US012672674B2

(12) United States Patent
Aoyama et al.

(10) Patent No.: US 12,672,674 B2
(45) Date of Patent: Jul. 7, 2026

(54) POWER SUPPLY UNIT FOR AEROSOL GENERATING DEVICE

(71) Applicant: Japan Tobacco Inc., Tokyo (JP)

(72) Inventors: Tatsunari Aoyama, Tokyo (JP); Hiroshi Kawanago, Tokyo (JP); Toru Nagahama, Tokyo (JP); Takashi Fujiki, Tokyo (JP); Ryo Yoshida, Tokyo (JP)

(73) Assignee: JAPAN TOBACCO INC., Tokyo (JP)

( * ) Notice: Subject to any disclaimer, the term of this patent is extended or adjusted under 35 U.S.C. 154(b) by 479 days.

(21) Appl. No.: 18/502,052

(22) Filed: Nov. 5, 2023

(65) Prior Publication Data

US 2024/0122247 A1 Apr. 18, 2024

Related U.S. Application Data

(63) Continuation of application No. PCT/JP2022/008369, filed on Feb. 28, 2022.

(30) Foreign Application Priority Data

May 10, 2021 (JP) ..... 2021-079882

(51) Int. Cl.
*A24F 40/46* (2020.01)

(52) U.S. Cl.
CPC ..... *A24F 40/46* (2020.01)

(58) Field of Classification Search
CPC ..... A24F 40/10; A24F 40/20; A24F 40/46; A24F 40/50; A24F 40/30; A24F 40/51;
(Continued)

(56) References Cited

U.S. PATENT DOCUMENTS

2020/0046031 A1 2/2020 Bernauer et al.
2020/0338282 A1* 10/2020 Trzecieski ..... A24F 40/53
2022/0287373 A1 9/2022 Lin et al.

FOREIGN PATENT DOCUMENTS

CN 1126425 A 7/1996
CN 104664605 A 6/2015
(Continued)

OTHER PUBLICATIONS

Extended European Search Report issued Apr. 2, 2025 in corresponding European Patent Application No. 22807089.2, 6 pages.
(Continued)

*Primary Examiner* — Bryan R Perez
(74) *Attorney, Agent, or Firm* — XSENSUS LLP

(57) ABSTRACT

A power supply unit for an aerosol generating device includes a power supply, a heater connector connected to a heater, a voltage conversion IC, a circuit board, a capacitor, a first ground provided inside the circuit board and connected to the other end of the capacitor, a second ground provided inside the circuit board, insulated from the first ground inside the circuit board, and connected to the detection terminal, and a common ground configured to electrically connect the first ground and the second ground. On the second surface, no electronic component is provided in a common ground projection region overlapping with the common ground when viewed from a direction orthogonal to the circuit board.

11 Claims, 26 Drawing Sheets

(58) Field of Classification Search
CPC ..... A24F 40/57; A24F 40/40; A24F 40/42; A24F 40/05; A24F 40/53; A24F 40/90; A24F 40/60; A24F 40/485; A24F 40/65; A24F 40/70; A24F 40/44; A24F 40/95
See application file for complete search history.

(56) References Cited

FOREIGN PATENT DOCUMENTS

| | | | |
|---|---|---|---|
| CN | 110547516 | A | 12/2019 |
| JP | 6833093 | B1 | 2/2021 |

OTHER PUBLICATIONS

International Search Report and Written Opinion mailed on May 10, 2022, received for PCT Application PCT/JP2022/008369, filed on Feb. 28, 2022, 8 pages including English Translation.

* cited by examiner

POWER SUPPLY UNIT FOR AEROSOL GENERATING DEVICE

CROSS-REFERENCE TO RELATED APPLICATIONS

This is a continuation of International Application No. PCT/JP2022/008369 filed on Feb. 28, 2022, and claims priority from Japanese Patent Application No. 2021-079882 filed on May 10, 2021, the entire content of each is incorporated herein by reference.

TECHNICAL FIELD

The present disclosure relates to a power supply unit for an aerosol generating device.

BACKGROUND ART

CN110547516A and CN104664605A describe a power supply unit for an aerosol generating device, the power supply unit being equipped with a voltage conversion IC which steps up and/or steps down a power. In the power supply unit for the aerosol generating device, a power supply voltage is converted by the voltage conversion IC and then supplied to a heater in order to improve an efficiency of aerosol generating. A ground of an element connected to an input and output line of the voltage conversion IC is preferably separated from another ground for a signal because voltage fluctuation or noise occurs.

When a ground for a power supply and a ground for a signal are separated, it is considered to provide a common ground to eliminate a potential deviation between these grounds.

However, in a case where a common ground is provided, heat and noise are generated due to elimination of a potential deviation, and thus there is room for consideration of how to dispose electronic components on a circuit board.

SUMMARY

The present disclosure provides a power supply unit for an aerosol generating device in which electronic components are appropriately disposed on a circuit board.

According to an aspect of the present disclosure, there is provided a power supply unit for an aerosol generating device includes a power supply, a heater connector connected to a heater configured to heat an aerosol source by consuming power supplied from the power supply, a voltage conversion IC connected to the heater connector and including an output terminal configured to convert and output an input voltage and a detection terminal configured to detect a voltage output from the output terminal, a circuit board including a first surface on which the voltage conversion IC is disposed and a second surface which is a back surface of the first surface, a capacitor having one end connected to the output terminal, a first ground provided inside the circuit board and connected to an other end of the capacitor, a second ground provided inside the circuit board, insulated from the first ground inside the circuit board, and connected to the detection terminal, and a common ground configured to electrically connect the first ground and the second ground, in which on the second surface, no electronic component is provided in a common ground projection region overlapping with the common ground when viewed from a direction orthogonal to the circuit board.

According to the present disclosure, the electronic components can be appropriately disposed on the circuit board, and the operation of the power supply unit for an aerosol generating device is stabilized.

DESCRIPTION OF EMBODIMENTS

Hereinafter, an inhaling system as an embodiment of an aerosol generating device according to the present disclosure will be described with reference to the drawings. The inhaling system includes a non-combustion inhaler 100 (hereinafter, also simply referred to as "inhaler 100") which is an embodiment of a power supply unit according to the present disclosure, and a rod 500 heated by the inhaler 100. In the following description, a configuration in which the inhaler 100 accommodates a heating unit in an undetachable manner will be described as an example. However, the heating unit may be attachable to and detachable from the inhaler 100. For example, the rod 500 and the heating unit may be integrated and attachable to and detachable from the inhaler 100. That is, the power supply unit for the aerosol generating device may have a configuration that does not include the heating unit as a component. The term "undetachable" refers to an aspect in which detachment cannot be performed as long as in an assumed application. Alternatively, an induction heating coil provided in the inhaler 100 and a susceptor built in the rod 500 may cooperate to constitute the heating unit.

Figure 1:
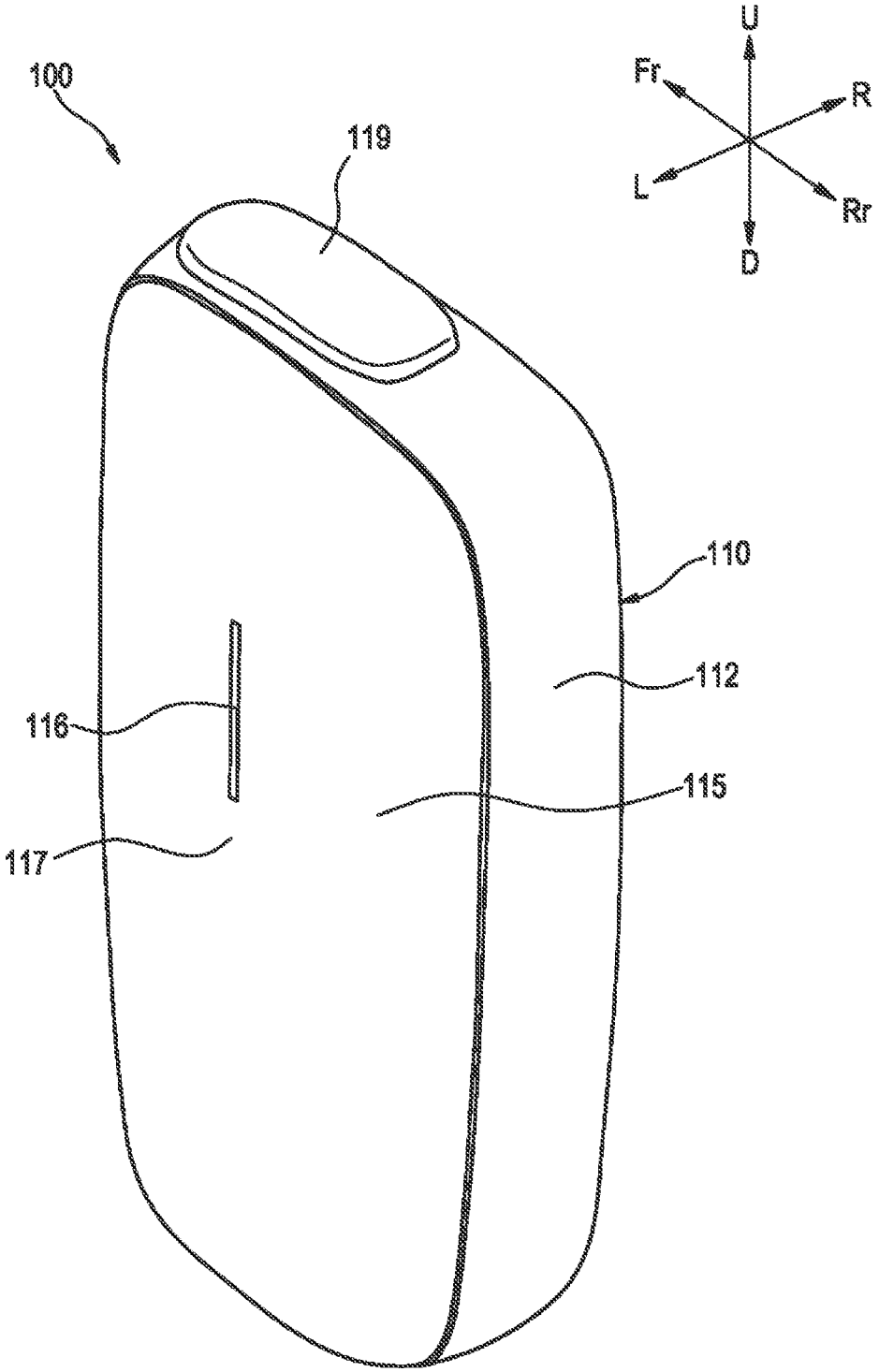
FIG. 1 is a perspective view of a non-combustion inhaler.
Figure 2:
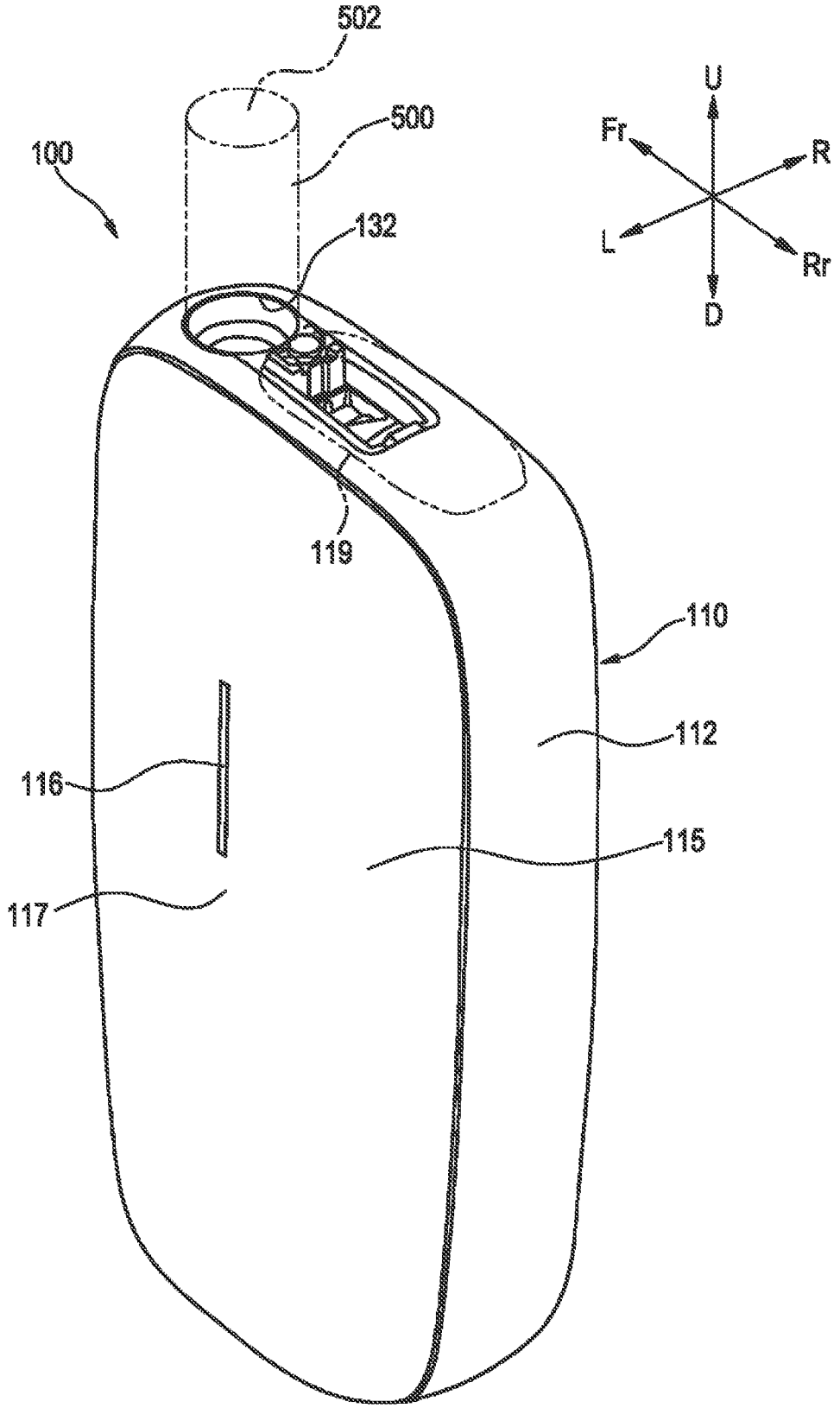
FIG. 2 is a perspective view of the non-combustion inhaler with a rod attached.
Figure 3:
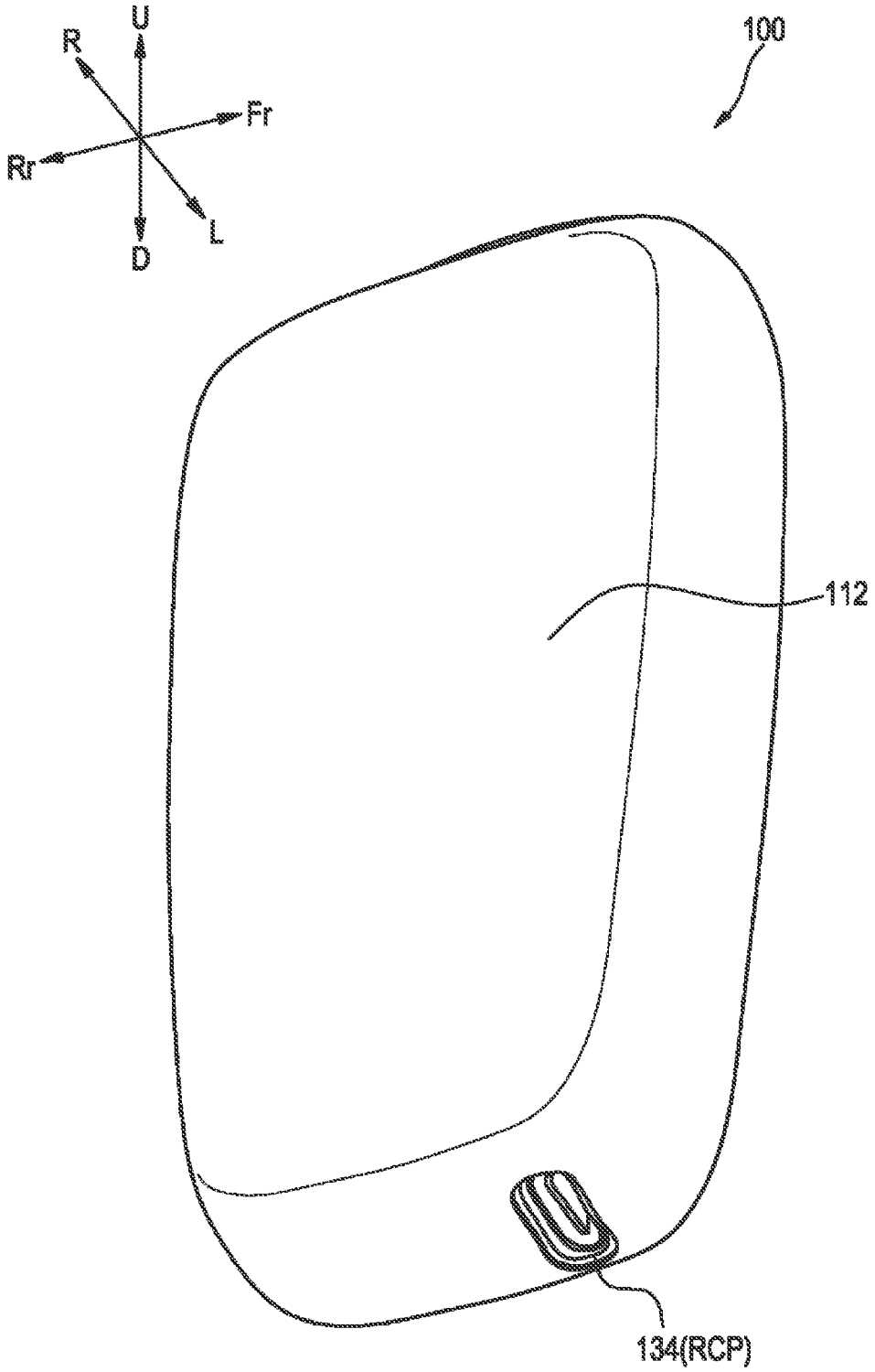
FIG. 3 is another perspective view of the non-combustion inhaler.
Figure 4:
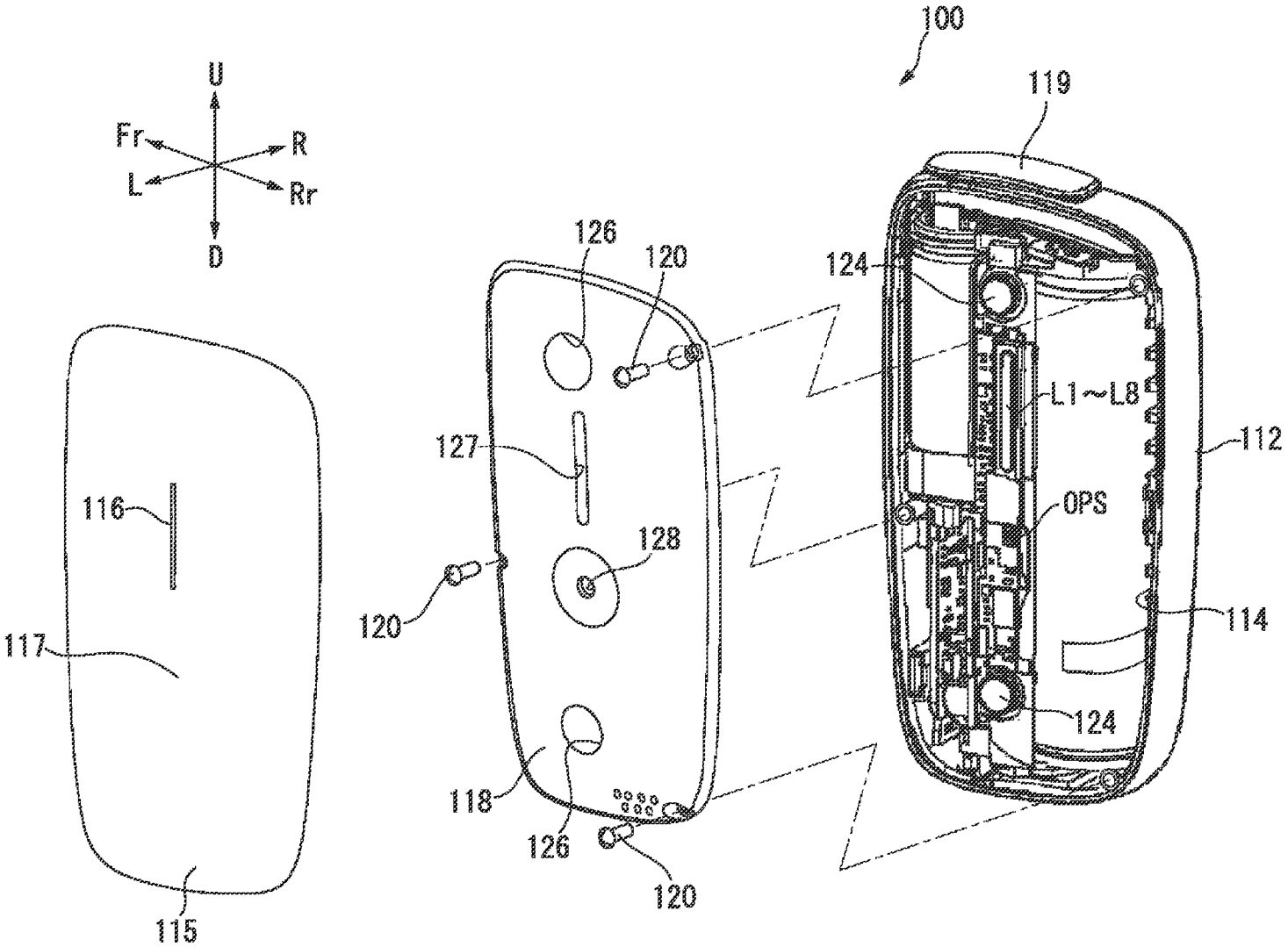
FIG. 4 is an exploded perspective view of the non-combustion inhaler.

FIG. 1 is a perspective view illustrating an overall configuration of the inhaler 100. FIG. 2 is a perspective view of the inhaler 100 with the rod 500 attached. FIG. 3 is another perspective view of the inhaler 100. FIG. 4 is an exploded perspective view of the inhaler 100. In addition, in the following description, for convenience, an orthogonal coordinate system in a three-dimensional space in which three directions orthogonal to one another are defined as a front-rear direction, a left-right direction, and an up-down direction will be described. In the drawings, a front side is denoted by Fr, a rear side is denoted by Rr, a right side is denoted by R, a left side is denoted by L, an upper side is denoted by U, and a lower side is denoted by D.

The inhaler 100 is configured to generate an aerosol containing a flavor by heating the rod 500 which is elongated and substantially columnar (see FIG. 2) as an example of a flavor component generating base material having a filler containing an aerosol source and a flavor source.

<Flavor Component Generating Base Material (Rod)>

The rod 500 includes a filler containing an aerosol source which is heated at a predetermined temperature to generate aerosol.

The type of the aerosol source is not particularly limited, and an extract substance from various natural products and/or a constituent component thereof can be selected according to a purpose. The aerosol source may be a solid, or may be, for example, a polyhydric alcohol such as glycerin or propylene glycol, or a liquid such as water. The aerosol source may include a flavor source such as a tobacco raw material which releases a flavor component by heating, or an extract originated from a tobacco raw material. The gas to which the flavor component is added is not limited to the aerosol, and for example, invisible steam may be generated.

The filler of the rod 500 may contain cut tobacco as the flavor source. A material of the cut tobacco is not specifically limited, and publicly known material such as a lamina and a stem may be used as the material. The filler may contain one kind or two or more kinds of flavors. The kinds of flavors are not specifically limited, however, in view of provision of satisfactory smoke flavor, a flavor is menthol, preferably. The flavor source may contain plants other than tobacco (for example, mints, herbal medicines, or herbs). The rod 500 may not contain a flavor source depending on the purpose.

<Overall Configuration of Non-Combustion Inhaler>

Next, an overall configuration of the inhaler 100 will be described with reference to FIGS. 1 to 4.

The inhaler 100 includes a substantially rectangular case 110 having a front surface, a rear surface, a left surface, a right surface, an upper surface, and a lower surface. The case 110 includes a bottomed tubular case main body 112 in which the front surface, the rear surface, the upper surface, the lower surface, and the right surface are integrally formed, an outer panel 115 and an inner panel 118 which seal an opening portion 114 (see FIG. 4) of the case main body 112 and constitute the left surface, and a slider 119.

The inner panel 118 is fixed to the case main body 112 by bolts 120. The outer panel 115 is fixed to the case main body 112 by magnets 124 held by an insulating chassis 150 (see FIG. 5) to be described later accommodated in the case main body 112, so as to cover an outer surface of the inner panel 118. The outer panel 115 is fixed by the magnets 124, so that a user may replace the outer panel 115 as desired.

The inner panel 118 is provided with two through holes 126 through which the magnets 124 pass. The inner panel 118 is further provided with a vertically long hole 127 and a circular round hole 128 between the two through holes 126 disposed vertically. The long hole 127 is used to transmit light emitted from eight light emitting diodes (LEDs) L1 to L8 built in the case main body 112. A button-type operation switch OPS built in the case main body 112 passes through the round hole 128. Accordingly, the user can detect the light emitted from the eight LEDs L1 to L8 through a LED window 116 of the outer panel 115. In addition, the user can press down the operation switch OPS via a pressing portion 117 of the outer panel 115.

As illustrated in FIG. 2, an opening 132 into which the rod 500 may be inserted is provided in the upper surface of the case main body 112. The slider 119 is coupled to the case main body 112 between a position where the opening 132 is closed (see FIG. 1) and a position where the opening 132 is opened (see FIG. 2), so as to be movable in the front-rear direction.

The operation switch OPS is used to perform various operations of the inhaler 100. For example, the user operates the operation switch OPS via the pressing portion 117 in a state where the rod 500 is inserted into the opening 132 and mounted as illustrated in FIG. 2. Accordingly, the rod 500 is heated by the heating unit 170 (see FIG. 5) without combustion. In a case where the rod 500 is heated, aerosol is generated from the aerosol source contained in the rod 500, and the flavor of the flavor source contained in the rod 500 is added to the aerosol. The user can inhale the aerosol containing the flavor by holding in the mouth an inhaling port 502 of the rod 500 protruding from the opening 132 to perform inhaling.

As illustrated in FIG. 3, a charging terminal 134 which is electrically connected to an external power supply such as an outlet or a mobile battery and receives supply of power is provided on the lower surface of the case main body 112. In the present embodiment, the charging terminal 134 is a universal serial bus (USB) Type-C receptacle, but is not limited thereto. The charging terminal 134 is hereinafter also referred to as a receptacle RCP.

The charging terminal 134 may include, for example, a power receiving coil, and may receive power transmitted from the external power supply in a non-contact manner. A method of wireless power transfer in this case may be an electromagnetic induction type, a magnetic resonance type, or a combination of the electromagnetic induction type and the magnetic resonance type. As another example, the charging terminal 134 may be connectable to various USB terminals or the like, and may include the above-described power receiving coil.

A configuration of the inhaler 100 illustrated in FIGS. 1 to 4 is merely an example. The inhaler 100 can be configured in various forms in which the rod 500 is held and applied with an action such as heating to generate a gas to which a flavor component is added from the rod 500, and a user can inhale the generated gas.

<Internal Configuration of Non-Combustion Inhaler>

An internal unit 140 of the inhaler 100 will be described with reference to FIGS. 5 to 8.

Figure 5:
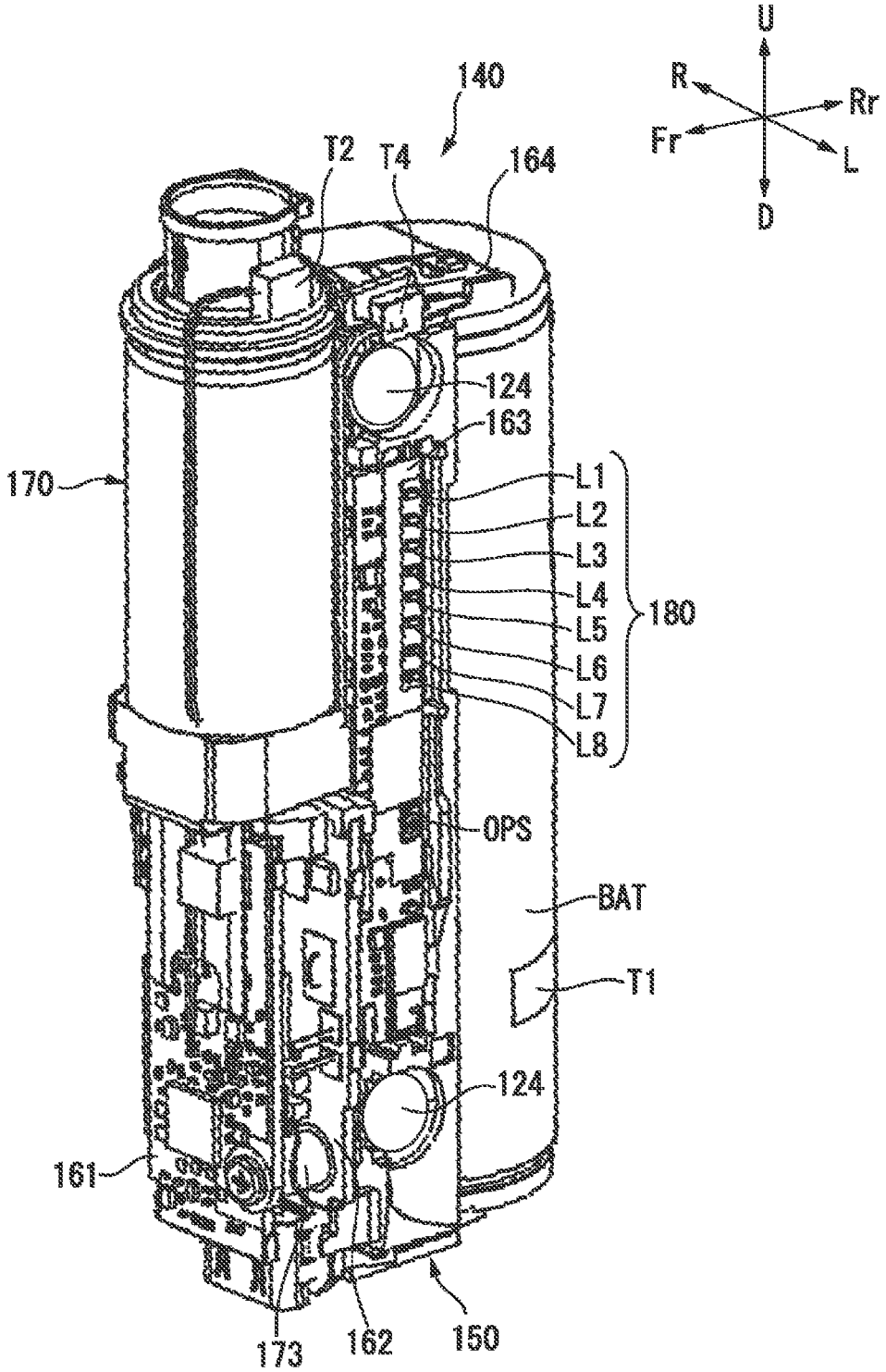
FIG. 5 is a perspective view of an internal unit of the non-combustion inhaler.
Figure 6:
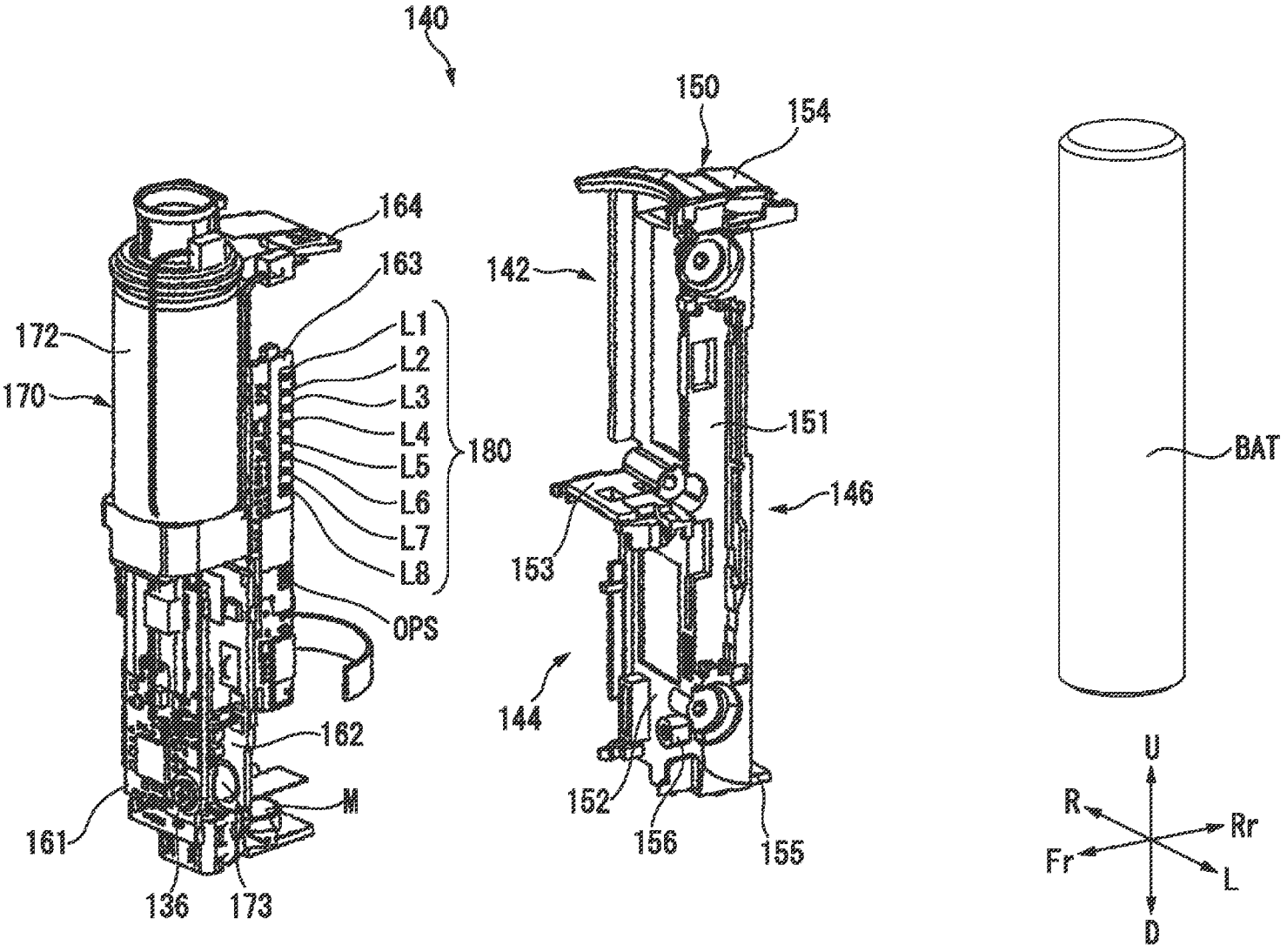
FIG. 6 is an exploded perspective view of the internal unit in FIG. 5.
Figure 7:
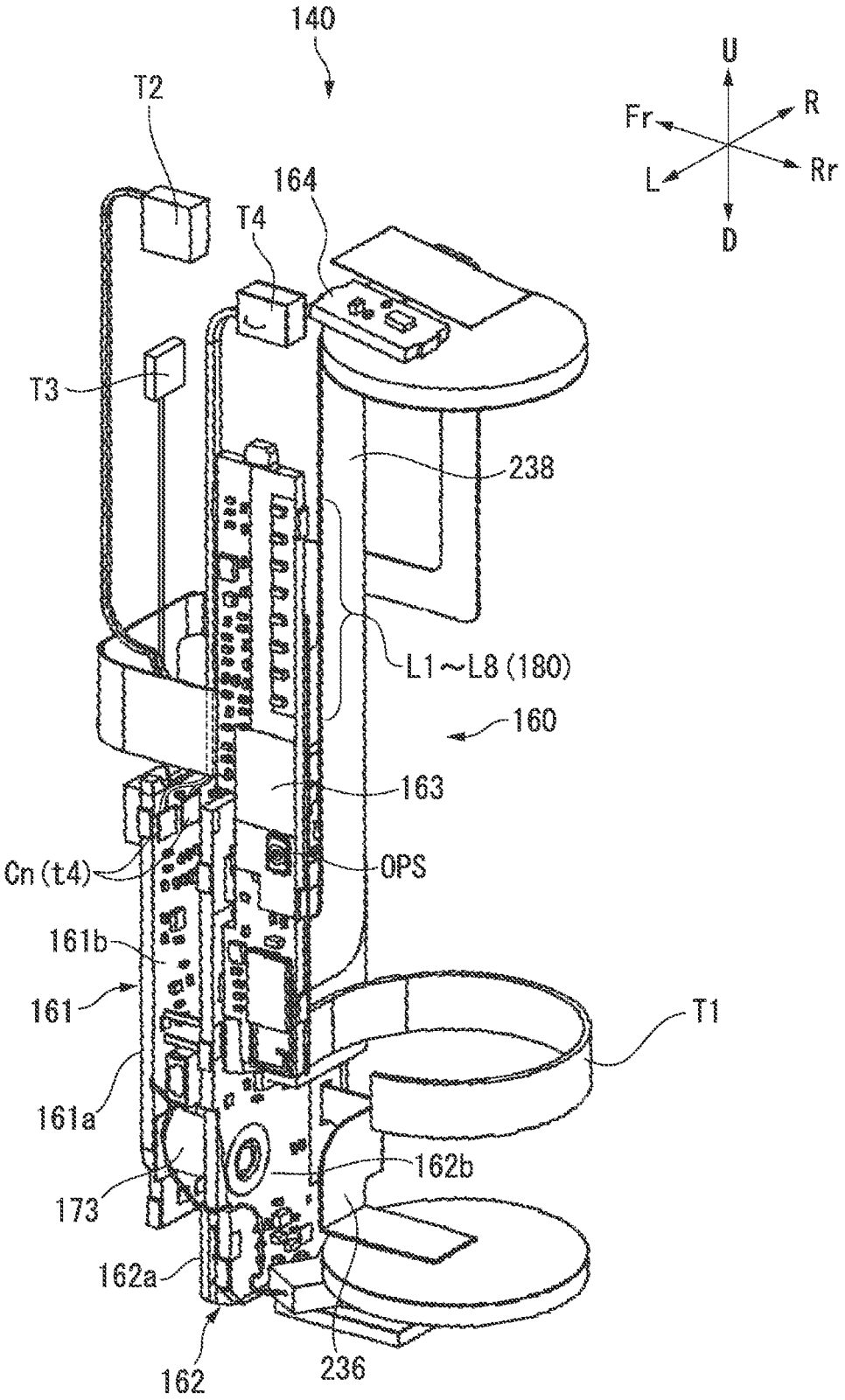
FIG. 7 is a perspective view of the internal unit with a power supply and a chassis removed.
Figure 8:
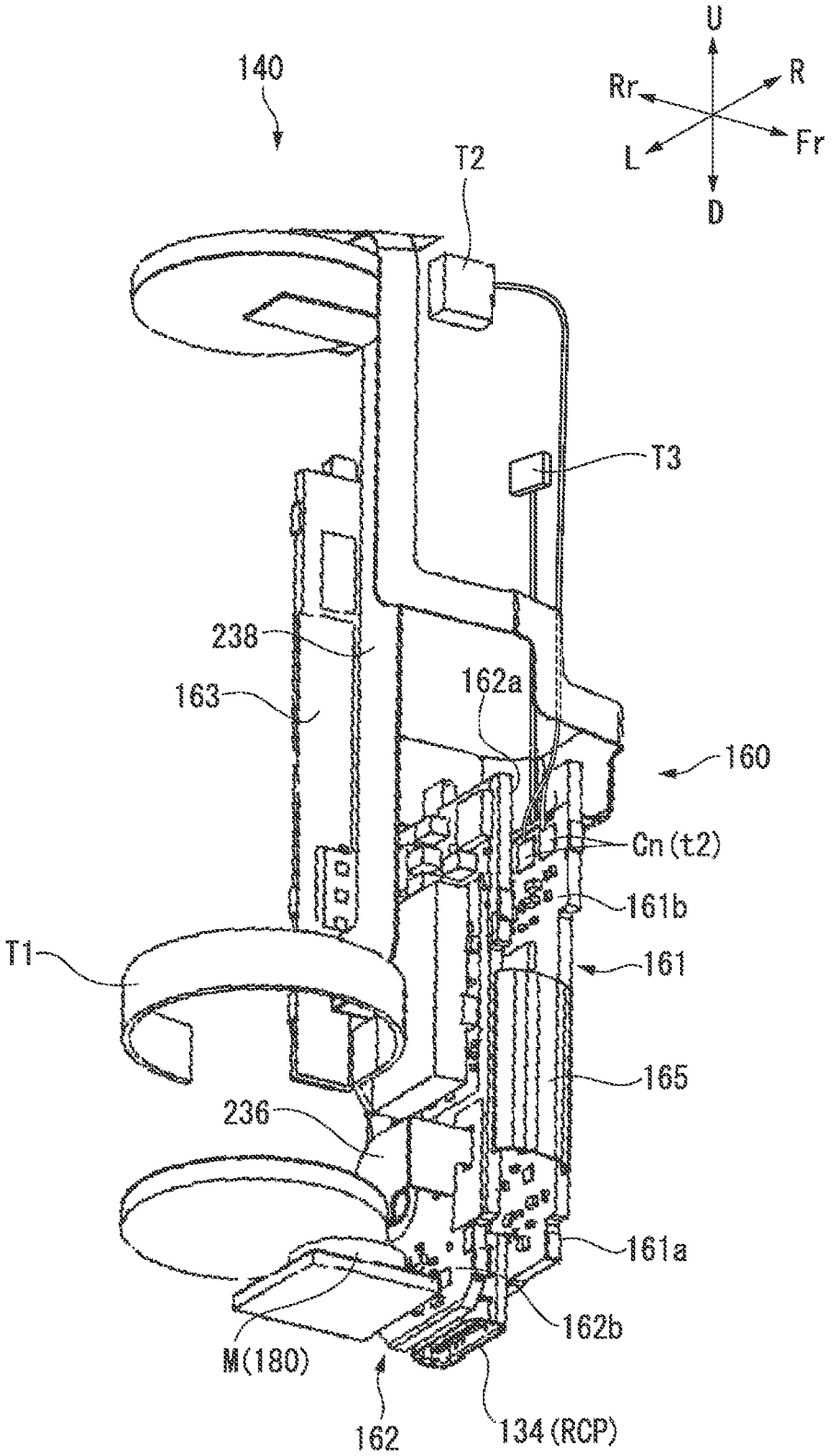
FIG. 8 is another perspective view of the internal unit with the power supply and the chassis removed.

FIG. 5 is a perspective view of the internal unit 140 of the inhaler 100. FIG. 6 is an exploded perspective view of the internal unit 140 in FIG. 5. FIG. 7 is a perspective view of the internal unit 140 from which a power supply BAT and the chassis 150 are removed. FIG. 8 is another perspective view of the internal unit 140 from which the power supply BAT and the chassis 150 are removed.

The internal unit 140 accommodated in an internal space of the case 110 includes the chassis 150, the power supply BAT, a circuit unit 160, a heating unit 170, a notification unit 180, and various sensors.

The chassis 150 is made of an insulating material, such as a resin, which has a property that does not allow heat to pass through easily. The chassis 150 includes a plate-shaped chassis main body 151 which is disposed substantially in a center of the internal space of the case 110 in the front-rear direction and which extends in the up-down direction and the front-rear direction, a plate-shaped front-rear dividing wall 152 which is disposed substantially in the center of the internal space of the case 110 in the front-rear direction and which extends in the up-down direction and the left-right direction, a plate-shaped up-down dividing wall 153 which extends forward from substantially a center of the front-rear dividing wall 152 in the up-down direction, a plate-shaped chassis upper wall 154 which extends rearward from upper edge portions of the front-rear dividing wall 152 and the chassis main body 151, and a plate-shaped chassis lower wall 155 which extends rearward from lower edge portions of the front-rear dividing wall 152 and the chassis main body 151. A left surface of the chassis main body 151 is covered with the inner panel 118 and the outer panel 115 of the case 110 described above.

By the chassis 150, a heating unit accommodation region 142 is defined and formed in an upper front portion of the internal space of the case 110, a board accommodation region 144 is defined and formed in a lower front portion thereof, and a power supply accommodation space 146 is defined and formed in a rear portion thereof over the up-down direction.

The heating unit 170 accommodated in the heating unit accommodation region 142 is constituted by a plurality of tubular members, and the tubular members are concentrically disposed to form a tubular body as a whole. The heating unit 170 includes a rod accommodation portion 172 capable of accommodating a part of the rod 500 therein, and a heater HTR (see FIGS. 10 to 19) which heats the rod 500 from an outer periphery or a center. It is preferable that a surface of the rod accommodation portion 172 and the heater HTR are thermally insulated by forming the rod accommodation portion 172 with a heat insulating material or providing a heat insulating material inside the rod accommodation portion 172. The heater HTR may be an element capable of heating the rod 500. The heater HTR is, for example, a heating element. Examples of the heating element include a heating resistor, a ceramic heater, and an induction-heating-type heater. As the heater HTR, for example, a heater having a positive temperature coefficient (PTC) characteristic in which a resistance value increases with an increase in temperature is preferably used. Alternatively, a heater HTR having a negative temperature coefficient (NTC) characteristic in which the resistance value decreases with an increase in temperature may be used. The heating unit 170 has a function of defining a flow path of air supplied to the rod 500 and a function of heating the rod 500. The case 110 is formed with a vent hole (not illustrated) for allowing air to flow in so that air can flow into the heating unit 170.

The power supply BAT accommodated in the power supply accommodation space 146 is a rechargeable secondary battery, an electric double layer capacitor, or the like, and is preferably a lithium ion secondary battery. An electrolyte of the power supply BAT may be constituted by one or a combination of a gel electrolyte, an electrolytic solution, a solid electrolyte, and an ionic liquid.

The notification unit 180 notifies various types of information such as a state of charge (SOC) indicating a charging state of the power supply BAT, a preheating time at the time of inhaling, and an inhaling available period. The notification unit 180 according to the present embodiment includes the eight LEDs L1 to L8 and a vibration motor M. The notification unit 180 may be constituted by a light emitting element such as the LEDs L1 to L8, a vibration element such as the vibration motor M, or a sound output element. The notification unit 180 may be a combination of two or more elements among a light emitting element, a vibration element, and a sound output element.

The various sensors include an intake sensor which detects a puff operation (inhaling operation) of the user, a power supply temperature sensor which detects a temperature of the power supply BAT, a heater temperature sensor which detects a temperature of the heater HTR, a case temperature sensor which detects a temperature of the case 110, a cover position sensor which detects a position of the slider 119, a panel detection sensor which detects attachment and detachment of the outer panel 115, and the like.

The intake sensor mainly includes, for example, a thermistor T2 disposed in the vicinity of the opening 132. The power supply temperature sensor mainly includes, for example, a thermistor T1 disposed in the vicinity of the power supply BAT. The heater temperature sensor mainly includes, for example, a thermistor T3 disposed in the vicinity of the heater HTR. As described above, the rod accommodation portion 172 is preferably thermally insulated from the heater HTR. In this case, the thermistor T3 is preferably in contact with or close to the heater HTR inside the rod accommodation portion 172. In a case where the heater HTR has the PTC characteristic or the NTC characteristic, the heater HTR may be used for the heater temperature sensor. The case temperature sensor mainly includes, for example, a thermistor T4 disposed in the vicinity of the left surface of the case 110. The cover position sensor mainly includes a Hall IC 14 including a Hall element disposed in the vicinity of the slider 119. The panel detection sensor mainly includes a Hall IC 13 including a Hall element disposed in the vicinity of an inner surface of the inner panel 118.

The circuit unit 160 includes four circuit boards, a plurality of integrate circuits (ICs), and a plurality of elements. The four circuit boards include an MCU-mounted board 161 to be described later on which a micro controller unit (MCU) 1 and a charging IC 2 are mainly disposed, a receptacle-mounted board 162 on which the charging terminal 134 is mainly disposed, an LED-mounted board 163 on which the operation switch OPS, the LEDs L1 to L8, and a communication IC 15 to be described later are disposed, and a Hall IC-mounted board 164 on which the Hall IC 14 to be described later including a Hall element constituting the cover position sensor is disposed.

The MCU-mounted board 161 and the receptacle-mounted board 162 are disposed in parallel with each other in the board accommodation region 144. Specifically, the MCU-mounted board 161 and the receptacle-mounted board 162 are disposed such that element disposition surfaces thereof extend in the left-right direction and the up-down direction, and the MCU-mounted board 161 is disposed in front of the receptacle-mounted board 162. Each of the MCU-mounted board 161 and the receptacle-mounted board 162 is provided with an opening portion. The MCU-mounted board 161 and the receptacle-mounted board 162 are fastened, by a bolt 136, to a board fixing portion 156 of the front-rear dividing wall 152 in a state where a cylindrical spacer 173 is interposed between peripheral portions of the respective opening portions. That is, the spacer 173, together with the chassis 150, fixes positions of the MCU-mounted board 161 and the receptacle-mounted board 162 inside the case 110, and mechanically connects the MCU-mounted board 161 and the receptacle-mounted board 162. Accordingly, the MCU-mounted board 161 and the receptacle-mounted board 162 come into contact with each other, and it is possible to prevent the occurrence of a short-circuit current therebetween. The spacer 173 may have conductivity, and a ground of the MCU-mounted board 161 and a ground of the receptacle-mounted board 162 may be connected via the spacer 173.

For convenience, assuming that the surfaces of the MCU-mounted board 161 and the receptacle-mounted board 162 facing the front are main surfaces 161*a* and 162*a*, respectively, and surfaces opposite to the main surfaces 161*a* and 162*a* are secondary surfaces 161*b* and 162*b*, respectively, the secondary surface 161*b* of the MCU-mounted board 161 and the main surface 162*a* of the receptacle-mounted board 162 face each other with a predetermined gap therebetween. The main surface 161*a* of the MCU-mounted board 161 faces the front surface of the case 110, and the secondary surface 162*b* of the receptacle-mounted board 162 faces the front-rear dividing wall 152 of the chassis 150. The MCU-mounted board 161 and the receptacle-mounted board 162 are electrically connected via a flexible wiring board 165. A thermal diffusion member 300 to be described later is provided on the secondary surface 162*b* of the receptacle-mounted board 162.

The LED-mounted board 163 is disposed on a left side surface of the chassis main body 151 and between the two magnets 124 disposed vertically. An element disposition surface of the LED-mounted board 163 is disposed along the up-down direction and the front-rear direction. In other words, element disposition surfaces of the MCU-mounted board 161 and the receptacle-mounted board 162 are orthogonal to the element disposition surface of the LED-mounted board 163. In this way, the element disposition surfaces of the MCU-mounted board 161 and the receptacle-mounted board 162 and the element disposition surface of the LED-mounted board 163 are not limited to being orthogonal to one another, and preferably intersect with one another (not parallel with one another). The vibration motor M constituting the notification unit 180 together with the LEDs L1 to L8 is fixed to a lower surface of the chassis lower wall 155 and is electrically connected to the MCU-mounted board 161.

The Hall IC-mounted board 164 is disposed on the upper surface of the chassis upper wall 154.

<Operation Modes of Inhaler>

Figure 9:
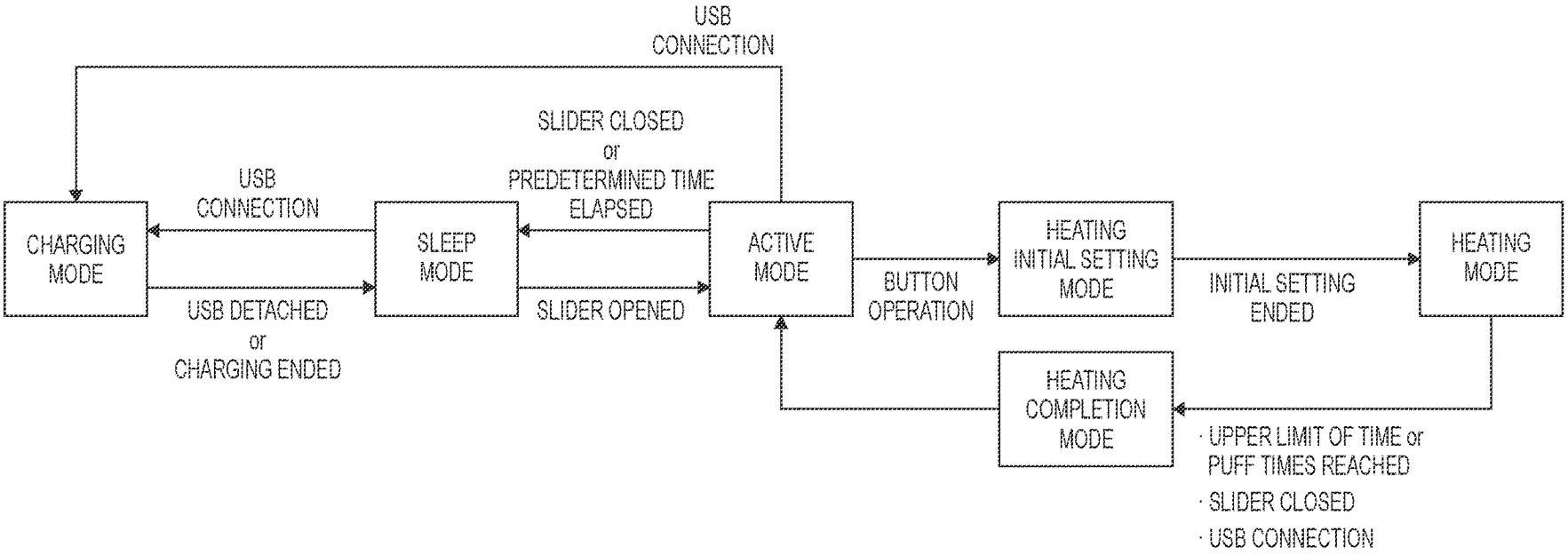
FIG. 9 is a schematic diagram for illustrating operation modes of the inhaler.

FIG. 9 is a schematic diagram for illustrating operation modes of the inhaler 100. As illustrated in FIG. 9, the operation modes of the inhaler 100 include a charging mode, a sleep mode, an active mode, a heating initial setting mode, a heating mode, and a heating completion mode.

The sleep mode is a mode in which supply of power to electronic components mainly required for heating control of the heater HTR is stopped to save power.

The active mode is a mode in which most of the functions excluding the heating control of the heater HTR are enabled. The inhaler 100 switches the operation mode to the active mode in a case where the slider 119 is opened in a state of operating in the sleep mode. The inhaler 100 switches the operation mode to the sleep mode in a case where the slider 119 is closed or a non-operation time of the operation switch OPS reaches a predetermined time in a state of operating in the active mode.

The heating initial setting mode is a mode for performing initial setting of control parameters and the like for starting the heating control of the heater HTR. The inhaler 100 switches the operation mode to the heating initial setting mode in a case where the operation of the operation switch OPS is detected in a state of operating in the active mode, and switches the operation mode to the heating mode in a case where the initial setting is completed.

The heating mode is a mode in which the heating control of the heater HTR (heating control for aerosol generating and heating control for temperature detection) is executed. The inhaler 100 starts the heating control of the heater HTR in a case where the operation mode is switched to the heating mode.

The heating completion mode is a mode in which a completion process (storage process of heating history or the like) of the heating control of the heater HTR is executed. The inhaler 100 switches the operation mode to the heating completion mode in a case where an energization time to the heater HTR or the number of times of inhaling by the user reaches an upper limit or the slider 119 is closed in a state of operating in the heating mode, and switches the operation mode to the active mode in a case where the completion process is completed. The inhaler 100 switches the operation mode to the heating completion mode in a case where a USB connection is established in a state of operating in the heating mode, and switches the operation mode to the charging mode in a case where the completion process is completed. As illustrated in FIG. 9, in this case, the operation mode may be switched to the active mode before the operation mode is switched to the charging mode. In other words, the inhaler 100 may switch the operation mode in the order of the heating completion mode, the active mode, and the charging mode in a case where the USB connection is established in a state of operating in the heating mode.

The charging mode is a mode in which the power supply BAT is charged by power supplied from the external power supply connected to the receptacle RCP. The inhaler 100 switches the operation mode to the charging mode in a case where an external power supply is connected (USB connected) to the receptacle RCP in a state of operating in the sleep mode or the active mode. The inhaler 100 switches the operation mode to the sleep mode in a case where the charging of the power supply BAT is completed or the connection between the receptacle RCP and the external power supply is released in a state of operating in the charging mode.

<Outline of Circuit of Internal Unit>

Figure 10:
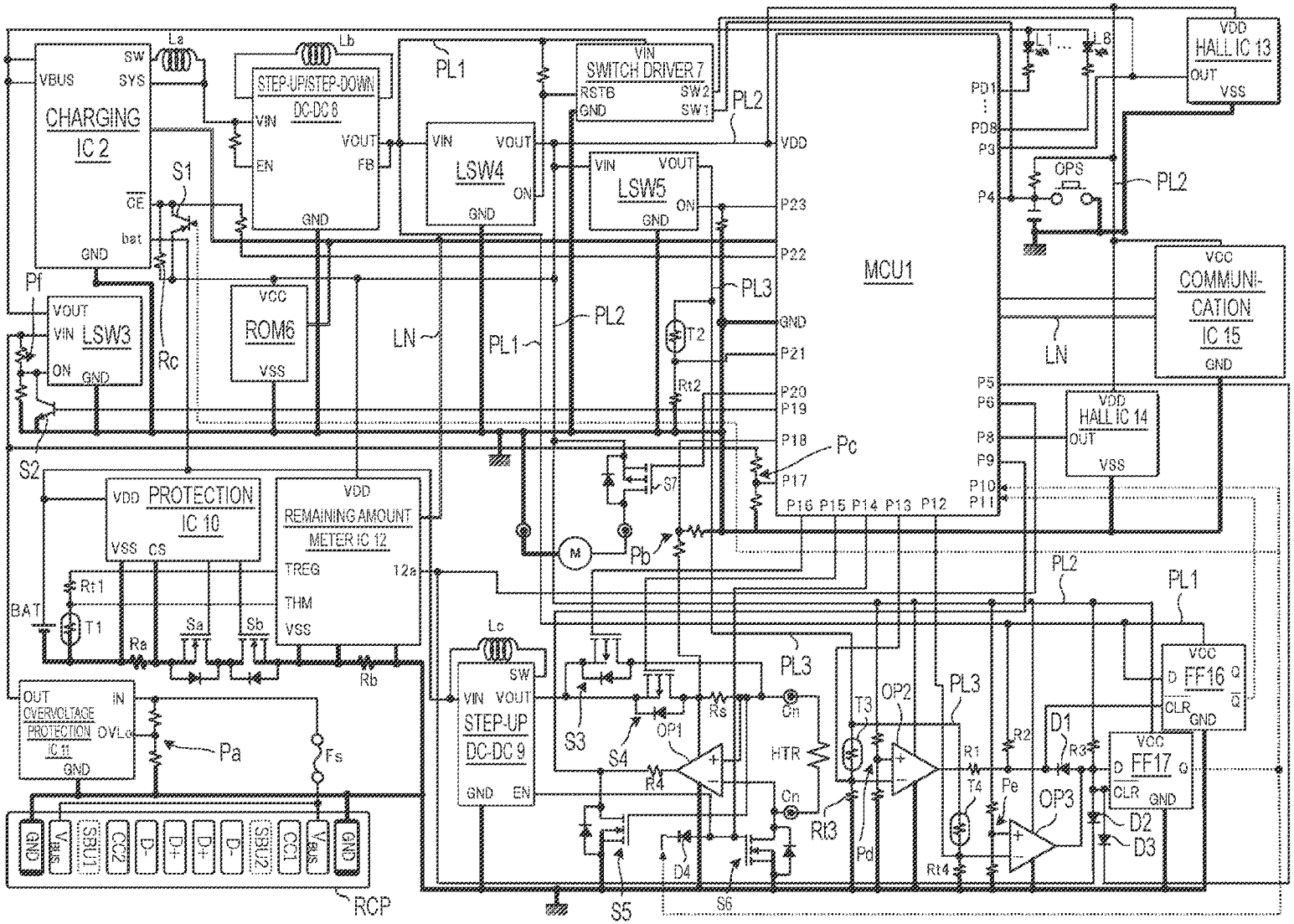
FIG. 10 is a diagram illustrating a schematic configuration of an electric circuit of the internal unit.
Figure 11:
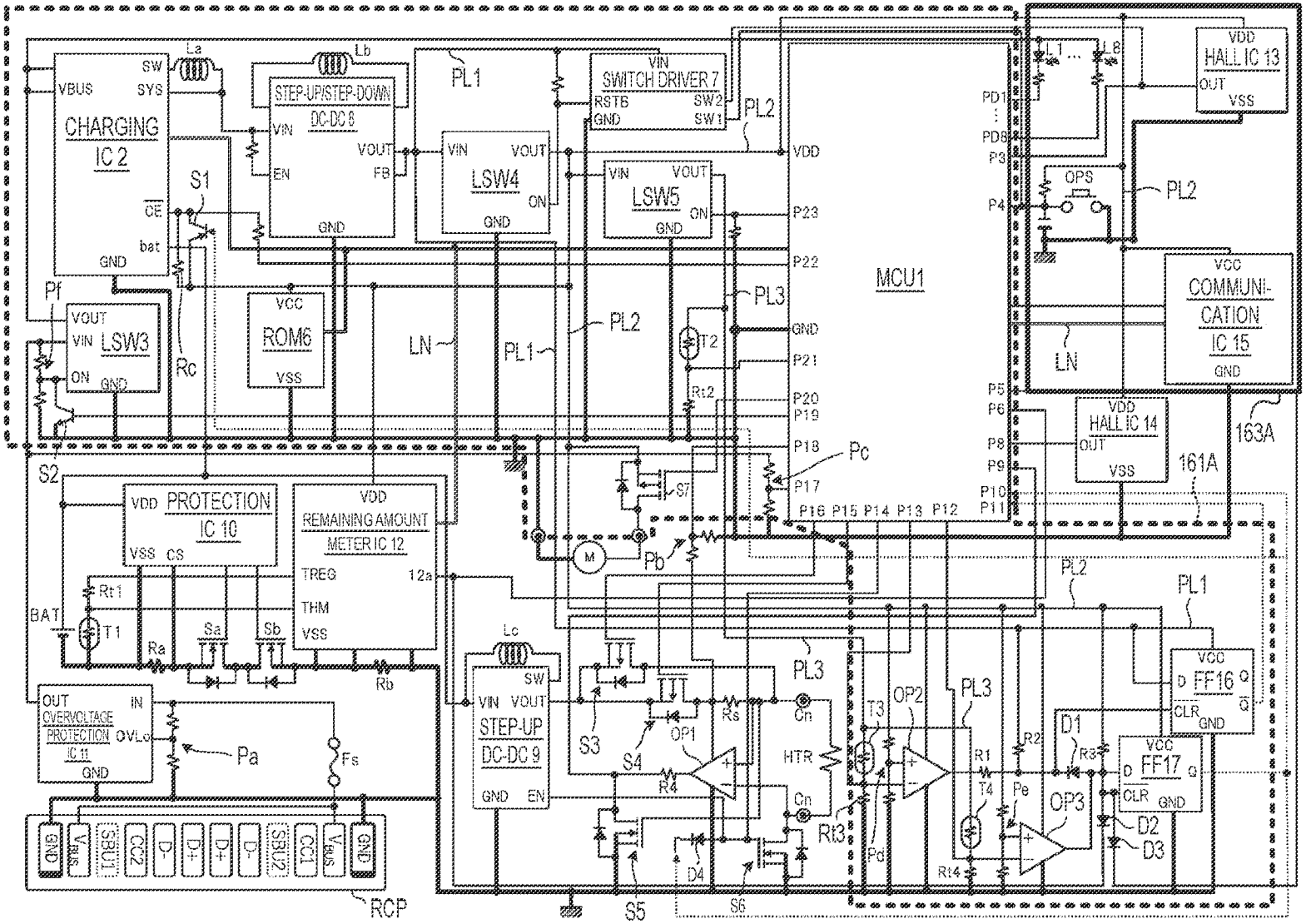
FIG. 11 is a diagram illustrating a schematic configuration of the electric circuit of the internal unit.
Figure 12:
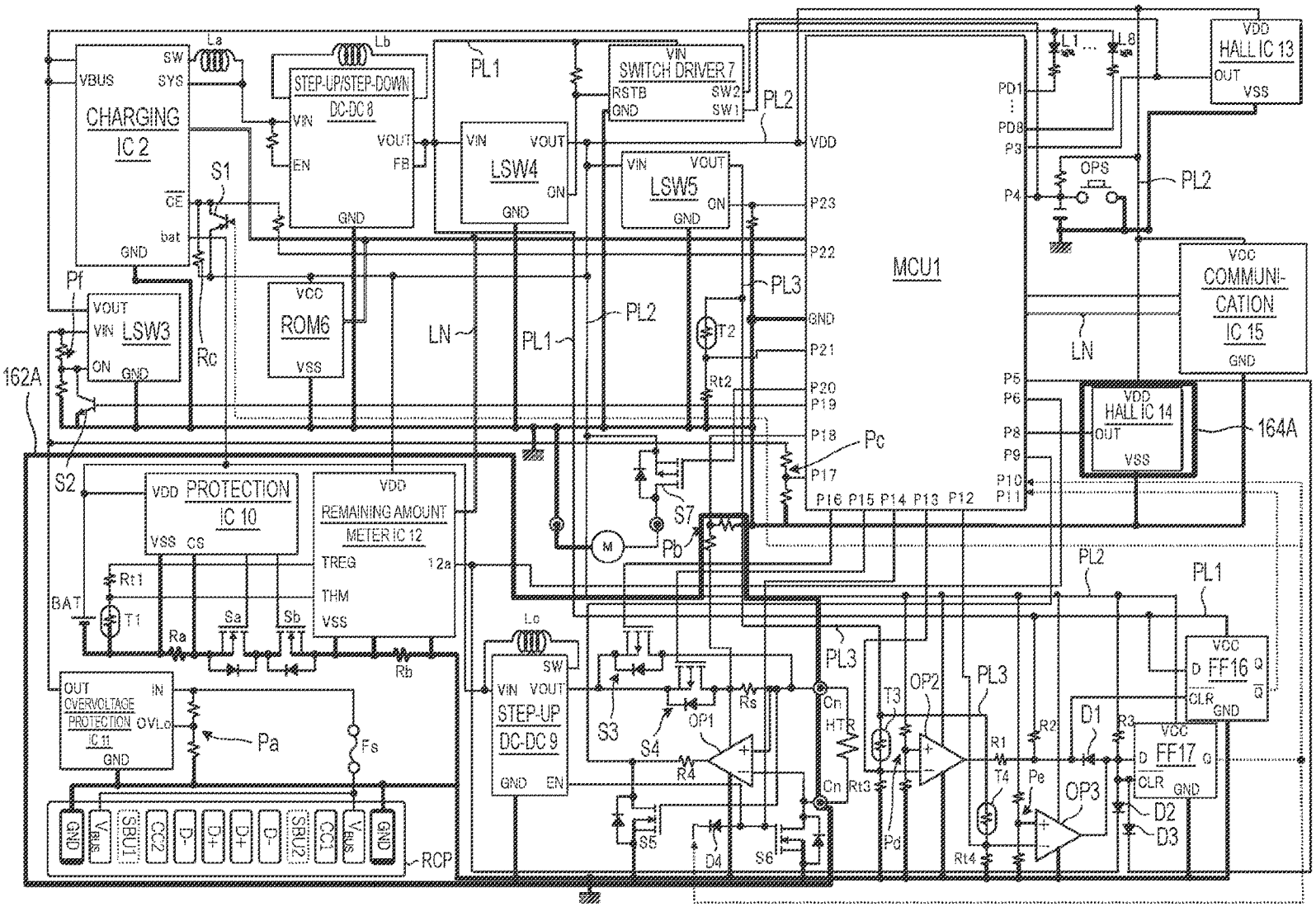
FIG. 12 is a diagram illustrating a schematic configuration of the electric circuit of the internal unit.

FIGS. 10, 11, and 12 are diagrams illustrating a schematic configuration of an electric circuit of the internal unit 140. FIG. 11 is the same as FIG. 10 except that a range 161A (range surrounded by a thick broken line) mounted on the MCU-mounted board 161 and a range 163A (range surrounded by a thick solid line) mounted on the LED-mounted board 163 are added in the electric circuit illustrated in FIG. 10. FIG. 12 is the same as FIG. 10 except that a range 162A mounted on the receptacle-mounted board 162 and a range 164A mounted on the Hall IC-mounted board 164 are added in the electric circuit illustrated in FIG. 10.

A wiring indicated by a thick solid line in FIG. 10 is a wiring having the same potential as a reference potential (ground potential) of the internal unit 140 (wiring connected to a ground provided in the internal unit 140), and this wiring is hereinafter referred to as a ground line. In FIG. 10, an electronic component in which a plurality of circuit elements are formed into a chip is indicated by a rectangle, and reference numerals of various terminals are described inside the rectangle. A power supply terminal VCC and a power supply terminal VDD mounted on the chip each indicate a power supply terminal on a high potential side. A power supply terminal VSS and a ground terminal GND mounted on the chip each indicate a power supply terminal on a low potential side (reference potential side). In the electronic component formed into a chip, a difference between a potential of the power supply terminal on the high potential side and a potential of the power supply terminal on the low potential side becomes a power supply voltage. The electronic component formed into a chip executes various functions using the power supply voltage.

As illustrated in FIG. 11, the MCU-mounted board 161 (range 161A) is provided with, as main electronic components, the MCU 1 which performs overall control of the inhaler 100, the charging IC 2 which performs charging control of the power supply BAT, load switches (hereinafter, LSW) 3, 4, and 5 configured by combining a capacitor, a resistor, a transistor, and the like, a read only memory (ROM) 6, a switch driver 7, a step-up/step-down DC/DC converter 8 (described as step-up/step-down DC/DC 8 in the drawing), an operational amplifier OP2, an operational amplifier OP3, flip-flops (hereinafter, FF) 16 and 17, a connector Cn (t2) electrically connected to the thermistor T2 constituting the intake sensor (described as the thermistor T2 connected to the connector in the drawing), a connector Cn (t3) electrically connected to the thermistor T3 constituting the heater temperature sensor (described as the thermistor T3 connected to the connector in the drawing), a connector Cn (t4) electrically connected to the thermistor T4 constituting the case temperature sensor (described as the thermistor T4 connected to the connector in the drawing), and a voltage divider circuit Pc for USB connection detection.

The ground terminal GND of each of the charging IC 2, LSW 3, LSW 4, LSW 5, the switch driver 7, the step-up/step-down DC/DC converter 8, the FF 16, and the FF 17 is connected to the ground line. The power supply terminal VSS of the ROM 6 is connected to the ground line. Negative power supply terminals of the operational amplifiers OP2 and the operational amplifier OP3 are connected to the ground line.

As illustrated in FIG. 11, the LED-mounted board 163 (range 163A) is provided with, as main electronic components, the Hall IC 13 including the Hall element constituting the panel detection sensor, the LEDs L1 to L8, the operation switch OPS, and the communication IC 15. The communication IC 15 is a communication module for communicating with an electronic device such as a smartphone. Each of the power supply terminal VSS of the Hall IC 13 and the ground terminal GND of the communication IC 15 is connected to the ground line. The communication IC 15 and the MCU 1 can communicate with each other via a communication line LN. One end of the operation switch OPS is connected to the ground line, and the other end of the operation switch OPS is connected to a terminal P4 of the MCU 1.

As illustrated in FIG. 12, the receptacle-mounted board 162 (range 162A) is provided with, as main electronic components, a power supply connector electrically connected to the power supply BAT (described as the power supply BAT connected to the power supply connector in the drawing), a connector electrically connected to the thermistor T1 constituting the power supply temperature sensor (described as the thermistor T1 connected to the connector in the drawing), the step-up DC/DC converter 9 (described as the step-up DC/DC 9 in the drawing), a protection IC 10, an overvoltage protection IC 11, a remaining amount meter IC 12, the receptacle RCP, the switch S3 to the switch S6 each constituted by a MOSFET, the operational amplifier OP1, and a pair of heater connectors Cn (positive electrode side and negative electrode side) electrically connected to the heater HTR.

The two ground terminals GND of the receptacle RCP, the ground terminal GND of the step-up DC/DC converter 9, the power supply terminal VSS of the protection IC 10, the power supply terminal VS S of the remaining amount meter IC 12, the ground terminal GND of the overvoltage protection IC 11, and the negative power supply terminal of the operational amplifier OP1 are each connected to the ground line.

As illustrated in FIG. 12, the Hall IC-mounted board 164 (range 164A) is provided with the Hall IC 14 including the Hall element constituting the cover position sensor. The power supply terminal VSS of the Hall IC 14 is connected to the ground line. An output terminal OUT of the Hall IC 14 is connected to a terminal P8 of the MCU 1. The MCU 1 detects opening and closing of the slider 119 based on a signal input to the terminal P8.

As illustrated in FIG. 11, a connector electrically connected to the vibration motor M is provided on the MCU-mounted board 161.

<Details of Circuit of Internal Unit>

A connection relation among the electronic components will be described below with reference to FIG. 10.

Two power supply input terminals $V_{BUS}$ of the receptacle RCP are each connected to an input terminal IN of the overvoltage protection IC 11 via a fuse Fs. In a case where a USB plug is connected to the receptacle RCP and a USB cable including the USB plug is connected to an external power supply, a USB voltage $V_{USB}$ is supplied to the two power supply input terminals $V_{BUS}$ of the receptacle RCP.

One end of a voltage divider circuit Pa including a series circuit of two resistors is connected to the input terminal IN of the overvoltage protection IC 11. The other end of the voltage divider circuit Pa is connected to the ground line. A connection point of the two resistors constituting the voltage divider circuit Pa is connected to a voltage detection terminal OVLo of the overvoltage protection IC 11. In a state where a voltage input to the voltage detection terminal OVLo is less than a threshold, the overvoltage protection IC 11 outputs the voltage input to the input terminal IN from the output terminal OUT. In a case where the voltage input to the voltage detection terminal OVLo is equal to or higher than a threshold (overvoltage), the overvoltage protection IC 11 stops the voltage output from the output terminal OUT (cuts off an electrical connection between the LSW 3 and the receptacle RCP) to protect the electronic components downstream of the overvoltage protection IC 11. The output terminal OUT of the overvoltage protection IC 11 is connected to an input terminal VIN of the LSW 3 and one end of the voltage divider circuit Pc (series circuit of two resistors) connected to the MCU 1. The other end of the voltage divider circuit Pc is connected to the ground line. A connection point of the two resistors constituting the voltage divider circuit Pc is connected to a terminal P17 of the MCU 1.

One end of a voltage divider circuit Pf including a series circuit of two resistors is connected to the input terminal VIN of the LSW 3. The other end of the voltage divider circuit Pf is connected to the ground line. A connection point of the two resistors constituting the voltage divider circuit Pf is connected to a control terminal ON of the LSW 3. A collector terminal of a bipolar transistor S2 is connected to the control terminal ON of the LSW 3. An emitter terminal of the bipolar transistor S2 is connected to the ground line. A base terminal of the bipolar transistor S2 is connected to a terminal P19 of the MCU 1. The LSW 3 outputs a voltage input to the input terminal VIN from an output terminal VOUT in a case where a signal input to the control terminal ON becomes a high level. The output terminal VOUT of the LSW 3 is connected to an input terminal VBUS of the charging IC 2.

The MCU 1 turns on the bipolar transistor S2 while the USB connection is not established. Accordingly, since the control terminal ON of the LSW 3 is connected to the ground line via the bipolar transistor S2, a low-level signal is input to the control terminal ON of the LSW 3.

The bipolar transistor S2 connected to the LSW 3 is turned off by the MCU 1 in a case where the USB connection is established. By turning off the bipolar transistor S2, the USB voltage $V_{USB}$ divided by the voltage divider circuit Pf is input to the control terminal ON of the LSW 3. Therefore, in a case where the USB connection is established and the bipolar transistor S2 is turned off, a high-level signal is input to the control terminal ON of the LSW 3. Accordingly, the LSW 3 outputs, from the output terminal VOUT, the USB voltage $V_{USB}$ supplied from the USB cable. Even when the USB connection is established in a state where the bipolar transistor S2 is not turned off, the control terminal ON of the LSW 3 is connected to the ground line via the bipolar transistor S2. Therefore, it should be noted that a low-level signal continues to be input to the control terminal ON of the LSW 3 unless the MCU 1 turns off the bipolar transistor S2.

A positive electrode terminal of the power supply BAT is connected to the power supply terminal VDD of the protection IC 10, an input terminal VIN of the step-up DC/DC converter 9, and a charging terminal bat of the charging IC 2. Therefore, the power supply voltage $V_{BAT}$ of the power supply BAT is supplied to the protection IC 10, the charging IC 2, and the step-up DC/DC converter 9. A resistor Ra, a switch Sa constituted by a MOSFET, a switch Sb constituted by a MOSFET, and a resistor Rb are connected in series to a negative electrode terminal of the power supply BAT in this order. A current detection terminal CS of the protection IC 10 is connected to a connection point between the resistor Ra and the switch Sa. Each of control terminals of the switch Sa and the switch Sb is connected to the protection IC 10. Both ends of the resistor Rb are connected to the remaining amount meter IC 12.

The protection IC 10 acquires, based on a voltage input to the current detection terminal CS (a voltage applied to both ends of the resistor Ra), a current value flowing through the resistor Ra during charging and discharging of the power supply BAT, and performs, when the current value is excessive (overcurrent), opening and closing control of the switch Sa and the switch Sb to stop the charging or the discharging of the power supply BAT, thereby protecting the power supply BAT. More specifically, in a case where an excessively large current value is acquired at the time of charging the power supply BAT, the protection IC 10 turns off the switch Sb to stop the charging of the power supply BAT. In a case where an excessively large current value is acquired at the time of discharging the power supply BAT, the protection IC 10 turns off the switch Sa to stop the discharging of the power supply BAT. In addition, in a case where a voltage value of the power supply BAT becomes abnormal based on the voltage input to the power supply terminal VDD (in a case of overcharge or overvoltage), the protection IC 10 performs opening and closing control of the switch Sa and the switch Sb to stop charging or discharging of the power supply BAT, thereby protecting the power supply BAT. More specifically, in a case where the overcharge of the power supply BAT is detected, the protection IC 10 turns off the switch Sb to stop the charging of the power supply BAT. In a case where the overdischarge of the power supply BAT is detected, the protection IC 10 turns off the switch S a to stop the discharging of the power supply BAT.

A resistor Rt1 is connected to the connector which is connected to the thermistor T1 disposed in the vicinity of the power supply BAT. A series circuit of the resistor Rt1 and the thermistor T1 is connected to the ground line and a regulator terminal TREG of the remaining amount meter IC 12. A connection point between the thermistor T1 and the resistor Rt1 is connected to a thermistor terminal THM of the remaining amount meter IC 12. The thermistor T1 may be a positive temperature coefficient (PTC) thermistor whose resistance value increases as the temperature increases, or may be a negative temperature coefficient (NTC) thermistor whose resistance value decreases as the temperature increases.

The remaining amount meter IC 12 detects a current flowing through the resistor Rb and derives battery information such as a remaining capacity of the power supply BAT, a state of charge (SOC) indicating a charging state, and a state of health (SOH) indicating a health state based on the detected current value. The remaining amount meter IC 12 supplies a voltage from a built-in regulator connected to the regulator terminal TREG to a voltage divider circuit of the thermistor T1 and the resistor Rt1. The remaining amount meter IC 12 acquires a voltage divided by the voltage divider circuit from the thermistor terminal THM, and acquires temperature information related to the temperature of the power supply BAT based on the voltage. The remaining amount meter IC 12 is connected to the MCU 1 via the communication line LN for serial communication, and is configured to be able to communicate with the MCU 1. The remaining amount meter IC 12 transmits the derived battery information and the acquired temperature information of the power supply BAT to the MCU 1 in response to a request from the MCU 1. The MCU 1 controls the discharging from the power supply BAT to the heater HTR based on a remaining capacity of the power supply BAT acquired by the remaining amount meter IC 12. That is, when the remaining capacity of the power supply BAT is equal to or less than a predetermined value, the MCU 1 performs a display for prohibiting the discharging to the heater HTR and prompting the charging. A plurality of signal lines such as a data line for data transmission and a clock line for synchronization are required to perform serial communication. It should be noted that only one signal line is illustrated in FIGS. 10 to 19 for simplification.

The remaining amount meter IC 12 includes a notification terminal 12*a*. The notification terminal 12*a* is connected to a terminal P6 of the MCU 1 and a cathode of a diode D2 to be described later. In a case where an abnormality such as an excessively high temperature of the power supply BAT is detected, the remaining amount meter IC 12 outputs a low-level signal from the notification terminal 12*a* to notify the MCU 1 of the occurrence of the abnormality. The low-level signal is also input to a CLR ($^{-}$) terminal of the FF 17 via the diode D2.

One end of a reactor Lc is connected to a switching terminal SW of the step-up DC/DC converter 9. The other end of the reactor Lc is connected to the input terminal VIN of the step-up DC/DC converter 9. The step-up DC/DC converter 9 performs ON/OFF control of a built-in transistor connected to the switching terminal SW, thereby performing voltage conversion control of stepping up an input voltage and outputs the stepped-up voltage from an output terminal VOUT thereof. The input terminal VIN of the step-up DC/DC converter 9 is connected to the power supply BAT and constitutes a power supply terminal on a high potential side of the step-up DC/DC converter 9. The step-up DC/DC converter 9 performs a step-up operation in a case where a signal input to an enable terminal EN is at a high level. In the USB-connected state, the signal input to the enable terminal EN of the step-up DC/DC converter 9 may be controlled to a low level by the MCU 1. Alternatively, in the USB-connected state, the MCU 1 may not control the signal input to the enable terminal EN of the step-up DC/DC converter 9 to make a potential of the enable terminal EN unstable.

A source terminal of a switch S4 constituted by a P-channel MOSFET is connected to the output terminal VOUT of the step-up DC/DC converter 9. A gate terminal of the switch S4 is connected to a terminal P15 of the MCU 1. One end of a resistor Rs is connected to a drain terminal of the switch S4. The other end of the resistor Rs is connected to the heater connector Cn on the positive electrode side connected to one end of the heater HTR. A voltage divider circuit Pb including two resistors is connected to a connection point between the switch S4 and the resistor Rs. A connection point of the two resistors constituting the voltage divider circuit Pb is connected to a terminal P18 of the MCU 1. A connection point between the switch S4 and the resistor Rs is further connected to a positive power supply terminal of the operational amplifier OP1.

A connection line between the output terminal VOUT of the step-up DC/DC converter 9 and the source terminal of the switch S4 is connected to a source terminal of the switch S3 constituted by a P-channel MOSFET. A gate terminal of the switch S3 is connected to the terminal P16 of the MCU 1. A drain terminal of the switch S3 is connected to a connection line between the resistor Rs and the heater connector Cn on the positive electrode side. In this way, a circuit including the switch S3 and a circuit including the switch S4 and the resistor Rs are connected in parallel between the output terminal VOUT of the step-up DC/DC converter 9 and the positive electrode side of the heater connector Cn. The circuit including the switch S3 does not include a resistor, and thus is a circuit having a lower resistance than the circuit including the switch S4 and the resistor Rs.

A non-inverting input terminal of the operational amplifier OP1 is connected to the connection line between the resistor Rs and the heater connector Cn on the positive electrode side. An inverting input terminal of the operational amplifier OP1 is connected to the heater connector Cn on the negative electrode side and a drain terminal of the switch S6, the heater connector Cn being connected to the other end of the heater HTR, the drain terminal of the switch S6 being constituted by an N-channel MOSFET. A source terminal of the switch S6 is connected to the ground line. A gate terminal of the switch S6 is connected to a terminal P14 of the MCU 1, an anode of the diode D4, and the enable terminal EN of the step-up DC/DC converter 9. A cathode of the diode D4 is connected to a Q terminal of the FF 17. One end of a resistor R4 is connected to an output terminal of the operational amplifier OP1. The other end of the resistor R4 is connected to a terminal P9 of the MCU 1 and a drain terminal of the switch S5 constituted by an N-channel MOSFET. A source terminal of the switch S5 is connected to the ground line. A gate terminal of the switch S5 is connected to the connection line between the resistor Rs and the heater connector Cn on the positive electrode side.

The input terminal VBUS of the charging IC 2 is connected to an anode of each of the LEDs L1 to L8. Cathodes of the LEDs L1 to L8 are connected to control terminals PD1 to PD8 of the MCU 1 via resistors for current limitation, respectively. That is, the LEDs L1 to L8 are connected in parallel with the input terminal VBUS. The LEDs L1 to L8 are configured to be able to be operated by the USB voltage $V_{USB}$ supplied from the USB cable connected to the receptacle RCP and a voltage supplied from the power supply BAT via the charging IC 2. Transistors (switching elements) connected to the control terminals PD1 to PD8 and the ground terminal GND are built in the MCU 1. The MCU 1 turns on the transistor connected to the control terminal PD1 to energize the LED L1 and turn on the LED L1. The MCU 1 turns off the transistor connected to the control terminal PD1 to turn off the LED L1. By switching ON and OFF of the transistor connected to the control terminal PD1 at a high speed, the luminance and the light emission pattern of the LED L1 can be dynamically controlled. Similarly, the LEDs L2 to L8 are controlled to be turned on and turned off by the MCU 1.

The charging IC 2 has a charging function of charging the power supply BAT based on the USB voltage $V_{USB}$ input to the input terminal VBUS. The charging IC 2 acquires a charging current or a charging voltage of the power supply BAT from a terminal or wiring (not illustrated), and performs charging control of the power supply BAT (control on supply of power from the charging terminal bat to the power supply BAT) based on the acquired charging current or charging voltage. In addition, the charging IC 2 may acquire, from the MCU 1, the temperature information of the power supply BAT transmitted from the remaining amount meter IC 12 to the MCU 1 through serial communication using the communication line LN and use the temperature information for charging control.

The charging IC 2 further includes a $V_{BAT}$ power path function and an OTG function. The V BAT power path function is a function of outputting, from an output terminal SYS, a system power supply voltage Vcc0 which is substantially equal to the power supply voltage $V_{BAT}$ input to the charging terminal bat. The OTG function is a function of outputting a system power supply voltage Vcc4 obtained by stepping up the power supply voltage $V_{BAT}$ input to the charging terminal bat from the input terminal VBUS. ON/OFF of the OTG function of the charging IC 2 is controlled by the MCU 1 through serial communication using the communication line LN. In the OTG function, the power supply voltage $V_{BAT}$ input to the charging terminal bat may be output as it is from the input terminal VBUS. In this case, the power supply voltage V BAT is substantially equal to the system power supply voltage Vcc4.

The output terminal SYS of the charging IC 2 is connected to an input terminal VIN of the step-up/step-down DC/DC converter 8. One end of a reactor La is connected to the switching terminal SW of the charging IC 2. The other end of the reactor La is connected to the output terminal SYS of the charging IC 2. A charge enable terminal CE(¯) of the charging IC 2 is connected to a terminal P22 of the MCU 1 via a resistor. Further, a collector terminal of the bipolar transistor S1 is connected to the charge enable terminal CE(¯) of the charging IC 2. An emitter terminal of the bipolar transistor S1 is connected to an output terminal VOUT of the LSW 4 to be described later. A base terminal of the bipolar transistor S1 is connected to the Q terminal of the FF 17. Further, one end of a resistor Rc is connected to the charge enable terminal CE(¯) of the charging IC 2. The other end of the resistor Rc is connected to the output terminal VOUT of the LSW 4.

A resistor is connected to the input terminal VIN and an enable terminal EN of the step-up/step-down DC/DC converter 8. By inputting the system power supply voltage Vcc0 from the output terminal SYS of the charging IC 2 to the input terminal VIN of the step-up/step-down DC/DC converter 8, a signal input to the enable terminal EN of the step-up/step-down DC/DC converter 8 becomes a high level, and the step-up/step-down DC/DC converter 8 starts a step-up operation or a step-down operation. The step-up/step-down DC/DC converter 8 steps up or steps down the system power supply voltage Vcc0 input to the input terminal VIN by switching control of a built-in transistor connected to a reactor Lb to generate a system power supply voltage Vcc1, and outputs the system power supply voltage Vcc1 from the output terminal VOUT. The output terminal VOUT of the step-up/step-down DC/DC converter 8 is connected to a feedback terminal FB of the step-up/step-down DC/DC converter 8, an input terminal VIN of the LSW 4, an input terminal VIN of the switch driver 7, and the power supply terminal VCC and a D terminal of the FF 16. A wiring to which the system power supply voltage Vcc1 output from the output terminal VOUT of the step-up/step-down DC/DC converter 8 is supplied is referred to as a power supply line PL1.

In a case where the signal input to a control terminal ON becomes a high level, the LSW 4 outputs, from the output terminal VOUT, the system power supply voltage Vcc1 input to the input terminal VIN. The control terminal ON of the LSW 4 and the power supply line PL1 are connected via a resistor. Therefore, by supplying the system power supply voltage Vcc1 to the power supply line PL1, the high-level signal is input to the control terminal ON of the LSW 4. The voltage output by the LSW 4 is the same as the system power supply voltage Vcc1 when a wiring resistance or the like is ignored, but in order to distinguish from the system power supply voltage Vcc1, the voltage output from the output terminal VOUT of the LSW 4 is hereinafter referred to as a system power supply voltage Vcc2.

The output terminal VOUT of the LSW 4 is connected to the power supply terminal VDD of the MCU 1, an input terminal VIN of the LSW 5, the power supply terminal VDD of the remaining amount meter IC 12, the power supply terminal VCC of the ROM 6, the emitter terminal of the bipolar transistor S1, the resistor Rc, and the power supply terminal VCC of the FF 17. A wiring to which the system power supply voltage Vcc2 output from the output terminal VOUT of the LSW 4 is supplied is referred to as a power supply line PL2.

When a signal input to a control terminal ON is at a high level, the LSW 5 outputs, from an output terminal VOUT, the system power supply voltage Vcc2 input to the input terminal VIN. The control terminal ON of the LSW 5 is connected to a terminal P23 of the MCU 1. A voltage output by the LSW 5 is the same as the system power supply voltage Vcc2 when a wiring resistance or the like is ignored, but in order to distinguish from the system power supply voltage Vcc2, the voltage output from the output terminal VOUT of the LSW 5 is hereinafter referred to as a system power supply voltage Vcc3. A wiring to which the system power supply voltage Vcc3 output from the output terminal VOUT of the LSW 5 is supplied is referred to as a power supply line PL3.

A series circuit of the thermistor T2 and a resistor Rt2 is connected to the power supply line PL3, and the resistor Rt2 is connected to the ground line. The thermistor T2 and the resistor Rt2 constitute a voltage divider circuit, and a connection point thereof is connected to a terminal P21 of the MCU 1. The MCU 1 detects a temperature variation (resistance value variation) of the thermistor T2 based on the voltage input to the terminal P21, and determines presence or absence of a puff operation based on a temperature variation amount.

A series circuit of the thermistor T3 and a resistor Rt3 is connected to the power supply line PL3, and the resistor Rt3 is connected to the ground line. The thermistor T3 and the resistor Rt3 constitute a voltage divider circuit, and a connection point thereof is connected to a terminal P13 of the MCU 1 and an inverting input terminal of the operational amplifier OP2. The MCU 1 detects a temperature of the thermistor T3 (corresponding to the temperature of the heater HTR) based on the voltage input to the terminal P13.

A series circuit of the thermistor T4 and a resistor Rt4 is connected to the power supply line PL3, and the resistor Rt4 is connected to the ground line. The thermistor T4 and the resistor Rt4 constitute a voltage divider circuit, and a connection point thereof is connected to a terminal P12 of the MCU 1 and an inverting input terminal of the operational amplifier OP3. The MCU 1 detects a temperature of the thermistor T4 (corresponding to the temperature of the case 110) based on the voltage input to the terminal P12.

A source terminal of a switch S7 implemented by a MOSFET is connected to the power supply line PL2. A gate terminal of the switch S7 is connected to a terminal P20 of the MCU 1. A drain terminal of the switch S7 is connected to one of a pair of connectors to which the vibration motor M is connected. The other of the pair of connectors is connected to the ground line. The MCU 1 can control opening and closing of the switch S7 by operating a potential of the terminal P20 to vibrate the vibration motor M in a specific pattern. A dedicated driver IC may be used instead of the switch S7.

A positive power supply terminal of the operational amplifier OP2 and a voltage divider circuit Pd (series circuit of two resistors) connected to a non-inverting input terminal of the operational amplifier OP2 are connected to the power supply line PL2. A connection point of the two resistors constituting the voltage divider circuit Pd is connected to the non-inverting input terminal of the operational amplifier OP2. The operational amplifier OP2 outputs a signal corresponding to the temperature of the heater HTR (signal corresponding to a resistance value of the thermistor T3). In the present embodiment, since a thermistor having the NTC characteristic is used as the thermistor T3, an output voltage of the operational amplifier OP2 decreases as the temperature of the heater HTR (temperature of the thermistor T3) increases. A reason is that a negative power supply terminal of the operational amplifier OP2 is connected to the ground line, and the value of the output voltage of the operational amplifier OP2 becomes substantially equal to the value of the ground potential in a case where the voltage value (divided value by the thermistor T3 and the resistor Rt3) input to the inverting input terminal of the operational amplifier OP2 becomes higher than the voltage value (divided value by the voltage divider circuit Pd) input to the non-inverting input terminal of the operational amplifier OP2. That is, in a case where the temperature of the heater HTR (temperature of the thermistor T3) becomes high, the output voltage of the operational amplifier OP2 becomes a low level.

In a case where a thermistor having the PTC characteristic is used as the thermistor T3, outputs of voltage divider circuits of the thermistor T3 and the resistor Rt3 may be connected to the non-inverting input terminal of the operational amplifier OP2, and an output of the voltage divider circuit Pd may be connected to the inverting input terminal of the operational amplifier OP2.

A positive power supply terminal of the operational amplifier OP3 and a voltage divider circuit Pe (series circuit of two resistors) connected to a non-inverting input terminal of the operational amplifier OP3 are connected to the power supply line PL2. A connection point of the two resistors constituting the voltage divider circuit Pe is connected to the non-inverting input terminal of the operational amplifier OP3. The operational amplifier OP3 outputs a signal corresponding to the temperature of the case 110 (signal corresponding to a resistance value of the thermistor T4). In the present embodiment, since a thermistor having the NTC characteristic is used as the thermistor T4, the output voltage of the operational amplifier OP3 decreases as the temperature of the case 110 increases. A reason is that a negative power supply terminal of the operational amplifier OP3 is connected to the ground line, and the value of the output voltage of the operational amplifier OP3 becomes substantially equal to the value of the ground potential in a case where the voltage value (divided value by the thermistor T4 and the resistor Rt4) input to the inverting input terminal of the operational amplifier OP3 becomes higher than the voltage value (divided value by the voltage divider circuit Pe) input to the non-inverting input terminal of the operational amplifier OP3. That is, in a case where the temperature of the thermistor T4 becomes high, the output voltage of the operational amplifier OP3 becomes a low level.

In a case where a thermistor having the PTC characteristic is used as the thermistor T4, outputs of voltage divider circuits of the thermistor T4 and the resistor Rt4 may be connected to the non-inverting input terminal of the operational amplifier OP3, and an output of the voltage divider circuit Pe may be connected to the inverting input terminal of the operational amplifier OP3.

A resistor R1 is connected to an output terminal of the operational amplifier OP2. A cathode of a diode D1 is connected to the resistor R1. An anode of the diode D1 is connected to an output terminal of the operational amplifier OP3, a D terminal of the FF 17, and a CLR(⁻) terminal of the FF 17. A resistor R2 connected to the power supply line PL1 is connected to a connection line between the resistor R1 and the diode D1. In addition, a CLR(⁻) terminal of the FF 16 is connected to the connection line.

One end of a resistor R3 is connected to a connection line between the D terminal of the FF 17 and a connection point between the anode of the diode D1 and the output terminal of the operational amplifier OP3. The other end of the resistor R3 is connected to the power supply line PL2. Further, an anode of the diode D2 connected to the notification terminal 12*a* of the remaining amount meter IC 12, an anode of a diode D3, and the CLR(⁻) terminal of the FF 17 are connected to the connection line. A cathode of the diode D3 is connected to a terminal P5 of the MCU 1.

In a case where the temperature of the heater HTR becomes excessively high, the signal output from the operational amplifier OP2 becomes small, and the signal input to the CLR(⁻) terminal becomes a low level, the FF 16 inputs a high-level signal from a Q(⁻) terminal to a terminal P11 of the MCU 1. A high-level system power supply voltage Vcc1 is supplied from the power supply line PL1 to the D terminal of the FF 16. Therefore, in the FF 16, a low-level signal is continuously output from the Q(⁻) terminal unless the signal input to the CLR(⁻) terminal operating with a negative logic becomes a low level.

The signal input to the CLR(⁻) terminal of the FF 17 becomes a low level in a case where the temperature of the heater HTR becomes excessively high, in a case where the temperature of the case 110 becomes excessively high, or in a case where a low-level signal indicating abnormality detection is output from the notification terminal 12*a* of the remaining amount meter IC 12. The FF 17 outputs a low-level signal from the Q terminal in a case where the signal input to the CLR(⁻) terminal becomes a low level. The low-level signal is input to a terminal P10 of the MCU 1, the gate terminal of the switch S6, the enable terminal EN of the step-up DC/DC converter 9, and the base terminal of the bipolar transistor S1 connected to the charging IC 2. In a case where a low-level signal is input to the gate terminal of the switch S6, a gate-source voltage of the N-channel MOSFET constituting the switch S6 becomes lower than a threshold voltage, and thus the switch S6 is turned off. In a case where a low-level signal is input to the enable terminal EN of the step-up DC/DC converter 9, the enable terminal EN of the step-up DC/DC converter 9 is a positive logic, and thus the step-up operation is stopped. In a case where a low-level signal is input to the base terminal of the bipolar transistor S1, the bipolar transistor S1 is turned on (an amplified current is output from the collector terminal). In a case where the bipolar transistor S1 is turned on, a high-level system power supply voltage Vcc2 is input to a CE(⁻) terminal of the charging IC 2 via the bipolar transistor S1. Since the CE(⁻) terminal of the charging IC 2 is a negative logic, the charging of the power supply BAT is stopped. Accordingly, the heating of the heater HTR and the charging of the power supply BAT are stopped. Even when the MCU 1 outputs a low-level enable signal from the terminal P22 to the charge enable terminal CE(⁻) of the charging IC 2, an amplified current is input from the collector terminal to the terminal P22 of the MCU 1 and the charge enable terminal CE(⁻) of the charging IC 2 in a case where the bipolar transistor S1 is turned on. Accordingly, it should be noted that a high-level signal is input to the charge enable terminal CE(⁻) of the charging IC 2.

A high-level system power supply voltage Vcc2 is supplied from the power supply line PL2 to the D terminal of the FF 17. Therefore, in the FF 17, a high-level signal continues to be output from the Q terminal unless a signal input to the CLR(⁻) terminal operating in a negative logic becomes a low level. In a case where a low-level signal is output from the output terminal of the operational amplifier OP3, the low-level signal is input to the CLR(⁻) terminal of the FF 17 regardless of the level of the signal output from the output terminal of the operational amplifier OP2. It should be noted that in a case where a high-level signal is output from the output terminal of the operational amplifier OP2, the low-level signal output from the output terminal of the operational amplifier OP3 is not affected by the high-level signal by the diode D1. In addition, in a case where a low-level signal is output from the output terminal of the operational amplifier OP2, even when a high-level signal is output from the output terminal of the operational amplifier OP3, the high-level signal is replaced with a low-level signal via the diode D1.

The power supply line PL2 further branches from the MCU-mounted board 161 toward the LED-mounted board 163 and the Hall IC-mounted board 164. A power supply terminal VDD of the Hall IC 13, a power supply terminal VCC of the communication IC 15, and a power supply terminal VDD of the Hall IC 14 are connected to the power supply line PL2 which branches.

An output terminal OUT of the Hall IC 13 is connected to a terminal P3 of the MCU 1 and a terminal SW2 of the switch driver 7. In a case where the outer panel 115 is detached, a low-level signal is output from the output terminal OUT of the Hall IC 13. The MCU 1 determines whether the outer panel 115 is attached based on the signal input to the terminal P3.

The LED-mounted board 163 is provided with the series circuit (series circuit of a resistor and a capacitor) connected to the operation switch OPS. The series circuit is connected to the power supply line PL2. A connection point between the resistor and the capacitor of the series circuit is connected to the terminal P4 of the MCU 1, the operation switch OPS, and a terminal SW1 of the switch driver 7. In a state where the operation switch OPS is not pressed, the operation switch OPS is not conducted, and the signals input to the terminal P4 of the MCU 1 and the terminal SW1 of the switch driver 7 become a high level by the system power supply voltage Vcc2. In a case where the operation switch OPS is pressed and the operation switch OPS is brought into a conductive state, the signals input to the terminal P4 of the MCU 1 and the terminal SW1 of the switch driver 7 become a low level because of connection to the ground line. The MCU 1 detects the operation of the operation switch OPS based on the signal input to the terminal P4.

The switch driver 7 is provided with a reset input terminal RSTB. The reset input terminal RSTB is connected to the control terminal ON of the LSW 4. In a case where both the levels of the signals input to the terminal SW1 and the terminal SW2 become a low level (a state where the outer panel 115 is detached and the operation switch OPS is pressed), the switch driver 7 outputs a low-level signal from the reset input terminal RSTB, thereby stopping the output operation of the LSW 4. That is, in a case where the operation switch OPS, which is originally pressed down via the pressing portion 117 of the outer panel 115, is directly pressed down by the user in a state where the outer panel 115 is detached, both the levels of the signals input to the terminal SW1 and the terminal SW2 of the switch driver 7 become a low level.

<Operation in Each Operation Mode of Inhaler>

Figure 13:
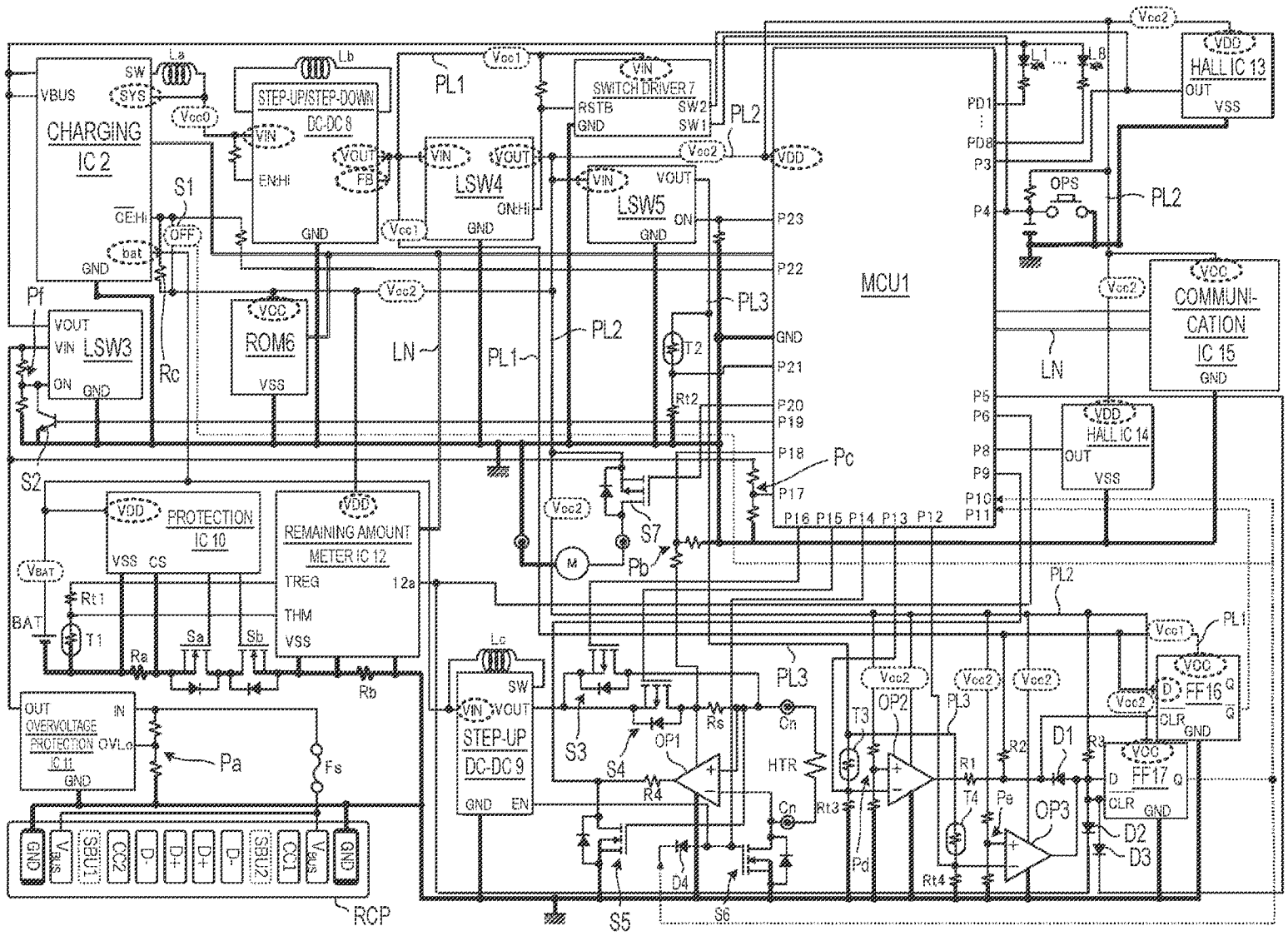
FIG. 13 is a diagram for illustrating an operation of the electric circuit in a sleep mode.
Figure 14:
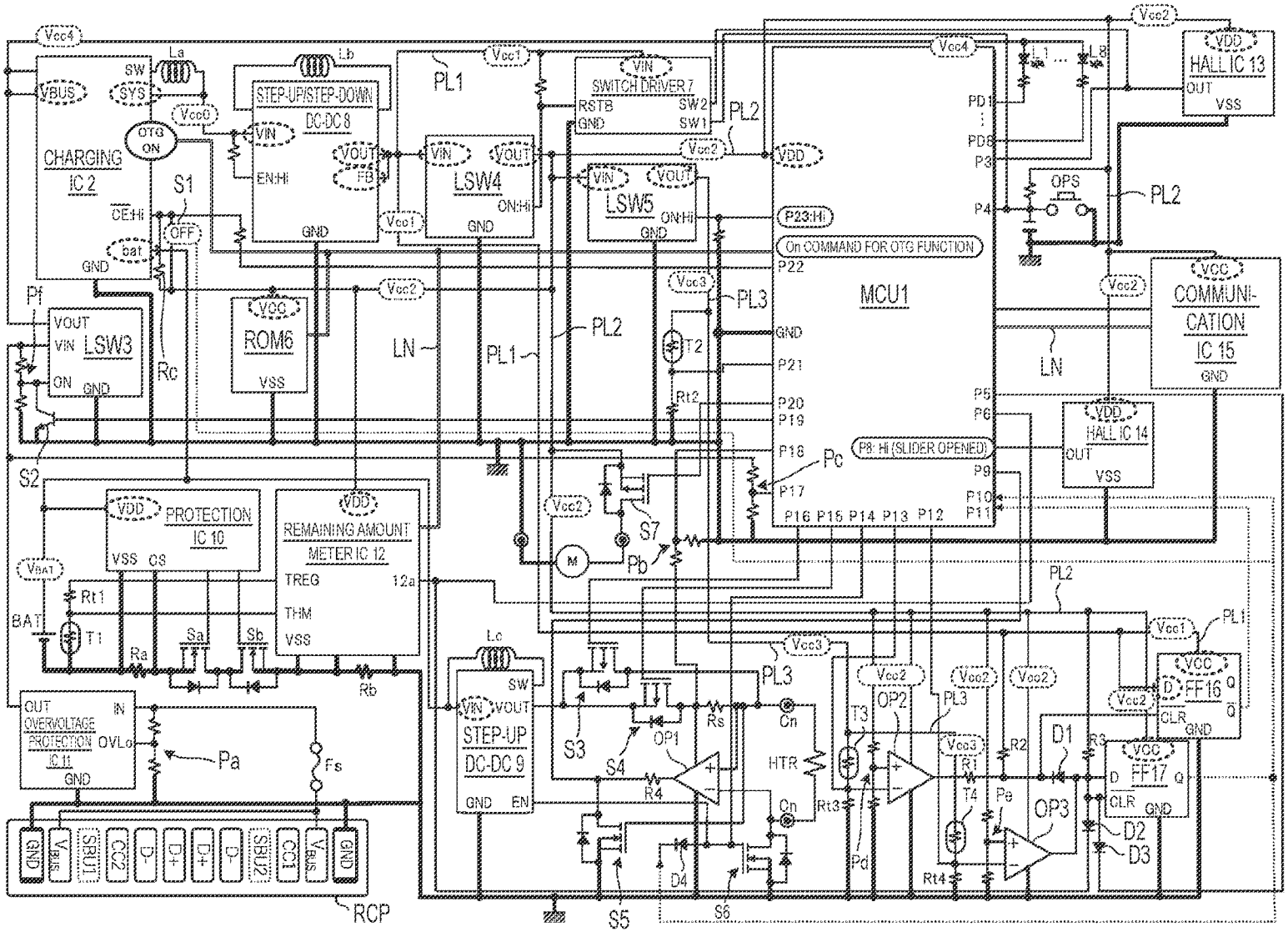
FIG. 14 is a diagram for illustrating an operation of the electric circuit in an active mode.
Figure 15:
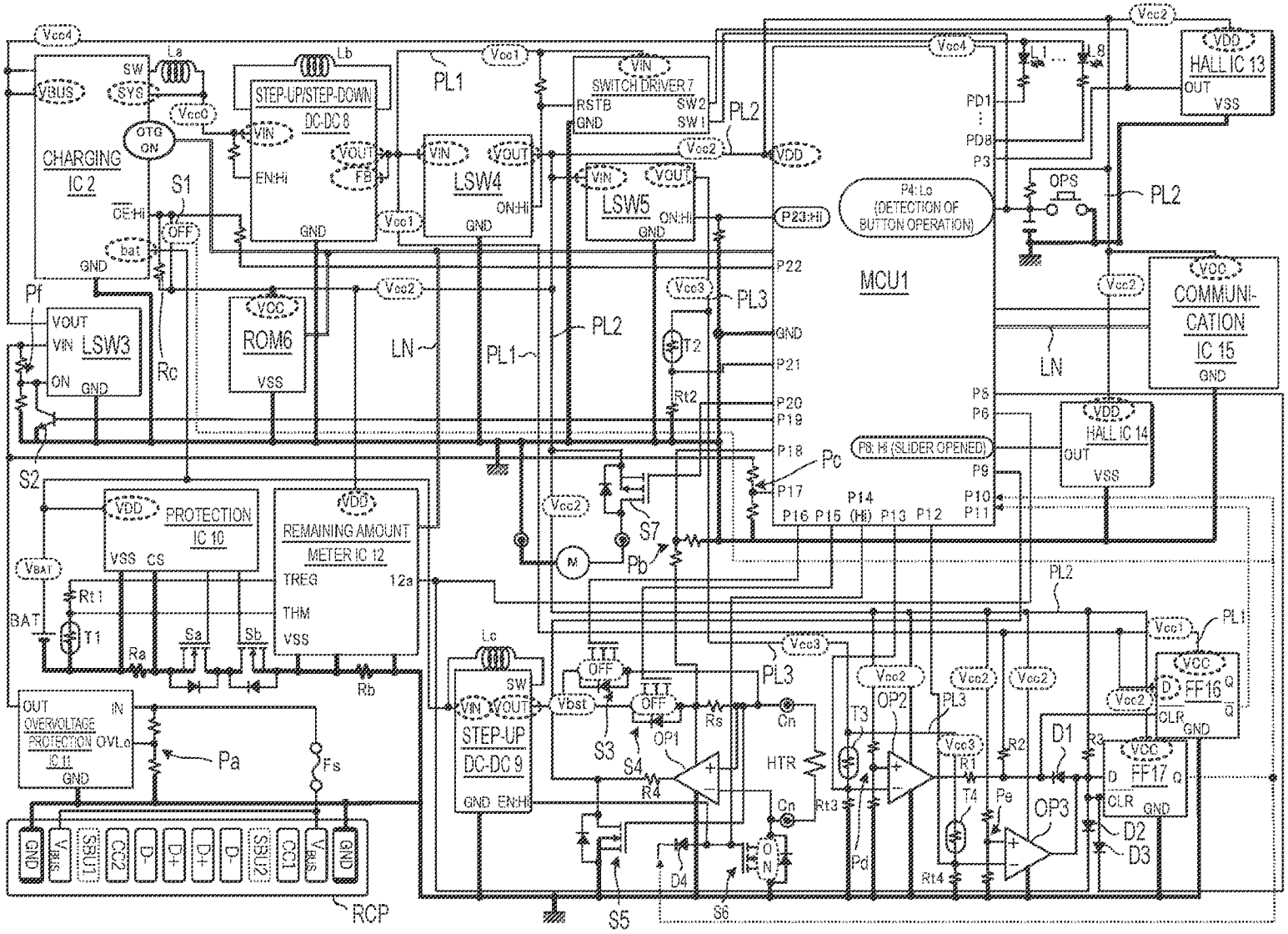
FIG. 15 is a diagram for illustrating an operation of the electric circuit in a heating initial setting mode.
Figure 16:
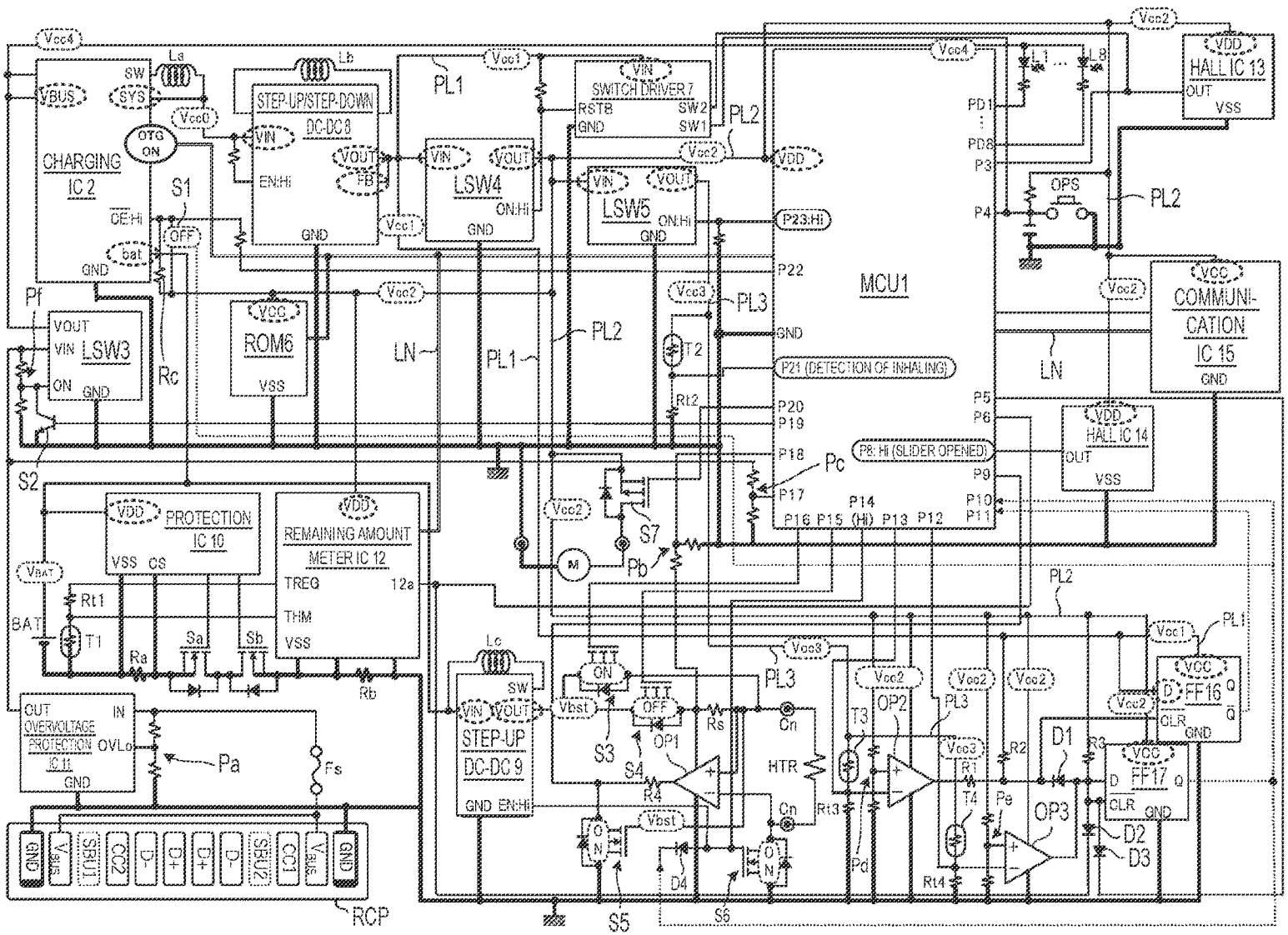
FIG. 16 is a diagram for illustrating an operation of the electric circuit at the time of heating the heater in a heating mode.
Figure 17:
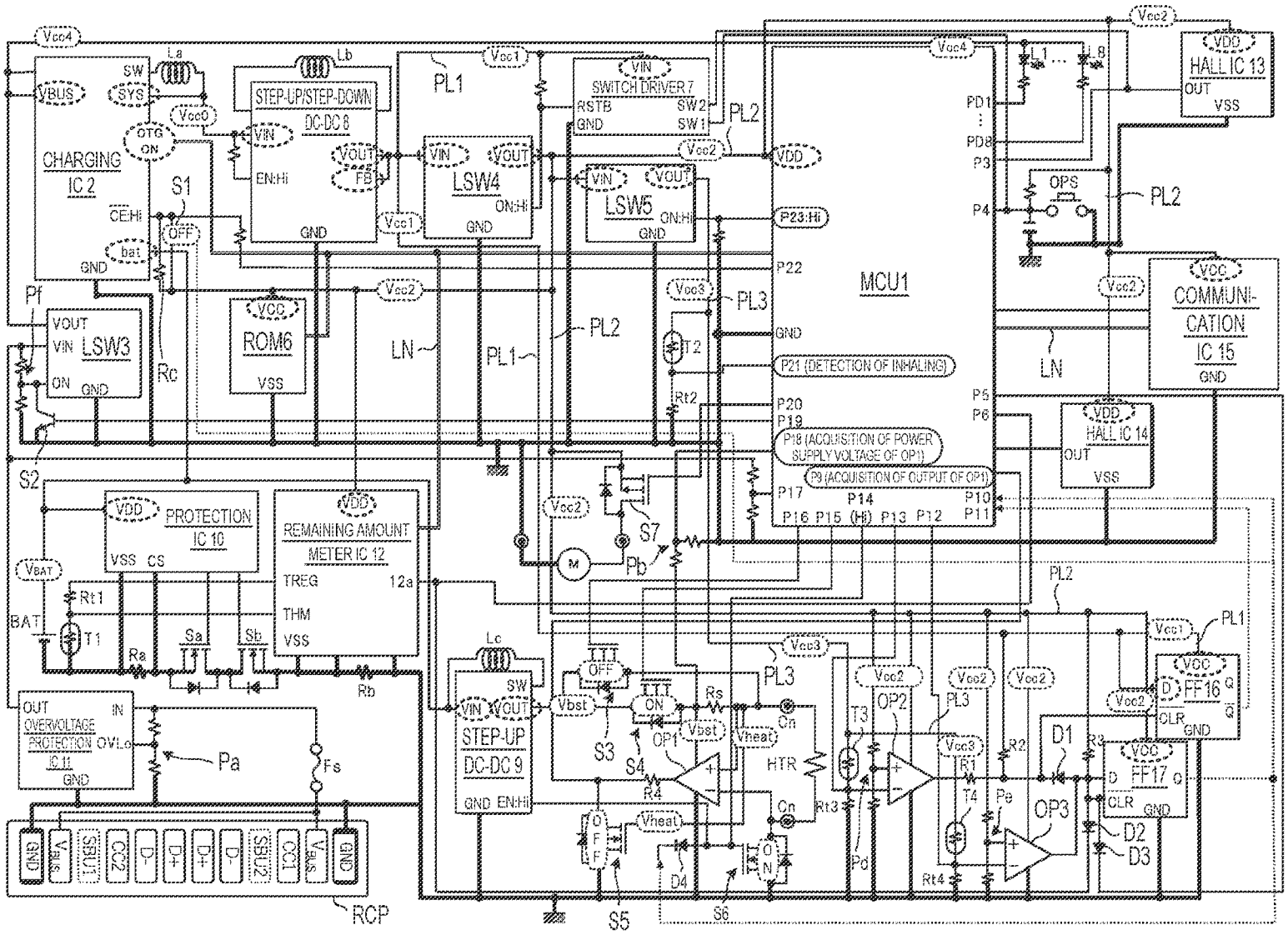
FIG. 17 is a diagram for illustrating an operation of the electric circuit at the time of detecting a temperature of the heater in the heating mode.
Figure 18:
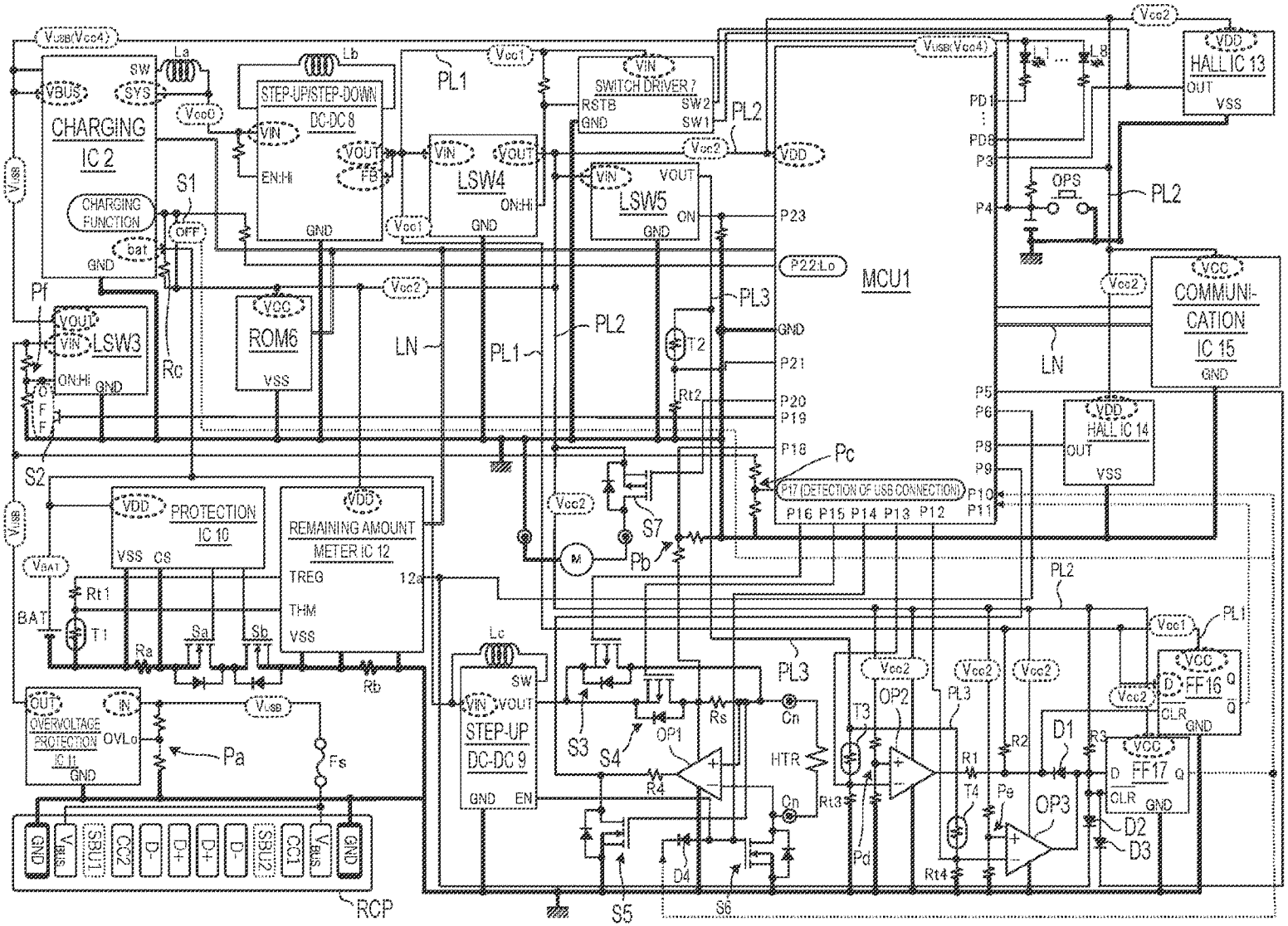
FIG. 18 is a diagram for illustrating an operation of the electric circuit in a charging mode.
Figure 19:
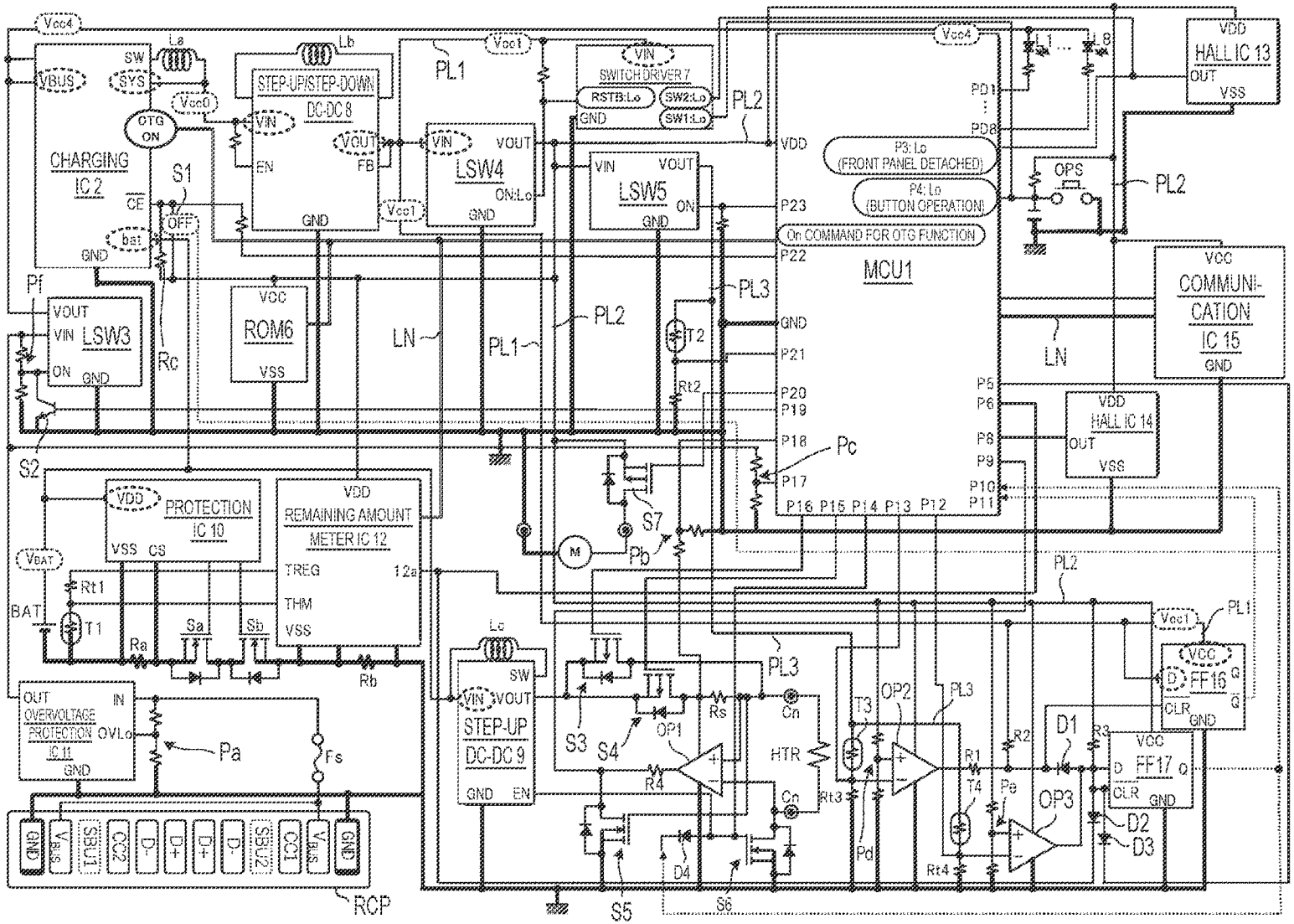
FIG. 19 is a diagram for illustrating an operation of the electric circuit at the time of resetting (restarting) an MCU.

Hereinafter, operations of the electric circuit illustrated in FIG. 10 will be described with reference to FIGS. 13 to 19. FIG. 13 is a diagram for illustrating an operation of the electric circuit in the sleep mode. FIG. 14 is a diagram for illustrating an operation of the electric circuit in the active mode. FIG. 15 is a diagram for illustrating an operation of the electric circuit in the heating initial setting mode. FIG. 16 is a diagram for illustrating an operation of the electric circuit at the time of heating the heater HTR in the heating mode. FIG. 17 is a diagram for illustrating an operation of the electric circuit at the time of detecting the temperature of the heater HTR in the heating mode. FIG. 18 is a diagram for illustrating an operation of the electric circuit in the charging mode. FIG. 19 is a diagram for illustrating an operation of the electric circuit at the time of resetting (restarting) the MCU 1. In each of FIGS. 13 to 19, terminals surrounded by a broken ellipse, among the terminals of the electronic components formed into chips, indicate terminals to which the power supply voltage $V_{BAT}$, the USB voltage $V_{USB}$, the system power supply voltage, and the like are input or output.

In any operation mode, the power supply voltage V BAT is input to the power supply terminal VDD of the protection IC 10, the input terminal VIN of the step-up DC/DC converter 9, and the charging terminal bat of the charging IC 2.

<Sleep Mode: FIG. 13>

The MCU 1 enables the V BAT power path function of the charging IC 2 and disables the OTG function and the charging function. The USB voltage $V_{USB}$ is not input to the input terminal VBUS of the charging IC 2, whereby the V BAT power path function of the charging IC 2 is enabled. Since a signal for enabling the OTG function from the communication line LN is not output from the MCU 1 to the charging IC 2, the OTG function is disabled. Therefore, the charging IC 2 generates the system power supply voltage Vcc0 from the power supply voltage $V_{BAT}$ input to the charging terminal bat, and outputs the system power supply voltage Vcc0 from the output terminal SYS. The system power supply voltage Vcc0 output from the output terminal SYS is input to the input terminal VIN and the enable terminal EN of the step-up/step-down DC/DC converter 8. The step-up/step-down DC/DC converter 8 is enabled by inputting the high-level system power supply voltage Vcc0 to the enable terminal EN which is a positive logic, generates the system power supply voltage Vcc1 from the system power supply voltage Vcc0, and outputs the system power supply voltage Vcc1 from the output terminal VOUT. The system power supply voltage Vcc1 output from the output terminal VOUT of the step-up/step-down DC/DC converter 8 is supplied to the input terminal VIN of the LSW 4, the control terminal ON of the LSW 4, the input terminal VIN of the switch driver 7, and the power supply terminal VCC and the D terminal of the FF 16.

By inputting the system power supply voltage Vcc1 to the control terminal ON, the LSW 4 outputs, from the output terminal VOUT, the system power supply voltage Vcc1 input to the input terminal VIN as the system power supply voltage Vcc2. The system power supply voltage Vcc2 output from the LSW 4 is input to the power supply terminal VDD of the MCU 1, the input terminal VIN of the LSW 5, the power supply terminal VDD of the Hall IC 13, the power supply terminal VCC of the communication IC 15, and the power supply terminal VDD of the Hall IC 14. Further, the system power supply voltage Vcc2 is supplied to the power supply terminal VDD of the remaining amount meter IC 12, the power supply terminal VCC of the ROM 6, the resistor Rc and the bipolar transistor S1 connected to the charge enable terminal CE(⁻) of the charging IC 2, the power supply terminal VCC of the FF 17, the positive power supply terminal of the operational amplifier OP3, the voltage divider circuit Pe, the positive power supply terminal of the operational amplifier OP2, and the voltage divider circuit Pd. The bipolar transistor S1 connected to the charging IC 2 is turned off unless a low-level signal is output from the Q terminal of the FF 17. Therefore, the system power supply voltage Vcc2 generated by the LSW 4 is also input to the charge enable terminal CE(⁻) of the charging IC 2. Since the charge enable terminal CE(⁻) of the charging IC 2 is a negative logic, the charging function by the charging IC 2 is turned off in this state.

In this manner, since the LSW 5 stops outputting the system power supply voltage Vcc3 in the sleep mode, the supply of power to the electronic components connected to the power supply line PL3 is stopped. In addition, since the OTG function of the charging IC 2 is stopped in the sleep mode, the supply of power to the LEDs L1 to L8 is stopped.

<Active Mode: FIG. 14>

When the MCU 1 detects that the signal input to the terminal P8 becomes a high level and the slider 119 is opened from the sleep mode state in FIG. 13, the MCU 1 inputs a high-level signal to the control terminal ON of the LSW 5 from the terminal P23. Accordingly, the LSW 5 outputs, from the output terminal VOUT, the system power supply voltage Vcc2 input to the input terminal VIN as the system power supply voltage Vcc3. The system power supply voltage Vcc3 output from the output terminal VOUT of the LSW 5 is supplied to the thermistor T2, the thermistor T3, and the thermistor T4.

Further, when the MCU 1 detects that the slider 119 is opened, the MCU 1 enables the OTG function of the charging IC 2 via the communication line LN. Accordingly, the charging IC 2 outputs, from the input terminal VBUS, the system power supply voltage Vcc4 obtained by stepping up the power supply voltage $V_{BAT}$ input from the charging terminal bat. The system power supply voltage Vcc4 output from the input terminal VBUS is supplied to the LEDs L1 to L8.

<Heating Initial Setting Mode: FIG. 15>

In a case where the signal input to the terminal P4 becomes a low level (the operation switch OPS is pressed) from the state in FIG. 14, the MCU 1 performs various settings necessary for heating, and then inputs a high-level enable signal from the terminal P14 to the enable terminal EN of the step-up DC/DC converter 9. Accordingly, the step-up DC/DC converter 9 outputs, from the output terminal VOUT, the drive voltage $V_{bst}$ obtained by stepping up the power supply voltage $V_{BAT}$ The drive voltage $V_{bst}$ is supplied to the switch S3 and the switch S4. In this state, the switch S3 and the switch S4 are turned off. In addition, the switch S6 is turned on by a high-level enable signal output from the terminal P14. Accordingly, a negative electrode-side terminal of the heater HTR is connected to the ground line, and the heater HTR is brought into a state of being heated by turning on the switch S3. After the enable signal of the high-level signal is output from the terminal P14 of the MCU 1, the operation mode shifts to the heating mode.

<Heater Heating in Heating Mode: FIG. 16>

In the state of FIG. 15, the MCU 1 starts switching control of the switch S3 connected to the terminal P16 and switching control of the switch S4 connected to the terminal P15. The switching control may be automatically started when the heating initial setting mode described above is completed, or may be started by further pressing the operation switch OPS. Specifically, the MCU 1 performs, as illustrated in FIG. 16, heating control in which the switch S3 is turned on, the switch S4 is turned off, the drive voltage $V_{bst}$ is supplied to the heater HTR, and the heater HTR is heated for generating aerosol, and performs, as illustrated in FIG. 17, temperature detection control in which the switch S3 is turned off, the switch S4 is turned on, and the temperature of the heater HTR is detected.

As illustrated in FIG. 16, during the heating control, the drive voltage $V_{bst}$ is also supplied to a gate of the switch S5, and the switch S5 is turned on. In addition, during the heating control, the drive voltage $V_{bst}$ passing through the switch S3 is also input to the positive power supply terminal of the operational amplifier OP1 via the resistor Rs. A resistance value of the resistor Rs is small enough to be negligible as compared with an internal resistance value of the operational amplifier OP1. Therefore, during the heating control, the voltage input to the positive power supply terminal of the operational amplifier OP1 is substantially equal to the drive voltage $V_{bst}$.

A resistance value of the resistor R4 is larger than an on-resistance value of the switch S5. The operational amplifier OP1 also operates during the heating control, but the switch S5 is turned on during the heating control. In a state where the switch S5 is turned on, the output voltage of the operational amplifier OP1 is divided by a voltage divider circuit of the resistor R4 and the switch S5 and is input to the terminal P9 of the MCU 1. The resistance value of the resistor R4 is larger than the on-resistance value of the switch S5, whereby the voltage input to the terminal P9 of the MCU 1 becomes sufficiently small. Accordingly, a large voltage may be prevented from being input from the operational amplifier OP1 to the MCU 1.

<Heater Temperature Detection in Heating Mode: FIG. 17>

As illustrated in FIG. 17, during the temperature detection control, the drive voltage $V_{bst}$ is input to the positive power supply terminal of the operational amplifier OP1 and is input to the voltage divider circuit Pb. The voltage divided by the voltage divider circuit Pb is input to the terminal P18 of the MCU 1. The MCU 1 acquires a reference voltage $V_{temp}$ applied to a series circuit of the resistor Rs and the heater HTR during the temperature detection control based on the voltage input to the terminal P18.

In addition, during the temperature detection control, the drive voltage $V_{bst}$ (reference voltage $V_{temp}$) is supplied to the series circuit of the resistor Rs and the heater HTR. Further, a voltage $V_{heat}$ obtained by dividing the drive voltage $V_{bst}$ (reference voltage $V_{temp}$) by the resistor Rs and the heater HTR is input to the non-inverting input terminal of the operational amplifier OP1. Since the resistance value of the resistor Rs is sufficiently larger than a resistance value of the heater HTR, the voltage $V_{heat}$ is a value sufficiently lower than the drive voltage $V_{bst}$. During the temperature detection control, the low voltage $V_{heat}$ is also supplied to the gate terminal of the switch S5, whereby the switch S5 is turned off. The operational amplifier OP1 amplifies a difference between the voltage input to the inverting input terminal and the voltage $V_{beat}$ input to the non-inverting input terminal and outputs the amplified difference.

An output signal of the operational amplifier OP1 is input to the terminal P9 of the MCU 1. The MCU 1 acquires the temperature of the heater HTR based on the signal input to the terminal P9, the reference voltage $V_{temp}$ acquired based on the input voltage of the terminal P18, and a known electric resistance value of the resistor Rs. The MCU 1 performs the heating control of the heater HTR based on the acquired temperature of the heater HTR. The heating control of the heater HTR includes control of discharge from the power supply BAT to the heater HTR, control such that the temperature of the heater HTR is a target temperature, and the like.

The MCU 1 can also acquire the temperature of the heater HTR even in a period in which the switch S3 and the switch S4 are turned off (a period in which the heater HTR is not energized). Specifically, the MCU 1 acquires the temperature of the heater HTR based on the voltage input to the terminal P13 (output voltage of the voltage divider circuit including the thermistor T3 and the resistor Rt3).

In addition, the MCU 1 may also acquire the temperature of the case 110 at any timing. Specifically, the MCU 1 acquires the temperature of the case 110 based on the voltage input to the terminal P12 (output voltage of the voltage divider circuit including the thermistor T4 and the resistor Rt4).

<Charging Mode: FIG. 18>

FIG. 18 illustrates a case where the USB connection is established in the sleep mode. In a case where the USB connection is established, the USB voltage $V_{USB}$ is input to the input terminal VIN of the LSW 3 via the overvoltage protection IC 11. The USB voltage $V_{USB}$ is also supplied to the voltage divider circuit Pf connected to the input terminal VIN of the LSW 3. Since the bipolar transistor S2 is turned on immediately after the USB connection is established, the signal input to the control terminal ON of the LSW 3 remains at a low level. The USB voltage V USB is also supplied to the voltage divider circuit Pc connected to the terminal P17 of the MCU 1, and a voltage divided by the voltage divider circuit Pc is input to the terminal P17. The MCU 1 detects that the USB connection is established based on the voltage input to the terminal P17.

When the MCU 1 detects that the USB connection is established, the MCU 1 turns off the bipolar transistor S2 connected to the terminal P19. When a low-level signal is input to a gate terminal of the bipolar transistor S2, the USB voltage $V_{USB}$ divided by the voltage divider circuit Pf is input to the control terminal ON of the LSW 3. Accordingly, a high-level signal is input to the control terminal ON of the LSW 3, and the LSW 3 outputs the USB voltage $V_{USB}$ from the output terminal VOUT. The USB voltage $V_{USB}$ output from the LSW 3 is input to the input terminal VBUS of the charging IC 2. In addition, the USB voltage $V_{USB}$ output from the LSW 3 is supplied to the LEDs L1 to L8 as the system power supply voltage Vcc4.

When the MCU 1 detects that the USB connection is established, the MCU 1 further outputs a low-level enable signal from the terminal P22 to the charge enable terminal CE(⁻) of the charging IC 2. Accordingly, the charging IC 2 enables the charging function of the power supply BAT and starts charging the power supply BAT by the USB voltage $V_{USB}$ input to the input terminal VBUS. At this time, the MCU 1 does not perform the heating of the heater HTR for aerosol generating while keeping the switches S3 and S4 off. In other words, when the MCU 1 detects that the USB connection is established based on the voltage input to the terminal P17, the MCU 1 prohibits a supply of a power from the power supply BAT to the heater connector Cn. Therefore, the receptacle RCP and the overvoltage protection IC 11, which are electronic components that function only during the charging, are electronic components that function when the voltage conversion control associated with the heating control is not performed.

In a case where the USB connection is established in the active mode, when the MCU 1 detects that the USB connection is established, the MCU 1 turns off the bipolar transistor S2 connected to the terminal P19, outputs a low-level enable signal from the terminal P22 to the charge enable terminal CE(⁻) of the charging IC 2, and turns off the OTG function of the charging IC 2 by serial communication using the communication line LN. Accordingly, the system power supply voltage Vcc4 supplied to the LEDs L1 to L8 is switched from the voltage generated by the OTG function of the charging IC 2 (voltage based on the power supply voltage $V_{BAT}$) to the USB voltage $V_{USB}$ output from the LSW 3. The LEDs L1 to L8 is not operated unless ON control of the built-in transistor is not performed by the MCU 1. Therefore, the unstable voltage in a transition period from ON to OFF of the OTG function is prevented from being supplied to the LEDs L1 to L8.

<Resetting of MCU: FIG. 19>

In a case where the outer panel 115 is detached, the output of the Hall IC 13 becomes a low level, an ON operation of the operation switch OPS is performed, and the signal input to the terminal P4 of the MCU 1 becomes a low level, the terminal SW1 and the terminal SW2 of the switch driver 7 both become a low level. Accordingly, the switch driver 7 outputs a low-level signal from the reset input terminal RSTB. The low-level signal output from the reset input terminal RSTB is input to the control terminal ON of the LSW 4. Accordingly, the LSW 4 stops the output of the system power supply voltage Vcc2 from the output terminal VOUT. By stopping the output of the system power supply voltage Vcc2, the system power supply voltage Vcc2 is not input to the power supply terminal VDD of the MCU 1, and thus the MCU 1 is stopped.

The switch driver 7 returns the signal output from the reset input terminal RSTB to a high level in a case where a time during which the low-level signal is output from the reset input terminal RSTB reaches a predetermined time or in a case where the signal input to either the terminal SW1 or the terminal SW2 becomes a high level. Accordingly, the control terminal ON of the LSW 4 becomes a high level, and the system power supply voltage Vcc2 returns to a state of being supplied to each unit.

<Peripheral Circuit of Step-up DC/DC Converter>

Figure 20:
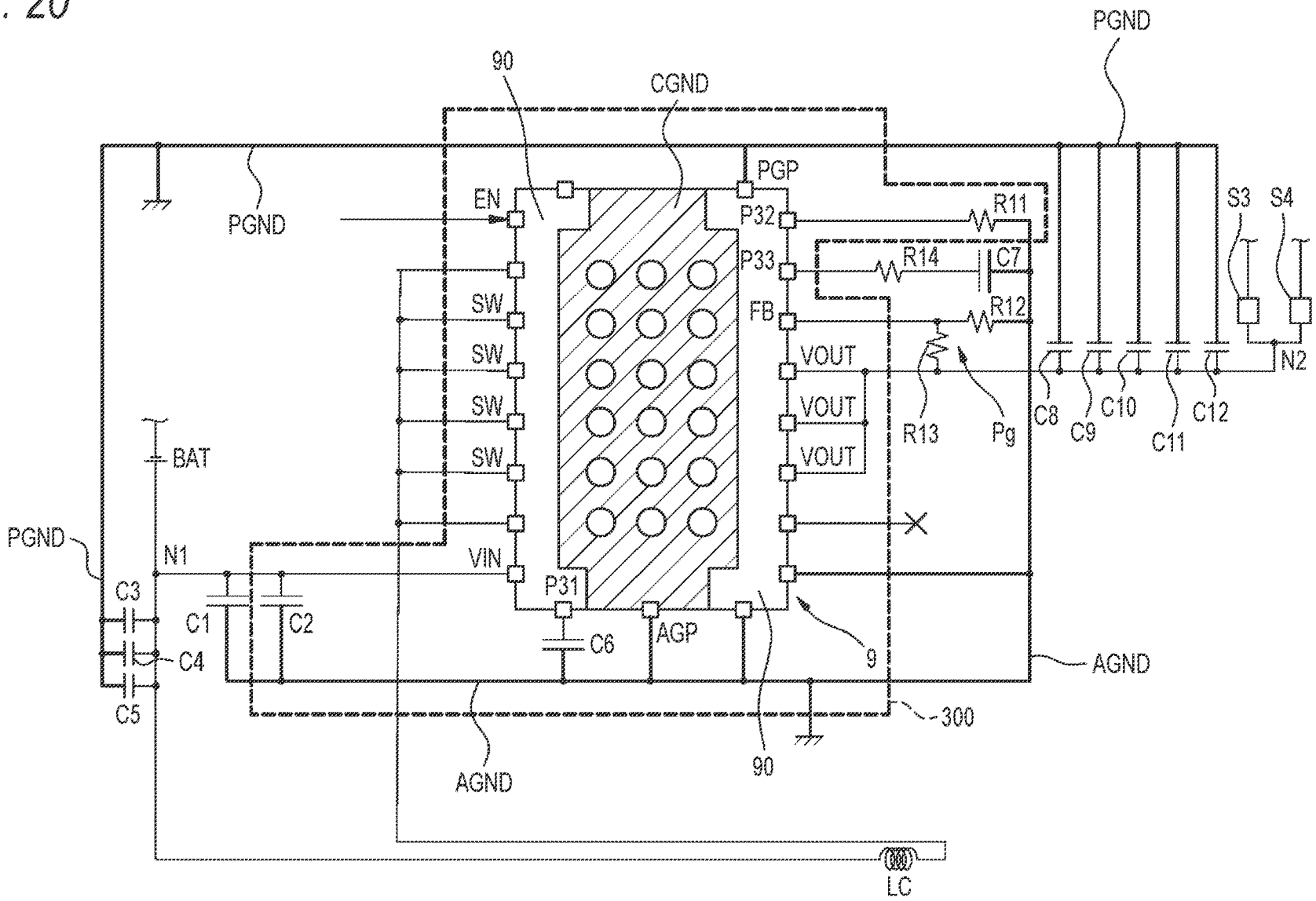
FIG. 20 is a circuit diagram of essential parts more specifically illustrating peripheral circuits of a step-up DC/DC converter.

FIG. 20 is a circuit diagram of a main part more specifically illustrating a peripheral circuit of the step-up DC/DC converter 9 in the electric circuit illustrated in FIG. 10.

FIG. 20 illustrates capacitors C1 to C12, resistors R11 to R14, and nodes N1 and N2 as electronic components or nodes which are not illustrated or whose reference numerals are omitted in FIG. 10.

In addition, FIG. 20 illustrates, as terminals of the step-up DC/DC converter 9, a first control terminal P31, a second control terminal P32, a third control terminal P33, and a feedback terminal FB, and illustrates a plurality of switching terminals SW, to which one end of the reactor Lc is connected, and a plurality of output terminals VOUT, which are connected to the heater connector Cn.

Further, FIG. 20 illustrates, as the ground terminal GND, a power ground terminal PGP connected to a power ground PGND to be described later and a signal ground terminal AGP connected to a signal ground AGND to be described later. The ground terminal GND and the ground line illustrated in FIG. 10 are the power ground terminal PGP and the power ground PGND, and the receptacle-mounted board 162 is provided with the signal ground AGND in addition to the power ground PGND.

The node N1 connects the input terminal VIN and one end of the reactor Lc. The node N1 is connected to the power supply connector electrically connected to the power supply BAT (illustrated as the power supply BAT connected to this power supply connector in the drawing). One ends of the capacitors C1 and C2 are connected in parallel between the node N1 and the input terminal VIN, and the other ends of the capacitors C1 and C2 are connected to the signal ground AGND. The capacitors C1 and C2 including one ends of which are connected to the input terminal VIN, are bypass capacitors (so-called pass capacitors) which prevent a ripple current, a ripple voltage, and the like from being input to the input terminal VIN. Hereinafter, the capacitors C1 and C2 may be referred to as bypass capacitors C1 and C2, the capacitor C1 may be referred to as a first bypass capacitor C1, and the capacitor C2 may be referred to as a second bypass capacitor C2.

One ends of the capacitors C3 to C5 are connected in parallel between the node N1 and one end of the reactor Lc, and the other ends of the capacitors C3 to C5 are connected to the power ground PGND. The capacitors C3 to C5 including one ends of which are connected to the reactor Lc are reactor capacitors which prevent a ripple current, a ripple voltage, or the like from being input to the reactor Lc. Hereinafter, the capacitors C3 to C5 may be referred to as reactor capacitors.

The node N2 connects the source terminal of the switch S3 and the source terminal of the switch S4. The node N2 is connected to the output terminal VOUT of the step-up DC/DC converter 9. One ends of the capacitors C8 to C12 are connected in parallel between the output terminal VOUT and the node N2, and the other ends of the capacitors C8 to C12 are connected to the power ground PGND. The capacitors C8 to C12 including one ends of which are connected to the output terminal VOUT are output capacitors which remove a ripple of a current or a voltage output from the output terminal VOUT. Hereinafter, the capacitors C8 to C12 may be referred to as output capacitors.

One end of a voltage divider circuit Pg including a series circuit of two resistors R12 and R13 is connected between the output terminal VOUT and the output capacitors C8 to C12. The other end of the voltage divider circuit Pg is connected to the signal ground AGND. A connection point of the two resistors R12 and R13 constituting the voltage divider circuit Pg is connected to the feedback terminal FB. The step-up DC/DC converter 9 executes voltage conversion control of converting a voltage input to the input terminal VIN and outputting the converted voltage from the output terminal VOUT based on a voltage input to the feedback terminal FB. That is, the step-up DC/DC converter 9 performs control to step up the power supply voltage $V_{BAT}$ based on the voltage input to the feedback terminal FB so that the drive voltage $V_{bst}$ becomes a target voltage.

One end of the capacitor C6 is connected to the first control terminal P31, and the other end of the capacitor C6 is connected to the signal ground AGND. The first control terminal P31 is, for example, a soft start control terminal, and performs soft start of the step-up DC/DC converter 9 according to a capacitance of the capacitor C6.

One end of the resistor R11 is connected to the second control terminal P32, and the other end of the resistor R11 is connected to the signal ground AGND. The second control terminal P32 is, for example, an output current limiting programming terminal, and programs a limiting value of an output current according to a resistance value of the resistor R11.

One end of a series circuit of the resistor R14 and the capacitor C7 is connected to the third control terminal P33, and the other end of the series circuit of the resistor R14 and the capacitor C7 is connected to the signal ground AGND. The third control terminal P33 is, for example, a phase compensation connection terminal, and the series circuit of the resistor R14 and the capacitor C7 is a component for phase compensation.

<Thermal Diffusion Member>

Figure 21:
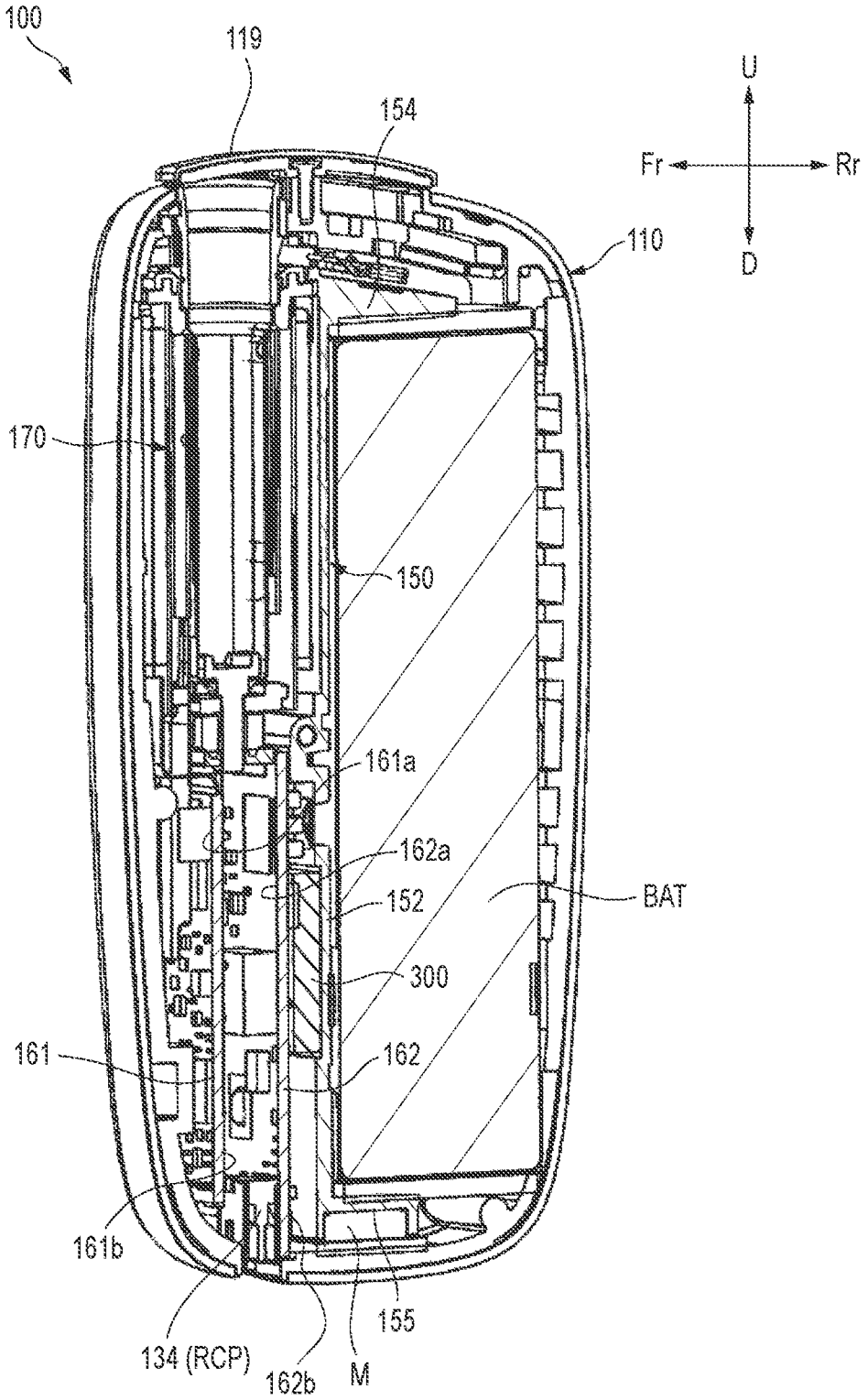
FIG. 21 is a cross-sectional view of the non-combustion inhaler.

As illustrated in FIG. 21, the thermal diffusion member 300 is provided on the secondary surface 162*b* of the receptacle-mounted board 162 between the secondary surface 162*b* and the chassis 150. Since the secondary surface 162*b* of the receptacle-mounted board 162 on which the thermal diffusion member 300 is disposed faces the front-rear dividing wall 152 of the chassis 150, the thermal diffusion member 300 is located between the step-up DC/DC converter 9 and the chassis 150.

The thermal diffusion member 300 is made of a material having a thermal diffusivity higher than that of air, for example, a thermal diffusion material such as metal, ceramic, graphite, or clay. A heat dissipation sheet may be used for the thermal diffusion member 300. At least a part of the heat dissipation sheet used for the thermal diffusion member 300 may be in a gel form. The thermal diffusion member 300 entirely or partially covers the plurality of electronic components disposed on the secondary surface 162*b* of the receptacle-mounted board 162, and diffuses heat into the air. Therefore, the temperature of the electronic component covered with the thermal diffusion member 300 is less likely to increase. In addition, the electronic component covered with the thermal diffusion member 300 is less likely to be affected by heat from the power supply BAT by the chassis 150, and thus the operation is stabilized. On the other hand, the heat diffused by the thermal diffusion member 300 is prevented from being transferred to other components by the chassis 150, and thus the durability of the inhaler 100 is improved.

A shape of the thermal diffusion member 300 is not particularly limited, but is preferably a simple shape such as a square shape, a rectangular shape, a circular shape, or an elliptical shape in a plan view from the viewpoint of cost. Two or more thermal diffusion members 300 may be provided. In the present embodiment, one thermal diffusion member 300 having a substantially rectangular shape is provided. The electronic components covered with the thermal diffusion member 300 will be described later together with elements and ICs mounted on the MCU-mounted board 161 and the receptacle-mounted board 162.

As illustrated in FIG. 21, by providing the thermal diffusion member 300 on the secondary surface 162*b* of the receptacle-mounted board 162, the MCU-mounted board 161, the receptacle-mounted board 162, the thermal diffusion member 300, the chassis 150, and the power supply BAT are disposed in this order from the front in the front-rear direction in the internal space of the case 110. Therefore, local heat in the receptacle-mounted board 162 is dissipated by the thermal diffusion member 300, and the dissipated heat is prevented from being transferred to the power supply BAT by the insulating chassis 150. In addition, since the heat generated in the power supply BAT is not transmitted to the receptacle-mounted board 162 by the insulating chassis 150, the temperatures of the power supply BAT and the receptacle-mounted board 162 are less likely to increase, and the operation of the inhaler 100 is stabilized.

The thermal diffusion member 300 is disposed on the secondary surface 162*b* of the receptacle-mounted board 162 by sticking, adhesion, welding, or the like. A predetermined gap is preferably formed between the thermal diffusion member 300 and the chassis 150.

<Detailed Description of Board>

Next, disposition of the ICs and the elements disposed on the MCU-mounted board 161 and the receptacle-mounted board 162 will be described.

[Receptacle-Mounted Board]

Figure 22:
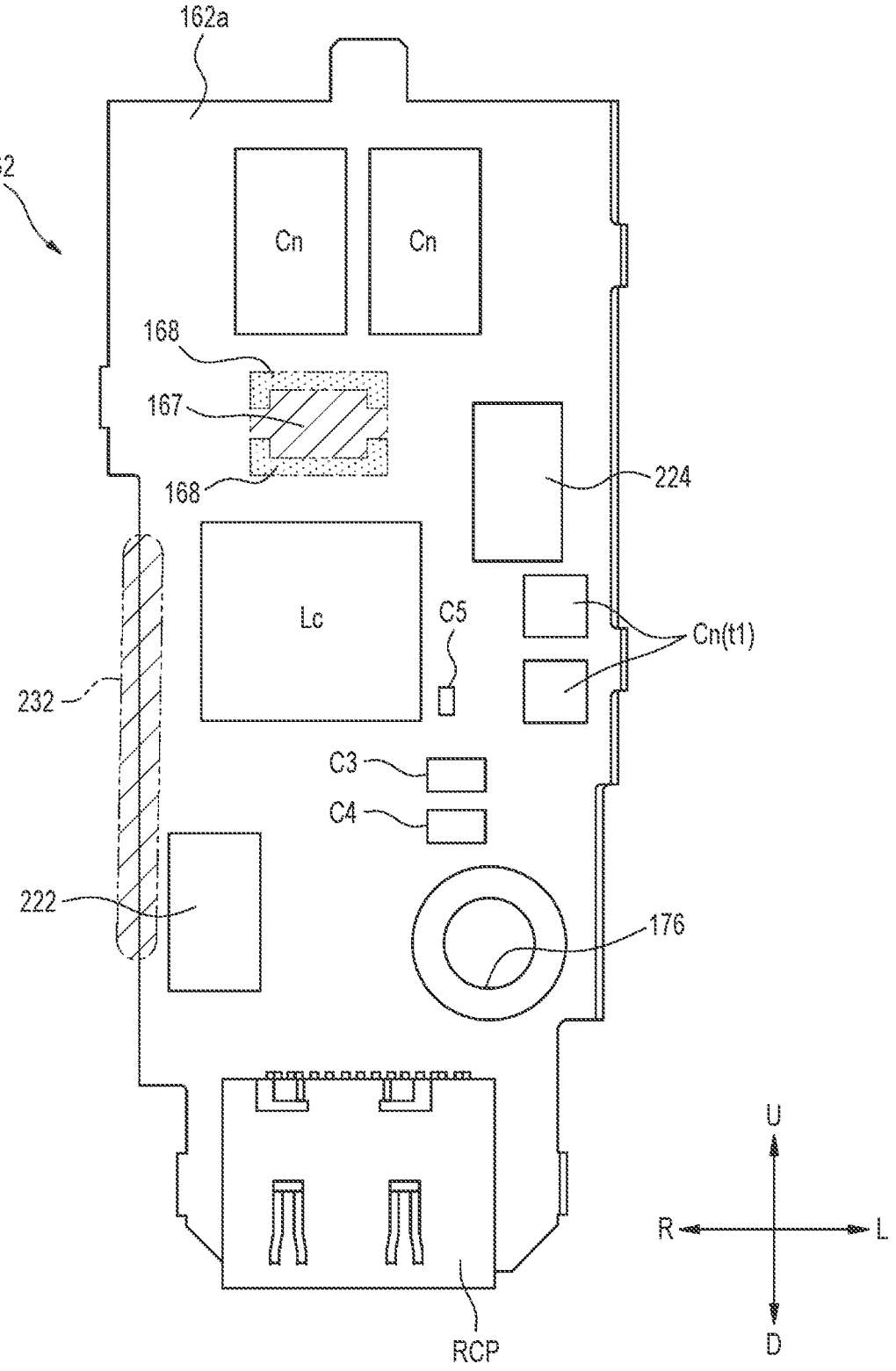
FIG. 22 is a view illustrating a main surface of a receptacle-mounted board.

FIG. 22 is a diagram illustrating the main surface 162*a* of the receptacle-mounted board 162. On the main surface 162*a* of the receptacle-mounted board 162 extending in the up-down direction, the heater connector Cn is disposed in the vicinity of an upper end portion thereof, the receptacle RCP is disposed at a lower end portion thereof, and the reactor Lc and the reactor capacitors C3 to C5 of the step-up DC/DC converter 9 is disposed between the heater connector Cn and the receptacle RCP.

In the vicinity of the receptacle RCP, a battery connector 222 on the positive electrode side (hereinafter, referred to as positive-electrode-side battery connector 222) is disposed on the right side, and the opening portion 176 for fixing the spacer 173 is disposed on the left side. Further, a battery connector 224 on the negative electrode side (hereinafter, referred to as a negative-electrode-side battery connector 224) and a power supply temperature detecting connector Cn (t1) connected to the thermistor T1 constituting a power supply temperature sensor are disposed on a left side of the reactor Lc. A positive-electrode-side power supply bus bar 236 (see FIGS. 7 and 8) extending from the positive electrode terminal of the power supply BAT is connected to the positive-electrode-side battery connector 222, and a negative-electrode-side power supply bus bar 238 (see FIGS. 7 and 8) extending from the negative electrode terminal of the power supply BAT is connected to the negative-electrode-side battery connector 224.

Figure 23:
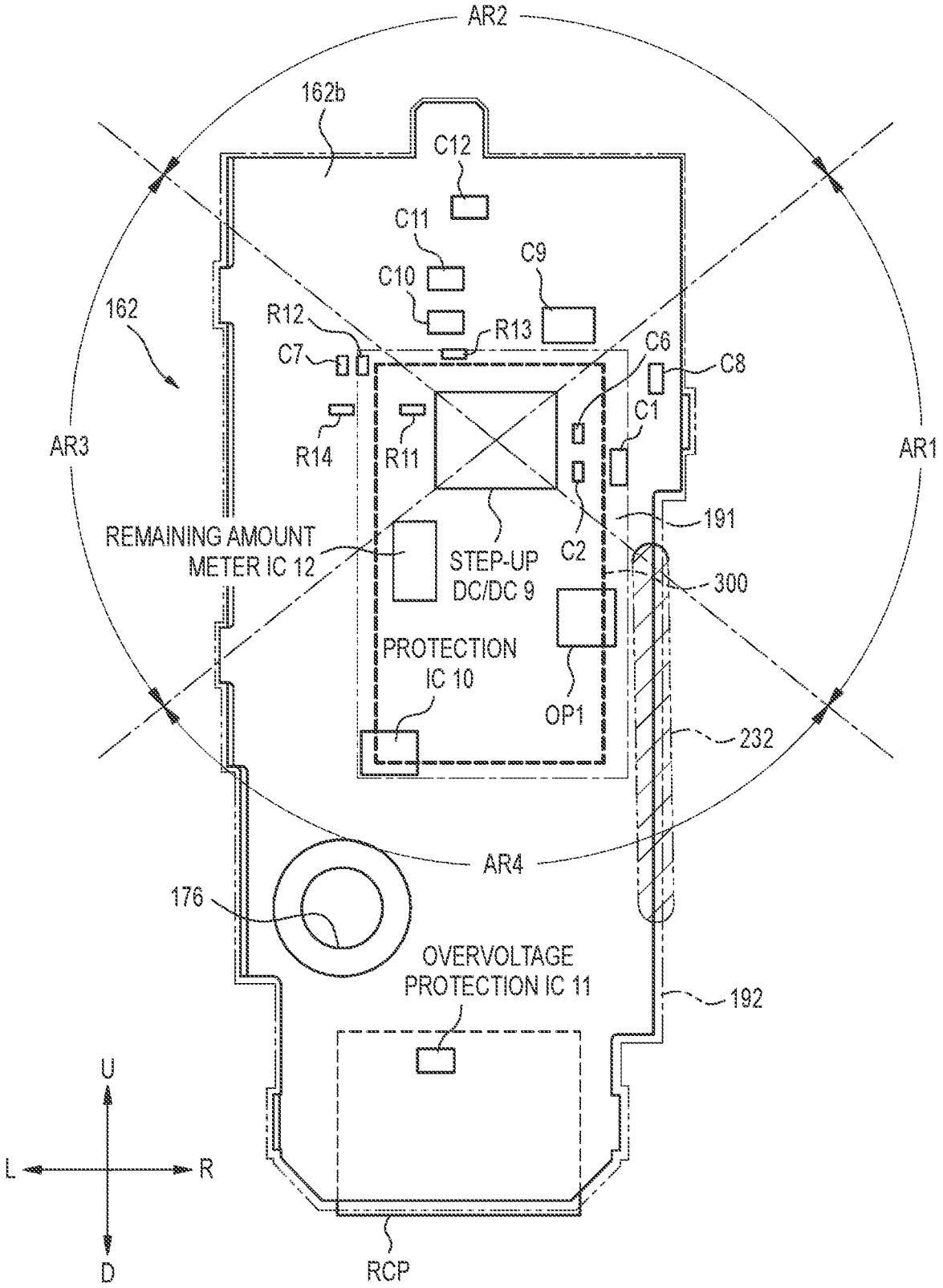
FIG. 23 is a view illustrating a secondary surface of the receptacle-mounted board.

FIG. 23 is a view illustrating the secondary surface 162*b* of the receptacle-mounted board 162. The secondary surface 162*b* of the receptacle-mounted board 162 is provided with a substantially rectangular IC-mounted region 191 in which a main IC or the like is mounted at a substantially central portion in the up-down direction, and the step-up DC/DC converter 9, the remaining amount meter IC 12, the operational amplifier OP1, and the protection IC 10 are disposed in the IC-mounted region 191. In addition, the resistors R11, R12, and R13 and the capacitors C1, C2, and C6, which are control elements, are disposed in the IC-mounted region 191. Since these control elements are disposed on the same surface as the step-up DC/DC converter 9, a wiring pattern can be simplified. In the secondary surface 162*b*, a region other than the IC-mounted region 191 is referred to as a residual region 192.

As described above, at least a part of the IC-mounted region 191 is covered with the thermal diffusion member 300 having a thermal diffusivity higher than that of air. In FIG. 23, a region covered with the thermal diffusion member 300 is indicated by a thick dotted line.

The thermal diffusion member 300 covers only the IC-mounted region 191 of the IC-mounted region 191 and the residual region 192 of the secondary surface 162*b*, and further covers only a part of the IC-mounted region 191. Accordingly, even when the size and the weight of the thermal diffusion member 300 are not excessively increased, concentration of heat can be effectively eliminated, and thus the operation of the inhaler 100 can be stabilized while preventing an increase in cost and weight of the inhaler 100.

More specifically, the thermal diffusion member 300 covers at least a part of the step-up DC/DC converter 9, the remaining amount meter IC 12, the protection IC 10, the resistor R11, the capacitors C2 and C6, and the operational amplifier OP1. In FIG. 20, the electronic components covered with the thermal diffusion member 300 are illustrated inside the thick dotted line. The electronic component is a concept including an integrated circuit (IC), an element (active element, passive element), and a receptacle.

The thermal diffusion member 300 partially covers at least the operational amplifier OP1, the remaining amount meter IC 12, and the protection IC 10, whereby the electronic components are less likely to be affected by heat, and thus the operation of the inhaler 100 is stabilized.

The thermal diffusion member 300 covers at least a part of the step-up DC/DC converter 9, whereby the temperature of the step-up DC/DC converter 9 is less likely to increase due to the thermal diffusion member 300, and the operation of the step-up DC/DC converter 9 is stabilized. Accordingly, the amount and the fragrance of the generated aerosol can be stabilized. The thermal diffusion member 300 preferably covers the entire step-up DC/DC converter 9. The thermal diffusion member 300 having a large area can effectively dissipate the heat generated by the step-up DC/DC converter 9 and the like, and can prevent local heating of the chassis 150, and thus the durability of the inhaler 100 can be improved.

On the other hand, the thermal diffusion member 300 does not cover the resistors R12 and R13 connected to detection terminals. The resistors R12 and R13 are used for the feedback terminal FB to detect a voltage as described above, and the step-up DC/DC converter 9 executes voltage conversion control of outputting from the output terminal VOUT based on the voltage input to the feedback terminal FB. Although the resistors R12 and R13 are fixed resistors whose electric resistance values hardly change depending on the temperature, the electric resistance values may slightly change when the temperature becomes high. Since the thermal diffusion member 300 does not cover the resistors R12 and R13, the resistors R12 and R13 are less likely to be affected by heat, and the output voltages detected by the resistors R12 and R13 are stabilized.

The thermal diffusion member 300 partially covers at least half of the plurality of control elements connected to the plurality of control terminals different from the feedback terminal FB of the step-up DC/DC converter 9. In the present embodiment, as illustrated in FIG. 20, the step-up DC/DC converter 9 includes the first to third control terminals P31, P32, and P33 as main control terminals, and the capacitor C6, the resistor R11, the resistor R14, and the capacitor C7 are provided as control elements connected to the control terminals. The thermal diffusion member 300 partially covers at least the resistor R11 and the capacitor C6 among the four control elements. By covering half of the control elements in this way, the area of the thermal diffusion member 300 can be increased, and the effect of thermal diffusion can be enhanced. The thermal diffusion member 300 may partially cover at least a part of the resistor R14 and the capacitor C7. In this way, since over half of the control elements are covered, the area of the thermal diffusion member 300 can be further increased, and the effect of thermal diffusion can be further enhanced.

The thermal diffusion member 300 does not cover the reactor Lc of the step-up DC/DC converter 9. As described above, the reactor Lc of the step-up DC/DC converter 9 is disposed on the main surface 162*a* of the receptacle-mounted board 162. The size of the reactor Lc connected to the step-up DC/DC converter 9 increases according to the current output by the step-up DC/DC converter 9. Since the heater HTR in the inhaler 100 is a component having the largest current consumption and the largest power consumption, the reactor Lc is likely to be larger than the step-up DC/DC converter 9. In addition, the reactor Lc generates less heat than the step-up DC/DC converter 9 built with a switch which is switched at the time of stepping up. Therefore, since the thermal diffusion member 300 does not cover the reactor Lc, it is possible to prevent the size of the thermal diffusion member 300 from becoming extremely large or the shape thereof from becoming complicated. By protecting an appropriate electronic component using the thermal diffusion member 300 having a simple shape in this way, the operation of the inhaler 100 can be stabilized. As compared with a case where the step-up DC/DC converter 9 and the reactor Lc occupying a large area on the board are disposed on the same surface of the circuit board, the size of the board can be reduced, and thus the cost and the size of the inhaler 100 can be reduced.

The thermal diffusion member 300 does not cover the reactor capacitors C3 to C5, and similarly to the reactor Lc, the reactor capacitors C3 to C5 are also disposed on the main surface 162*a* of the receptacle-mounted board 162. The thermal diffusion member 300 does not cover the reactor capacitors C3 to C5 which generate a relatively small amount of heat, whereby it is possible to prevent the size of the thermal diffusion member 300 from becoming extremely large or the shape thereof from becoming complicated. By protecting an appropriate electronic component using the thermal diffusion member 300 having a simple shape, the operation of the inhaler 100 can be stabilized. As compared with a case where the step-up DC/DC converter 9 and the reactor capacitors C3 to C5 occupying a large area on the board are disposed on the same surface, the size of the board can be reduced, and thus the cost and the size of the inhaler 100 can be reduced.

In addition, the thermal diffusion member 300 does not cover the output capacitors C8 to C12. The output capacitors C8 to C12 generally have large capacitances to be able to sufficiently remove a ripple current and a ripple voltage. The size of the capacitor roughly depends on its capacitance. When the output capacitors C8 to C12 are covered, the size of the thermal diffusion member 300 is increased. In addition, the output capacitors C8 to C12 generate heat when a ripple of a current or a voltage is removed. Such output capacitors C8 to C12 are not covered with the thermal diffusion member 300, whereby the heat generated by the step-up DC/DC converter 9 can be effectively diffused, and the cost of the inhaler 100 can be reduced.

The output capacitors C9 to C12 are electronic components having the highest height among the electronic components disposed on the secondary surface 162*b*. The output capacitors C9 to C12 are disposed in the residual region 192 where the thermal diffusion member 300 is not disposed, and are not covered with the thermal diffusion member 300. The thermal diffusion member 300 does not cover the electronic component having the largest height, whereby it is possible to prevent the size of the thermal diffusion member 300 from becoming extremely large or the shape thereof from becoming complicated. As illustrated in FIG. 23, in addition to the output capacitors C9 to C12, the capacitor C7, the output capacitor C8, the resistor R14, the overvoltage protection IC 11, and the like are disposed in the residual region 192.

The thermal diffusion member 300 partially covers the bypass capacitors C1 and C2. More specifically, of the plurality of bypass capacitors C1 and C2, the thermal diffusion member 300 covers the second bypass capacitor C2 without covering the first bypass capacitor C1. The bypass capacitors C1 and C2 prevent a ripple current or a ripple voltage from being input to the input terminal VIN of the step-up DC/DC converter 9. It is preferable to provide a plurality of smoothing capacitors as bypass capacitors for sufficient smoothing. However, when temperatures of the bypass capacitors C1 and C2 become high, a ripple current or a ripple voltage may not be sufficiently removed. On the other hand, when the thermal diffusion member 300 covers both the bypass capacitors C1 and C2, the size of the thermal diffusion member 300 becomes extremely large or the shape thereof becomes complicated. Therefore, the thermal diffusion member 300 partially covers at least a part of the plurality of bypass capacitors C1 and C2 (in the present embodiment, the second bypass capacitor C2), whereby the thermal diffusion member 300 prevents the temperature of the second bypass capacitor C2 from becoming high, and the step-up DC/DC converter 9 is less likely to fail or malfunction. Further, by covering only the second bypass capacitor C2, it is possible to prevent the size of the thermal diffusion member 300 from becoming extremely large or the shape thereof from becoming complicated.

Here, the second bypass capacitor C2 is a capacitor having a smaller capacitance than the first bypass capacitor C1. As described above, the size of the capacitor roughly depends on its capacitance. That is, it can be said that a capacitor having a smaller capacitance is more likely to generate heat locally. Therefore, it is preferable to protect the second bypass capacitor C2 having a small capacitance in preference to the thermal diffusion member 300. By protecting an appropriate electronic component using the thermal diffusion member 300 having a simple shape in this way, the operation of the inhaler 100 can be stabilized. Instead of the present embodiment, of the plurality of bypass capacitors C1 and C2, the thermal diffusion member 300 may cover the first bypass capacitor C1 without covering the second bypass capacitor C2. The thermal diffusion member 300 may cover only a part of the first bypass capacitor C1 and/or a part of the second bypass capacitor C2.

[Ground]

Figure 24A:
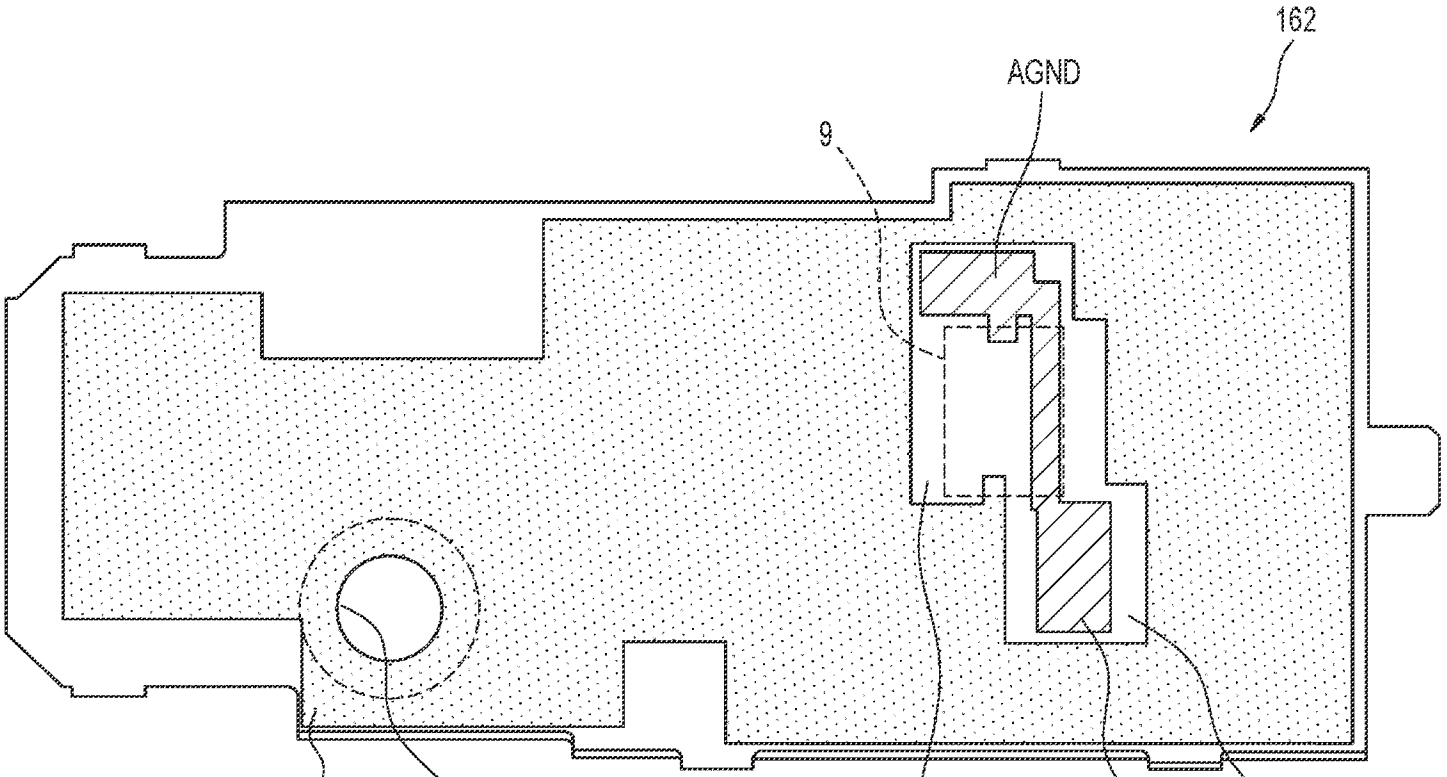
FIGS. 24A and 24B are a view illustrating an inner structure of the receptacle-mounted board.
Figure 24B:
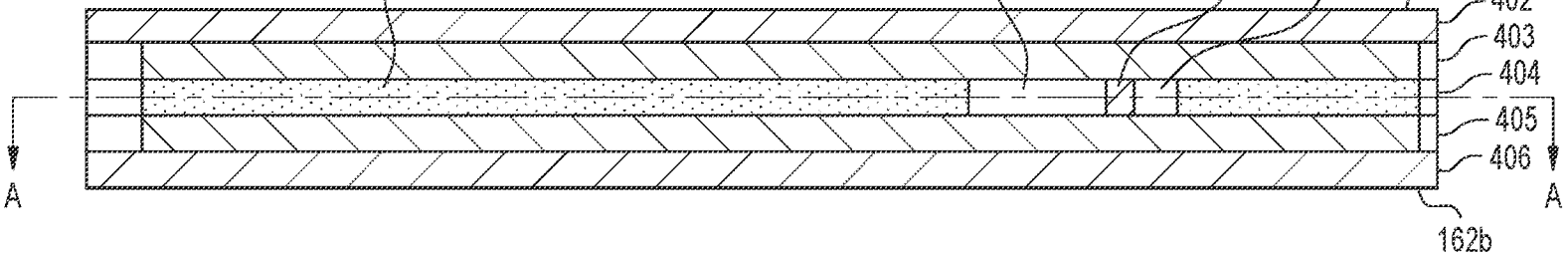

Next, the ground of the receptacle-mounted board 162 will be described with reference to FIGS. 24A and 24B. FIGS. 24A and 24B are views illustrating an internal structure of the receptacle-mounted board 162, and FIG. 24A is a cross-sectional view taken along a line A-A of FIG. 24B. In addition, FIG. 24B is a cross-sectional view of the receptacle-mounted board 162 taken along the front-rear direction.

As illustrated in FIGS. 24A and 24B, the receptacle-mounted board 162 is a multilayer board formed by laminating a plurality of layers. The receptacle-mounted board 162 includes a main-surface-side surface layer 402 constituting the main surface 162*a*, a ground layer 404 provided with two grounds PGND and AGND insulated from each other, a secondary-surface-side surface layer 406 constituting the secondary surface 162*b*, a main-surface-side power supply layer 403 provided between the main-surface-side surface layer 402 and the ground layer 404, and a secondary-surface-side power supply layer 405 provided between the secondary-surface-side surface layer 406 and the ground layer 404. A prepreg (not illustrated) is provided between the layers, and the adjacent layers are maintained in an insulated state.

The main-surface-side power supply layer 403 and the secondary-surface-side power supply layer 405 are appropriately electrically connected to each other through a via (through hole) (not illustrated), and constitute a circuit indicated by a thin solid line indicated by the range 162A mounted on the receptacle-mounted board 162 in FIG. 12. In the periphery of the step-up DC/DC converter 9, the input terminal VIN of the step-up DC/DC converter 9, the switching terminal SW, one ends of the bypass capacitors C1 and C2, both ends of the reactor Lc, one ends of the reactor capacitors C3 to C5, one ends of the output capacitors C8 to C12, and the output terminal VOUT are connected to the main-surface-side power supply layer 403 and the secondary-surface-side power supply layer 405.

The ground layer 404 is provided with two grounds of the power ground PGND connected to a circuit through which a relatively large current flows and the signal ground AGND connected to a circuit through which a relatively small current flows. A region between the power ground PGND and the signal ground AGND in the ground layer 404 is an insulating portion 194 made of an insulating material.

As illustrated in FIG. 20, the power ground PGND is connected to the power ground terminal PGP of the step-up DC/DC converter 9 (ground terminal GND of the step-up DC/DC converter 9 in FIG. 10), the other ends of the reactor capacitors C3 to C5, one ends of which are connected to a wiring connecting the node N1 and the reactor Lc, and the other ends of the output capacitors C8 to C12, one ends of which are connected to a wiring connecting the output terminal VOUT and the node N2.

In addition, the power ground PGND is the ground line illustrated in FIG. 10 as described above, and the power ground PGND is connected to the power supply terminal VSS and the ground terminal GND of the protection IC 10, the overvoltage protection IC 11, the remaining amount meter IC 12, and the receptacle RCP, which are included in the range 162A mounted on the receptacle-mounted board 162 of FIG. 12.

Further, as illustrated in FIG. 10, the power ground PGND is connected to the switch S6 which is a transistor connected to a negative electrode of the heater connector Cn, and is further connected to the ground terminal GND of the receptacle RCP. The output terminal VOUT of the step-up DC/DC converter 9, the other IC, the switch S6, and the receptacle RCP are connected to the same ground, whereby these elements have a common reference potential (=potential of power ground PGND). Therefore, the operation of the inhaler 100 is stabilized, and a short circuit is less likely to occur therebetween, thereby improving the safety of the inhaler 100.

In addition, the power ground PGND of the receptacle-mounted board 162 is connected to the ground of the MCU-mounted board 161 via the spacer 173 as described above. As a result, ground potentials of the MCU-mounted board 161 and the receptacle-mounted board 162 can be equalized, and supply of charging power and operating power between the MCU-mounted board 161 and the receptacle-mounted board 162 and communication therebetween can be stabilized. On the other hand, the ground of the MCU-mounted board 161 is not directly connected to the signal ground AGND. Therefore, the signal ground AGND is less likely to be affected by heat or noise generated when potentials of the power ground PGND and the ground of the MCU-mounted board 161 are combined.

The signal ground AGND is connected to the signal ground terminal AGP of the step-up DC/DC converter 9, the other end of the resistor R11 of which one end is connected to the second control terminal P32, the other ends of the bypass capacitors C1 and C2 of which one ends are connected to a connection line between the node N1 and the input terminal VIN, the other end of the series circuit of the resistor R14 and the capacitor C7 of which one end is connected to the third control terminal P33, the other end of the voltage divider circuit Pg of which one end is connected to a connection line between the output terminal VOUT and the output capacitors C8 to C12 and having a connection point connected to the feedback terminal FB, and the other end of the capacitor C6 of which one end is connected to the first control terminal P31. That is, the resistors R11 to R14, the capacitors C6 and C7, and the bypass capacitors C1 and C2 are disposed on a power path between the step-up DC/DC converter 9 and the signal ground AGND. These electronic components are electronic components that function when the voltage conversion control is executed by the step-up DC/DC converter 9.

In this way, the signal ground AGND is connected to the electronic components that function when the voltage conversion control is executed, and is more preferably connected to only the electronic components that function when the voltage conversion control is executed. The signal ground AGND is not connected to an electronic component having low relevance to the step-up DC/DC converter 9, whereby the potential of the signal ground AGND is stabilized, and a voltage value detected by the feedback terminal FB is also stabilized. Therefore, the voltage applied to the heater HTR by the step-up DC/DC converter 9 can be stabilized, and the amount and the fragrance of the generated aerosol can be stabilized. On the other hand, among the electronic components disposed on the receptacle-mounted board 162, the receptacle RCP and the overvoltage protection IC 11, which are electronic components that function when the voltage conversion control is not executed, are connected to the power ground PGND (see FIG. 10).

An electronic component having low relevance to the step-up DC/DC converter 9 may be connected to the signal ground AGND. However, the number of the electronic components that function when the voltage conversion control is executed by the step-up DC/DC converter 9 and that are connected to the signal ground AGND is preferably larger than the number of the electronic components that function when the voltage conversion control is not executed and that are connected to the signal ground AGND. Accordingly, the potential of the signal ground AGND is stabilized, the voltage value detected by the feedback terminal FB is also stabilized, and thus the voltage applied to the heater HTR by the step-up DC/DC converter 9 can be stabilized, and the amount and the fragrance of the generated aerosol can be stabilized.

Among the resistors R11 to R14, the capacitors C6 and C7, and the bypass capacitors C1 and C2, which are elements disposed on the power path between the step-up DC/DC converter 9 and the signal ground AGND, it is preferable that the number of elements disposed on the secondary surface 162*b* is larger than the number of elements disposed on the main surface 162*a*, and it is more preferable that all the elements are disposed on the secondary surface 162*b*. In the present embodiment, all of the resistors R11 to R14, the capacitors C6 and C7, and the bypass capacitors C1 and C2 are disposed on the secondary surface 162*b*. Accordingly, it is possible to reduce a situation in which the signal ground AGND is formed into a shape that connects the elements disposed on the respective surfaces, and thus it is possible to reduce the size of the signal ground AGND and to reduce the possibility that noise enters from other positions of the board. In addition, it is possible to increase the area of the power ground PGND and to stabilize the potential of the power ground PGND.

In addition, it is preferable that the resistors R11 to R14, the capacitors C6 and C7, and the bypass capacitors C1 and C2 are collectively disposed. In the present embodiment, as illustrated in FIG. 23, in a case where four regions on the circuit board partitioned and formed by four diagonal lines starting from a center of the step-up DC/DC converter 9 and extending so as to include the vertex of the step-up DC/DC converter 9 when viewed from the direction orthogonal to the secondary surface 162*b* (front-rear direction in the present embodiment) are denoted by a first region AR1 to a fourth region AR4, the bypass capacitors C1, C2 and the capacitor C6 are disposed in the first region AR1, and the resistors R11, R12, R14 and the capacitor C7 are disposed in the third region AR3. In addition, the resistor R13 is disposed in the second region AR2, and none of the elements is disposed in the fourth region AR4. By providing a region in which a plurality of elements are disposed on the power path between the step-up DC/DC converter 9 and the signal ground AGND and a region in which no element is disposed in this way and disposing elements connected to the signal ground AGND in a concentrated manner on the board, it is possible to reduce the area of the signal ground AGND and to reduce the possibility of noise entering from other positions on the board. In addition, it is possible to increase the area of the power ground PGND and to stabilize the potential of the power ground PGND.

As illustrated in FIGS. 24A and 24B, the area of the power ground PGND (region hatched with dots in FIG. 24A) is larger than the area of the signal ground AGND (region hatched with oblique lines in FIG. 24A). The power ground PGND has a large area, whereby the potential of the power ground PGND is stabilized. Accordingly, a ripple of a current and a voltage can be more effectively removed from a waveform output by the step-up DC/DC converter 9, and thus the waveform of the voltage output by the step-up DC/DC converter 9 becomes close to an ideal stationary wave, and the amount and the fragrance of the generated aerosol can be stabilized.

In addition, the signal ground AGND is partially surrounded by at least the power ground PGND. In the present embodiment, the power ground PGND is disposed so as to surround the entire circumference of the signal ground AGND. Accordingly, the signal ground AGND is protected from external noise or the like by the power ground PGND.

In addition, in the present embodiment, the power ground PGND and the signal ground AGND are provided in the same layer in the receptacle-mounted board 162, which is a multilayer board, but without being limited thereto, may be provided in different layers. By provision in the same layer, the number of layers of the multilayer board can be reduced.

In addition, the power ground PGND and the signal ground AGND are electrically connected to each other by a common ground CGND. Two grounds have a common potential by the common ground CGND. The common ground CGND may be provided on the receptacle-mounted board 162 or may be provided outside the receptacle-mounted board 162. By provision outside the receptacle-mounted board 162, the power ground PGND and the signal ground AGND are separated from the common ground CGND, and the power ground PGND and the signal ground AGND are less likely to be affected by heat and noise derived from the common ground. Accordingly, the electronic components connected to the power ground PGND and the signal ground AGND are less likely to be affected by heat and noise generated along with elimination of a potential deviation, and the operation of the inhaler 100 is likely to be stabilized. The common ground CGND according to the present embodiment is provided on the bottom surface of the step-up DC/DC converter 9 as an example of the outside of the receptacle-mounted board 162.

Here, on the main surface 162*a* of the receptacle-mounted board 162, no electronic component is provided in a common ground projection region 167 overlapping with the common ground CGND when viewed from the direction orthogonal to the main surface 162*a* (front-rear direction in the present embodiment). FIG. 22 illustrates the common ground projection region 167. Since the two grounds PGND and AGND are insulated in the circuit board, the potentials are likely to be different. In the common ground CGND for eliminating the potential deviation, heat and noise are generated along with the elimination of the potential deviation. The heat and the noise may be transmitted to the vicinity of the common ground CGND, for example, to the right back of the common ground CGND. An electronic component is not disposed at such a position, whereby the electronic component is less likely to be affected by the heat or the noise generated along with the elimination of the potential deviation, and the operation of the inhaler 100 is likely to be stabilized.

On the other hand, on the main surface 162*a* of the step-up DC/DC converter 9, electronic components may be disposed in a residual portion projection region 168 overlapping with a residual portion 90 (see FIG. 20) of the bottom surface of the step-up DC/DC converter 9, which is not included in the common ground CGND, when viewed from the direction orthogonal to the main surface 162*a* (front-rear direction in the present embodiment). FIG. 22 illustrates the residual portion projection region 168 together with the common ground projection region 167. In a case where electronic components are disposed in the residual portion projection region 168, the degree of freedom of disposition of the electronic components on the circuit board is improved as compared with a case where the electronic components are not disposed in the entire region overlapping with the bottom surface of the step-up DC/DC converter 9, and thus the utilization efficiency of the circuit board is improved, and an increase in size of the circuit board can be avoided. The electronic components may include an active element such as an IC or a switch, and may include a passive element such as a resistor or a capacitor, but among the electronic components, it is preferable that at least one of a precise IC and a switch is not included, it is more preferable that neither the IC nor the switch are included, and among the electronic components, a passive element that is hardly affected by the noise or the heat is still more preferable. Accordingly, the operation of the inhaler 100 is likely to be stabilized while improving the utilization efficiency of the circuit board.

Further, the reactor Lc of the step-up DC/DC converter 9 disposed on the main surface 162*a* is preferably not disposed in the common ground projection region 167, and more preferably not disposed in the common ground projection region 167 and the residual portion projection region 168. The reactor Lc is not disposed in the common ground projection region 167, whereby the reactor Lc is less likely to be affected by the heat and the noise derived from the common ground CGND, and thus the voltage conversion in the step-up DC/DC converter 9 is more likely to be stabilized, and as a result, the amount and the fragrance of the generated aerosol are also stabilized.

[MCU-Mounted Board]

Figure 25:
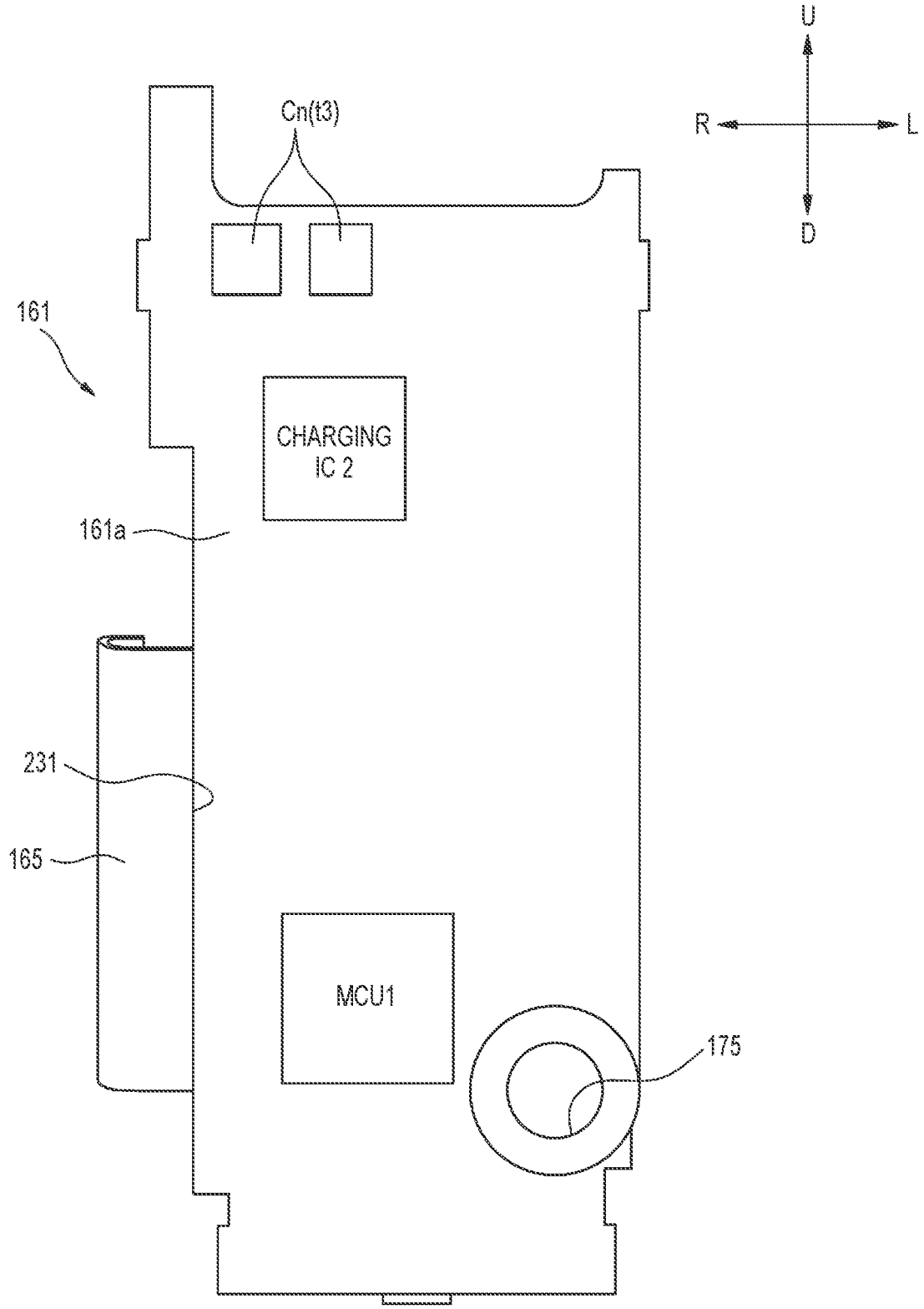
FIG. 25 is a view illustrating a main surface of an MCU-mounted board.

FIG. 25 is a diagram illustrating the main surface 161*a* of the MCU-mounted board 161. On the main surface 161*a* of the MCU-mounted board 161 extending in the up-down direction, the heater temperature detecting connector Cn (t3) to which the thermistor T3 constituting a heater temperature sensor is connected via a conductive wire is disposed at an upper end portion thereof, and the charging IC 2 is disposed at a lower side thereof. In addition, an opening portion 175 for fixing the spacer 173 is disposed at a position corresponding to the opening portion 176 of the receptacle-mounted board 162, and the MCU 1 is disposed in the vicinity of the opening portion 175.

By disposing the MCU 1 on the MCU-mounted board 161 with respect to the receptacle-mounted board 162 on which the receptacle RCP is disposed, the MCU 1 is separated from the receptacle RCP, and thus the MCU 1 is less likely to be affected by static electricity or the like that may enter from the receptacle RCP. Accordingly, the operation of the inhaler 100 can be further stabilized.

In addition, since the MCU 1 is disposed on the secondary surface 161*b* farther from the secondary surface 162*b* of the receptacle-mounted board 162 than the main surface 161*a*, the MCU 1 can be separated as far as possible from the receptacle-mounted board 162 and the power supply BAT which may be a heat source, and the operation of the inhaler 100 is stabilized.

Figure 26:
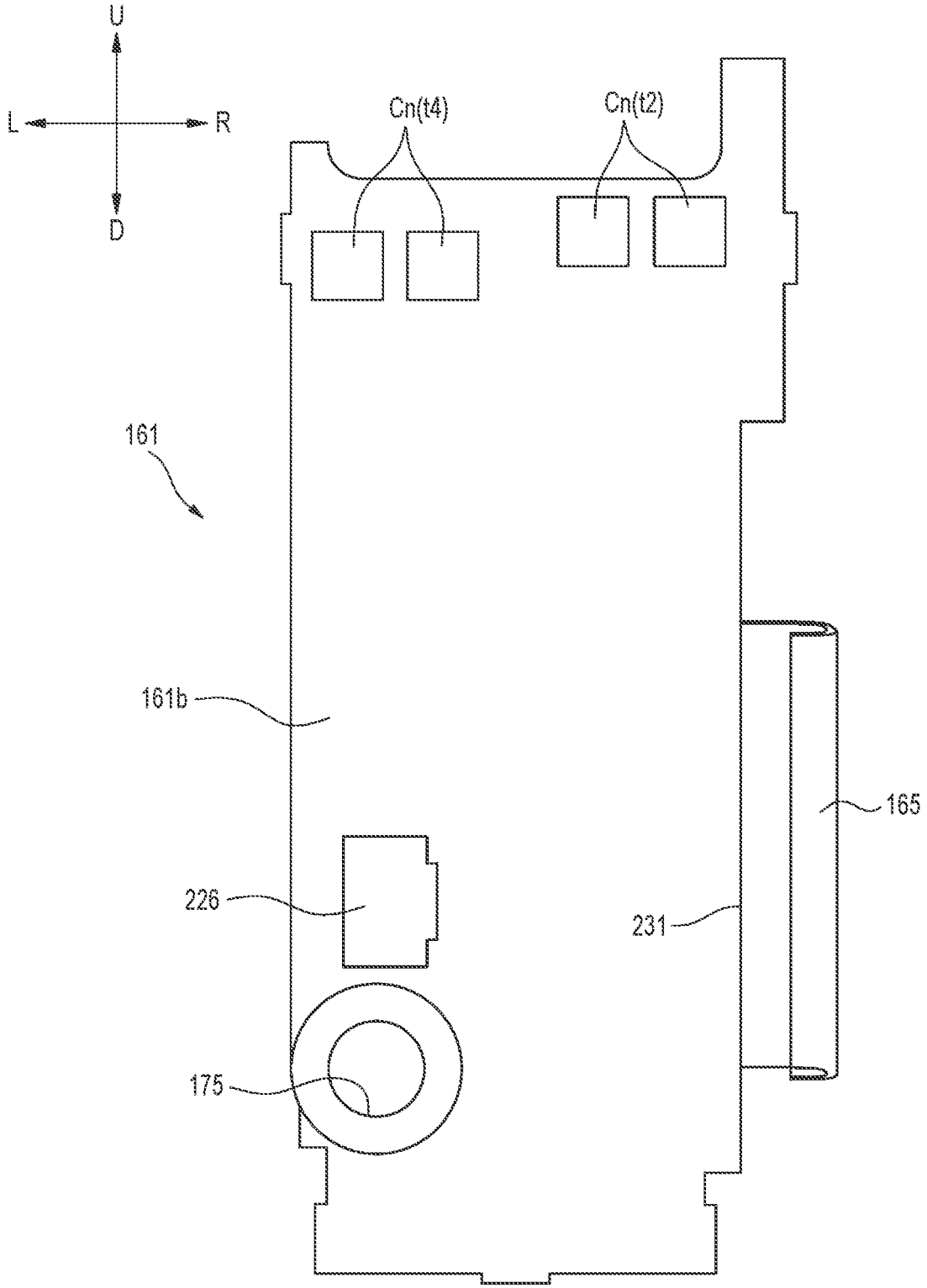
FIG. 26 is a view illustrating a secondary surface of the MCU-mounted board.

FIG. 26 is a diagram illustrating the secondary surface 161*b* of the MCU-mounted board 161. On the secondary surface 161*b* of the MCU-mounted board 161, a motor connector 226 to which the vibration motor M is connected via a conductive wire is disposed at an upper side of the opening portion 175, and a case temperature detecting connector Cn (t4) to which the thermistor T4 constituting a case temperature sensor is connected via a conductive wire and an intake detecting connector Cn (t2) to which the thermistor T2 constituting an intake sensor is connected via a conductive wire are disposed at an upper end portion thereof.

The flexible wiring board 165 electrically connecting the MCU-mounted board 161 and the receptacle-mounted board 162 connects FPC connection portions 231 and 232 of the MCU-mounted board 161 and the receptacle-mounted board 162. The FPC connection portions 231 and 232 are located at right end portions of the MCU-mounted board 161 and the receptacle-mounted board 162, respectively, and at positions reaching the vicinity of the opening portions 175 and 176 downward from a substantially central portion in the up-down direction.

Although various embodiments have been described above with reference to the drawings, it is needless to say that the present invention is not limited to these examples. It is apparent to those skilled in the art that various changes and modifications may be conceived within the scope described in the claims, and it is understood that the changes and the modifications naturally fall within the technical scope of the present invention. In addition, the components described in the above embodiments may be optionally combined without departing from the spirit of the invention.

For example, in the above-described embodiment, the reactor capacitors C3 to C5 are connected in parallel between the node N1 and one end of the reactor Lc, but may be connected in parallel between the other end of the reactor Lc and the switching terminal SW.

In the present description, at least the following matters are described. Corresponding constituent components and the like in the above-mentioned embodiment are shown in parentheses, but the present invention is not limited thereto.

(1) A power supply unit (non-combustion inhaler 100) for an aerosol generating device, including:

a power supply (power supply BAT);

a heater connector (heater connector Cn) connected to a heater (heater HTR) configured to heat an aerosol source by consuming power supplied from the power supply;

a voltage conversion IC (step-up DC/DC converter 9) connected to the heater connector and including an output terminal (output terminal VOUT) configured to convert and output an input voltage and a detection terminal (feedback terminal FB) configured to detect a voltage output from the output terminal;

a circuit board (receptacle-mounted board 162) including a first surface (secondary surface 162*b*) on which the voltage conversion IC is disposed and a second surface (main surface 162*a*) which is a back surface of the first surface;

a capacitor (output capacitors C8 to C12) having one end connected to the output terminal;

a first ground (power ground PGND) provided inside the circuit board and connected to an other end of the capacitor;

a second ground (signal ground AGND) provided inside the circuit board, insulated from the first ground inside the circuit board, and connected to the detection terminal; and a common ground (common ground CGND) configured to electrically connect the first ground and the second ground, in which on the second surface, no electronic component is provided in a common ground projection region (common ground projection region 167) overlapping with the common ground when viewed from a direction orthogonal to the circuit board.

Since the two grounds are insulated in the circuit board, the potentials may be different. In the common ground for eliminating the potential deviation, heat and noise are generated along with the elimination of the potential deviation. The heat and the noise may be transmitted to the vicinity of the common ground, for example, to the right back of the common ground. According to (1), an electronic component is not disposed at such a position, whereby the electronic component is less likely to be affected by the heat or the noise generated along with the elimination of the potential deviation, and the operation of the power supply unit for an aerosol generating device is stabilized.

(2) The power supply unit for an aerosol generating device according to (1), in which the common ground is provided on a bottom surface of the voltage conversion IC.

According to (2), by providing the common ground at a location separated from the other electronic components, the other electronic components are less likely to be affected by heat or noise derived from the common ground, and the operation of the power supply unit for an aerosol generating device is more likely to be stabilized.

(3) The power supply unit for an aerosol generating device according to (2), in which the common ground is provided on a part of a bottom surface of the voltage conversion IC, and on the second surface, a first electronic component is disposed in a residual portion projection region (residual portion projection region 168) overlapping with a residual portion (residual portion 90) not included in the part of the bottom surface of the voltage conversion IC when viewed from the direction orthogonal to the circuit board.

According to (3), the degree of freedom of disposition of the electronic components on the circuit board is improved as compared with a case where the electronic components are not disposed in the entire region overlapping with the bottom surface of the voltage conversion IC, and thus the utilization efficiency of the circuit board can be improved, and an increase in size of the circuit board can be avoided.

(4) The power supply unit for an aerosol generating device according to (3), in which the first electronic component does not include at least one of an IC and a switch.

According to (4), a precise IC or switch among the electronic components is not disposed in the residual portion projection region that is not as large as the common ground projection region but may be affected by noise or heat to some extent, whereby the operation of the aerosol generating device is likely to be stabilized while avoiding an increase in the size of the board.

(5) The power supply unit for an aerosol generating device according to (3), in which the first electronic component is a passive element.

According to (5), the passive element that is less likely to be affected by noise or heat among the electronic components is disposed in the residual portion projection region that is not as large as the common ground projection region but may be affected by noise or heat to some extent, whereby the operation of the aerosol generating device is likely to be stabilized.

(6) The power supply unit for an aerosol generating device according to any one of (1) to (5), further including:

a plurality of first elements (resistors R11 to R14 and capacitors C1, C2, C6, and C7) disposed on a power path between the voltage conversion IC and the second ground, in which the number of elements disposed on the first surface among the plurality of first elements is larger than the number of elements disposed on the second surface among the first elements.

According to (6), it is possible to reduce a situation in which the second ground is formed into a shape that connects the elements disposed on the respective surfaces, and thus it is possible to reduce the size of the second ground, to reduce the possibility of noise entering from other positions of the board, to increase the area of the first ground, and to stabilize the potential of the first ground.

(7) The power supply unit for an aerosol generating device according to (6), in which all of the first elements are disposed on the first surface.

According to (7), the second ground may not have a shape that connects the elements disposed on the respective surfaces, and thus it is possible to reduce the size of the second ground, to reduce the possibility of noise entering from other positions of the board, to increase the area of the first ground, and to stabilize the potential of the first ground.

(8) The power supply unit for an aerosol generating device according to (6), further including:

a plurality of first elements (resistors R11 to R14 and capacitors C1, C2, C6, and C7) disposed on a power path between the voltage conversion IC and the second ground, and disposed on the circuit board, in which:

the voltage conversion IC has an N-sided polygonal shape when viewed from the direction orthogonal to the circuit board; and at least one (regions AR1 and AR3) of N regions (regions AR1 to AR4) on the circuit board, which are defined and formed by N virtual lines starting from a center of the voltage conversion IC and extending so as to include vertices of the voltage conversion IC, includes a plurality of elements among the plurality of first elements.

According to (8), by disposing the elements connected to the second ground in a concentrated manner on the board, it is possible to reduce the area of the second ground, and thus it is possible to reduce the possibility of noise entering from other positions on the board, to increase the area of the first ground, and to stabilize the potential of the first ground.

(9) The power supply unit for an aerosol generating device according to (8), in which at least one (region AR4) of the N regions does not include the first element.

According to (9), by disposing the elements connected to the second ground in a concentrated manner on the board, it is possible to reduce the area of the second ground, and thus it is possible to reduce the possibility of noise entering from other positions on the board, to increase the area of the first ground, and to stabilize the potential of the first ground.

(10) The power supply unit for an aerosol generating device according to any one of (1) to (9), further including:

a reactor having one end connected to the power supply and an other end connected to the voltage conversion IC, in which the reactor is disposed on the second surface.

According to (10), the voltage conversion IC and the reactor are elements that generate heat during voltage conversion, and by disposing these on different surfaces, concentration of heat can be avoided, and thus the durability of the power supply unit for an aerosol generating device can be improved.

(11) The power supply unit for an aerosol generating device according to (10), in which the reactor is disposed in a region not included in the common ground projection region overlapping with the common ground when viewed from the direction orthogonal to the circuit board.

According to (11), the reactor is less likely to be affected by heat and noise derived from the common ground, and thus the voltage conversion in the voltage conversion IC is more likely to be stabilized, and as a result, the amount and the fragrance of the generated aerosol are also stabilized.

The invention claimed is:

1. A non-combustion inhaler, comprising:

a power supply;

a heater connector connected to a heater configured to heat an aerosol source by consuming power supplied from the power supply;

a voltage conversion integrated circuit (IC) connected to the heater connector and including an output terminal configured to convert and output an input voltage and a detection terminal configured to detect a voltage output from the output terminal;

a circuit board including a first surface on which the voltage conversion IC is disposed and a second surface which is a back surface of the first surface;

a capacitor having one end connected to the output terminal;

a first ground provided inside the circuit board and connected to an other end of the capacitor;

a second ground provided inside the circuit board, insulated from the first ground inside the circuit board, and connected to the detection terminal; and a common ground configured to electrically connect the first ground and the second ground, wherein on the second surface, no electronic component is provided in a common ground projection region overlapping with the common ground when viewed from a direction orthogonal to the circuit board.

2. The non-combustion inhaler according to claim 1, wherein the common ground is provided on a bottom surface of the voltage conversion IC.

3. The non-combustion inhaler according to claim 2, wherein:

the common ground is provided on a part of a bottom surface of the voltage conversion IC; and on the second surface, a first electronic component is disposed in a residual portion projection region overlapping with a residual portion not included in the part of the bottom surface of the voltage conversion IC when viewed from the direction orthogonal to the circuit board.

4. The non-combustion inhaler according to claim 3, wherein the first electronic component does not include at least one of an IC and a switch.

5. The non-combustion inhaler according to claim 3, wherein the first electronic component is a passive element.

6. The non-combustion inhaler according to claim 1, further comprising:

a plurality of first elements disposed on a power path between the voltage conversion IC and the second ground, wherein the number of elements disposed on the first surface among the plurality of first elements is larger than the number of elements disposed on the second surface among the first elements.

7. The non-combustion inhaler according to claim 6, wherein all of the first elements are disposed on the first surface.

8. The non-combustion inhaler according to claim 6, further comprising:

a plurality of first elements disposed on a power path between the voltage conversion IC and the second ground, and disposed on the circuit board, wherein:

the voltage conversion IC has an N-sided polygonal shape when viewed from the direction orthogonal to the circuit board; and at least one of N regions on the circuit board, which are defined and formed by N virtual lines starting from a center of the voltage conversion IC and extending so as to include vertices of the voltage conversion IC, includes a plurality of elements among the plurality of first elements.

9. The non-combustion inhaler according to claim 8, wherein at least one of the N regions does not include the first element.

10. The non-combustion inhaler according to claim 1, further comprising:

a reactor having one end connected to the power supply and an other end connected to the voltage conversion IC, wherein the reactor is disposed on the second surface.

11. The non-combustion inhaler according to claim 10, wherein the reactor is disposed in a region not included in the common ground projection region overlapping with the common ground when viewed from the direction orthogonal to the circuit board.

* * * * *